US005128866A

United States Patent [19]

Weakley

[11] Patent Number: 5,128,866

[45] Date of Patent: Jul. 7, 1992

[54] PORE PRESSURE PREDICTION METHOD

[75] Inventor: Robert R. Weakley, The Woodlands, Tex.

[73] Assignee: Chevron Corporation, San Francisco, Calif.

[21] Appl. No.: 535,345

[22] Filed: Jun. 8, 1990

Related U.S. Application Data

[63] Continuation-in-part of Ser. No. 408,650, Sep. 20, 1989, abandoned.

[51] Int. Cl.[5] ..... G01V 1/00

[52] U.S. Cl. ..... 364/421; 364/422; 367/73

[58] Field of Search ..... 364/421, 422; 367/14, 367/25, 73

[56] References Cited

U.S. PATENT DOCUMENTS

| | | | |
|---|---|---|---|
| 3,237,094 | 2/1966 | Blackburn et al. | 324/323 |
| 3,382,933 | 5/1968 | Hottman | 175/50 |
| 3,785,446 | 1/1974 | Fertl et al. | 175/50 |
| 3,898,610 | 8/1975 | Pennebaker, Jr. | 367/38 |
| 4,346,592 | 8/1982 | Fertl et al. | 73/152 |
| 4,399,525 | 8/1983 | Thompson et al. | 367/75 |
| 4,679,174 | 7/1987 | Gelfand | 367/73 |
| 4,817,062 | 3/1989 | DeBuyl et al. | 367/73 |
| 4,833,914 | 5/1989 | Rasmus | 73/152 |

OTHER PUBLICATIONS

C. E. Hottmann, et al. "Estimation of Formation Pressures from Log Derived Shale Properties" Jour. of Petr. Tech., Jun., 1965, pp. 717–722.

E. S. Pennebaker, Jr. "Seismic Data Indicate Depth, Magnitude of Abnormal Pressures" World Oil (Jun., 1968) pp. 73–77.

Edward B. Reynolds, et al. "The Geophysical Aspects of Abnormal Fluid Pressures" Houston Geol. Soc. A Study Group Report (1969–1971) pp. 31–47.

Benj. Eaton "The Effect of Overburden Stress on Geo Pressure Prediction on Well Logs" Jour. of Petr. Tech., (Aug. 1972) pp. 929–934.

P. Zseller "Determination of Layer Pressures Using Interval Velocities" Geofizikia Kozliemenyek vol. 25, pp. 39–51 (1979).

Kenneth H. Waters "Reflection Seismology" (2nd Ed., 1981, John Wiley & Sons) Section 5.2 pp. 160–166 and Sections 7.1–7.4, pp. 238–259.

D. Bilgeri, et al. "Predicting Abnormally Pressured Sedimentar Rocks" Geophysical Prospecting, (European Assoc. of Expl. Geoph.) vol. 30, pp. 608–621.

D. G. Stone "Predicting Pore Pressure and Porosity From V.S.P. (vertical Seismic Profile) AAPG Bull. " vol. 68, No. 4 p. 532 (Apr. 1984).

P.E. Pilkington "Uses of Pressure and Temperature Data in Exploration and New Developments in Overpressure Detection" Jour. of Petr. Tech. (May 1988) pp. 543–549.

R. R. Weakley "Use of Seismic Data to Predict Formation Pore Pressures (Sand Shale Depositional Environments" SPE/IADC, Paper No. 18713, Presented Feb. 28, 1989, New Orleans, La.

*Primary Examiner*—Dale M. Shaw
*Assistant Examiner*—David Huntley
*Attorney, Agent, or Firm*—Burns, Doane, Swecker & Mathis

[57] ABSTRACT

A method of predicting pore pressures at a proposed drilling location using Interval Transit Times derived from seismic data and Interval Transit Times from a calibrated normal geopressure trend. Seismic Interval Transit Times derived pore pressures and actual pore pressures derived from logs in a drilled well at an offset location are used to correlate graphically or analytically the seismic Interval Transit Times to normal geopressure interval transit times from a proposed drilling location to be used in the prediction of pore pressures at the proposed location.

10 Claims, 60 Drawing Sheets

Offset Well

Offset Well

Offset Well

Offset Well

Offset Well

| Offset Well | | | Prospect Well | | |
|---|---|---|---|---|---|
| Depth | PP | 2 Way Time | Depth | PP | 2 Way Time |
| 2300 | 8.5 | .768 | 2480 | 8.5 | .830 |
| 2900 | 8.7 | .960 | 3080 | 8.7 | 1.000 |
| 3200 | 9.0 | 1.040 | 3320 | 9.0 | 1.075 |
| 3500 | 9.2 | 1.134 | 3760 | 9.2 | 1.200 |
| 4550 | 9.9 | 1.400 | 4570 | 9.9 | 1.400 |
| 5300 | 10.0 | 1.600 | 5160 | 10.0 | 1.585 |
| 6750 | 10.0 | 1.940 | 7000 | 10.0 | 1.990 |
| 7700 | 11.1 | 2.152 | 7720 | 11.1 | 2.150 |
| 9300 | 11.3 | 2.476 | - | - | - |
| 9500 | 11.5 | 2.524 | 9500 | 11.5 | 2.525 |
| 10800 | 11.8 | 2.776 | 11080 | 11.7 | 2.815 |
| 11200 | 11.8 | 2.846 | 11200 | 11.8 | 2.845 |
| 11600 | 12.0 | 2.924 | - | - | - |
| 11900 | 11.8 | 2.976 | 11900 | 11.8 | 2.980 |
| 13400 | 11.9 | 3.230 | | | |

FIG. 28

Prospect Well Correlative Prediction

ITT - Offset Well

Offset Well

Offset Well ITT

Offset Well

ITT

Offset Well

ITT

Offset Well Shifted

ITT Prospect Well

Prospect Well ITT

Prospect Well

Prospect Well

Prospect Well

Prospect Well

Prospect Well

PORE PRESSURE PREDICTION METHOD

This application is a continuation-in-part of U.S. Ser. No. 07/408,650 filed Sep. 20, 1989, now abandoned.

FIELD OF THE INVENTION

The present invention relates to a method of predicting pore pressures over known depth intervals of a well bore prior to drilling at a given location. More specifically, it relates to a method of estimating pore pressures of earth formations along the length of a well bore to reach a subterranean reservoir from a proposed drilling site using seismic data recorded at the earth's surface over the drilling site as calibrated in accordance with similar recorded seismic data and well logs recorded in and around a well bore at an offset location proximate to the proposed well location.

BACKGROUND OF THE INVENTION

The most economical method of drilling a well bore is to use conventional open hole drilling techniques to drill an appropriate diameter hole with standard drilling fluid compositions. However such conventional methods are frequently not suitable where "abnormally" pressured formations may be encountered by the well bore during drilling. Such conditions frequently lead to sticking the drill string or risking the blowout of the well by high pressure gas or oil in the over-pressured zone. Such sticking may occur by inadvertent fracture of a lower pressured zone above or below the high pressure zone. Accurate prediction of pore pressures that may be expected along the length of a drilling well, especially exploration wells, has traditionally been a difficult industry problem. Where abnormal pressures are known to exist, or may be found unexpectedly along the length of such well bores, accurate prediction of the depth at which such pressures will be encountered may be critical to the economic success of the drilling operation. The particular problem presented in these situations is that it is generally necessary to run several different diameters of concentric well casings from the surface of the earth to points above and below such high pressure zones. This permits control of the well bore pressure by drilling fluid alone through potentially oil productive zones. The cost of individual well casings from the surface to the intended well depth represents high economic risk to drill the well. If the well bore and casing are too large, the drilling cost per foot of depth is substantially higher. If the bore hole is too small, the result may be that the diameter of the well casing and the bore hole is too small to accommodate the necessary number of drill casings to control the well. This may lead to drilling a well so that it fails to reach the intended depth objective, due to inadequate casing diameter to accommodate enough concentric casing strings. On the other hand, unnecessary well casing programs may interfere with use of conventional well testing or well logging methods to evaluate potentially productive formations along the well bore.

It is a particular object of the present invention to predict more accurately pore pressures that may be encountered in drilling the proposed well, and particularly in undrilled areas, including wildcat or stepout wells, where subsurface data is incomplete or not readily available. An estimate of the pore pressures in a well bore to be drilled at a selected well location is obtained by utilizing seismic data collected and recorded down to depths extending through both an area below a proposed well site and below or adjacent to a drilled well near the proposed well. In both areas, time-amplitude seismic "traces" having a common mid-point (CMP) between a plurality of pairs of sources and detectors are recorded for a multiplicity of different source-detector distances or offsets, each pair having the same common mid-point. Such separate traces are selectively corrected and stacked or combined to correct for "move-out" (to compensate for different distances between each pair of sources and detectors after reflection from various depths along the mid-point). Such traces are also corrected for dip of the reflecting horizons and other errors due to difference in geometry and geology between the sources and detectors. Such combined traces yield so-called "stacking velocities" over the various subterranean geological intervals underlying both the adjacently drilled and proposed well location. The drilled well is selected as close as possible to the given or proposed drill site. However, the only information contained in the combined seismic traces are time and amplitude; that is, the time required for a seismic wave to travel from a source to a seismic discontinuity, which then reflects the wave back to a detector, and the amplitude of the reflected wave. The actual depth of each reflector in such traces must be converted to depth-amplitude by relying entirely upon a knowledge of the velocity of each interval of the rock sequences through which the seismic wave has traveled before it is imaged by the seismic trace.

Such seismic time and amplitude records or "traces", indicate only the average of all strata through which the seismic energy has passed, from the source to a reflector and back to a detector. Where the depth of the strata acting as reflectors are shallow, say a few thousand feet, and the bedding planes are not complex, few of the amplitudes represent multiple reflections, and such velocities correlate well with the true depths of such strata. However, at greater depths of, say 5,000 to 14,000 feet, such recorded traces velocities may change with depth, and geometry of the reflecting beds, as well as many factors depending upon physical or chemical structure, or both. Thus, based on the summed interval velocities of all strata, the depth of such seismic reflectors, as evidenced by the amplitude spikes, may vary in actual depth over several tens or even hundreds of feet. Accordingly, a particular difficulty in previously known methods of predicting pore pressures at given depths under an exploratory well from such seismic data alone lies in the lack of detailed information as to the actual velocities of portions, or intervals, of the geological column, through which the seismic waves travel.

It has been proposed, (and commonly used in field operations) to calibrate pore pressures derived from measurements in an adjacent drilled well to pore pressures based on an interval transit time log derived from measurements based on of seismic traces recorded at the earth's surface from common mid-points adjacent the same well. The well pore pressures are generally based on empirically developed mathematical relations between interval transit times recorded as sonic logs, either directly generated, or synthesized, from electrical logs, conductivity logs, or density logs recorded in the well, and pore pressures measured on cores or chips recovered from drilling fluid from known depths in the drilled well. These calculated values are then directly related to true depth of strata to determine the interval velocity of strata penetrated by a well bore. Thus, actual pore pressures at selected depths are convertible (from interval transit times for some waves) to pore pressures extending over the same depth as the adjacent seismic data trace.

Based on such measured pore pressures in the adjacent drilled well, it has been further proposed to use a similar stacked seismic trace at a proposed well site to calculate similar pore pressures from interval transit times measured on a synthetic sonic log constructed from such seismic trace. However, calculations of pore pressures from selected interval transit times also require a knowledge of the "normal" trend of pore pressures over the same depth intervals. Because such detailed knowledge, required to draw a normal trend line, is frequently not available from the adjacent well, a normal trend line is generally drawn arbitrarily to match the general appearance of the seismic trace. Furthermore, because such a normal trend line in fact depends on age and lithology of the geological column, as well as pore pressures, I have found that the true values of pore pressures derived from a seismic trace and an assumed "normal" trend line may be vertically displaced over significant depths of from several feet up to several hundred feet. This is due to the need at each depth to use both the "measured" values established by the seismic curve and "normal" values of the overburden, or geostatic pressures established by the trend line at the same depth to calculate a pore pressure at that depth. Accordingly, the pore pressures assigned to the seismic curve, to a large extent, depend upon the accuracy of a normal trend line selected arbitrarily. Accordingly, such derived pore pressures at a given depth are not sufficiently accurate to develop a reliable drilling program of casing diameters and drilling fluid weight, or density, to adequately control well pressures at critical points during drilling.

SUMMARY OF THE INVENTION

In accordance with the present invention, the true values of pore pressures at a given depth in a proposed well are developed by properly calibrating a suite of pore pressures calculated from the selected normal trend line and the common mid-point (CMP) seismic curve representing the drilled well to the well measured pore pressures over at least the critical depths of the well. I have found that by correctly adjusting or calibrating the normal trend line to be recorded seismic CMP trace at the proposed drill site, with the suite of calculated pore pressures matched to the measured pore pressures over thé depth as pre pressures derived from the synthetic sonic curve derived from the seismic trace at the proposed drill site may be used to indicate more precisely the true depth of an abnormally pressured formation before it is penetrated by the bore hole.

In accordance with the present invention, the normal trend of the overburden pressure, by which all values of pore pressure are calculated from interval transit time values, are generated by iterative comparison of such values with a similar series of discrete pore pressures over selected intervals of earth formations traversed by the adjacent drilled well. The suite of pore pressures may then be used through the critical drilling depths in the proposed well with pore pressures calculated from the calibrated normal pressure trend line and the synthetic sonic log derived from the stacked interval velocity seismic trace at the selected drill site. The iterative procedure may include selecting a multiplicity of normal trend lines having different slopes relative to a semi-log plot of interval transit time versus depth for direct comparison of a selected suite of successive pore pressures over a given depth interval which extends above and below the critical depths of the drilled well, or over the full length of the well by means of:

(a) a least squares method of curve matching as confirmed by comparable pore pressures;

(b) tables of values precalculated for reducing the differences in pore pressure values with successive substitution of values;

(c) graphically matching normal trend lines by trial and error to the seismic ITT curve to obtain similar sets of pore pressure values; or (d) iteratively computing pore pressures for a set of trend lines to reduce the differences toward zero values over the complete suite of pore pressure values.

Further objects and advantages of the present invention will become apparent from the following detailed description of the invention taken with the accompanying drawings which form an integral part of the present specification.

BRIEF DESCRIPTION OF THE DRAWINGS

FIGS. 18 to 45 are plots of graphs, similar to FIG. 1 to 15, useful in connection with Example II of this specification, as particularly directed to predicting pore pressures in wells in a North Sea drilling environment.

DETAILED DESCRIPTION OF THE INVENTION

Figure 1:
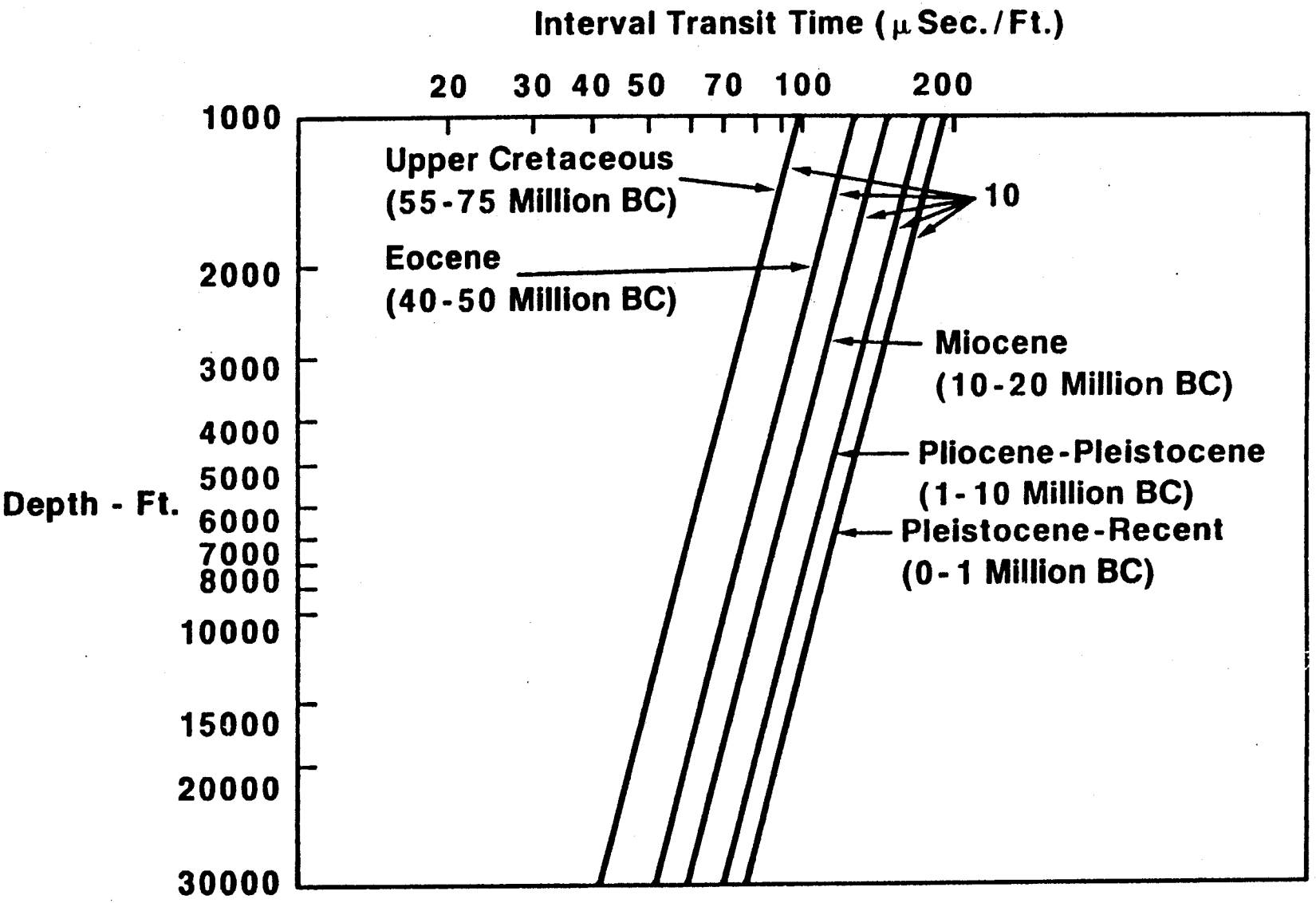
FIG. 1 is a log-log scale plot of seismic velocities, in interval transit times, (microseconds per foot) versus depth for strata of common geological ages and based on a normally pressured environment extrapolated to cover depth normally recorded by seismic surveys.
Figure 2:
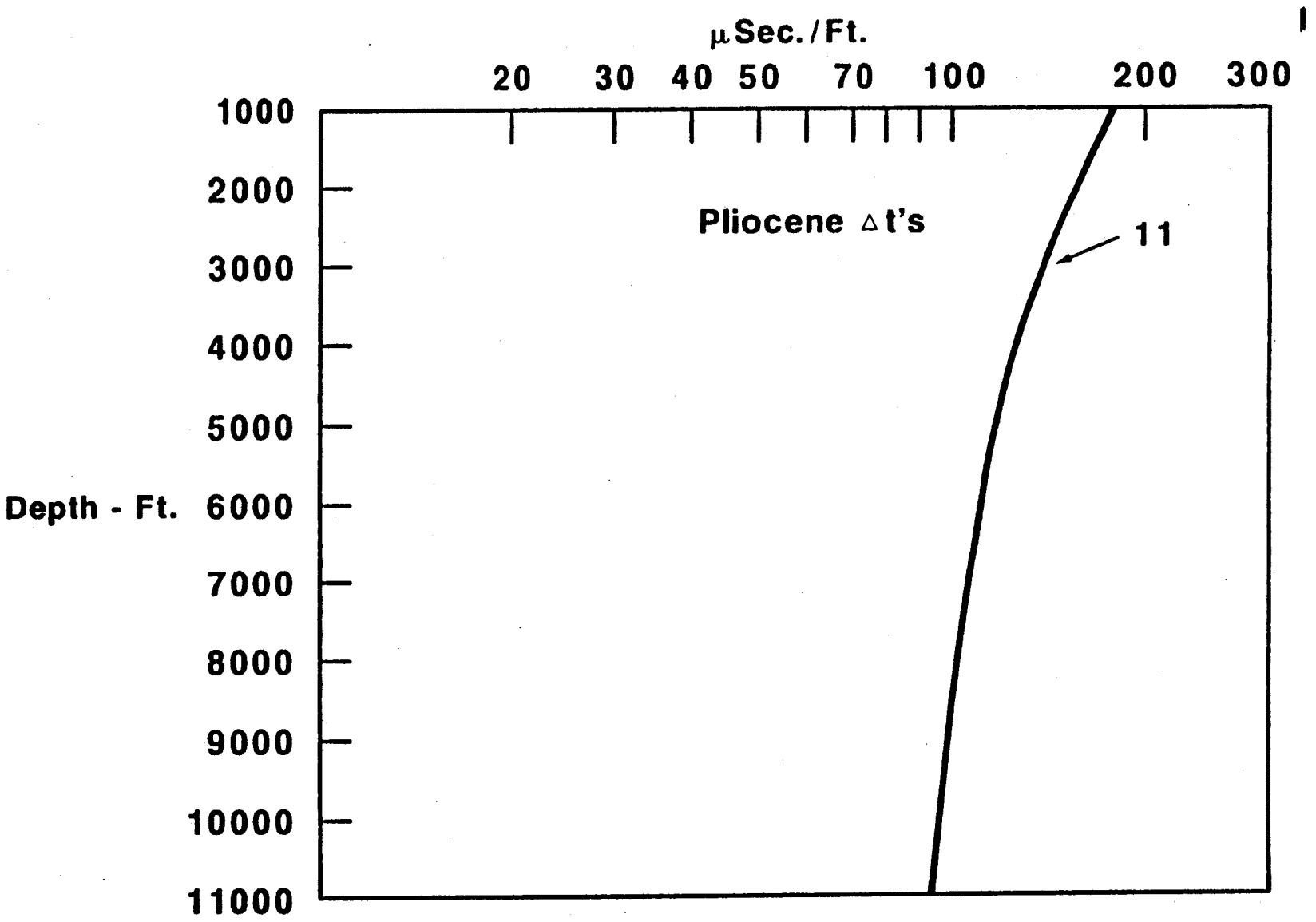
FIG. 2 is a plot, similar to FIG. 1, but on semi-logarithmic scale representative of interval transit times versus depth, strata of Pliocene age only.

As discussed above, pore PRESSURES at given depths below a proposed well site are calculatable from seismic data and a knowledge of the "normal" trend of geostatic pressures through the geological column of earth strata through which the well is to be drilled. Seismic information is collected by conventional means known to those skilled in the art as common mid-point (CMP) stacking at both a proposed location and at an offset location adjacent a drilled well. Such seismic information inherently includes velocity information that may be recorded, as "stacking" velocities. From such stacking velocities, interval velocities over different portions of the geologic column may be used to generate a curve of interval transit time velocities (in microseconds per foot) versus depth beneath any point on a seismic line. It will be appreciated that this curve is essentially a synthetic sonic log. It is also referred to by those skilled in the art as a "slowness curve". FIG. 1 illustrates a series of such "slowness curves" representing interval transit times through five different types of rocks of increasing geological eras or ages. Interval velocities are extrapolated from the earth's surface to a depth of burial of 30,000 feet. As indicated, interval velocities, or transit times, uniformly increase with depth when plotted on a log-log scale. The data thus appears as linear curves. This interval velocity versus depth data may then be replotted on semi-logarithmic scale, with the vertical linear scale representing depth, in feet, and the horizontal log scale representing interval transit times in microseconds per foot. A representative curve 11, such as that shown in FIG. 2 may be drawn to represent normally pressured strata, all of the same geological age, with interval velocity increasing uniformly with depth. Curve 11 represents interval transit time (ITT) versus depth for Pliocene strata at all depths on such a semi-logarithmic scale.

Figure 3:
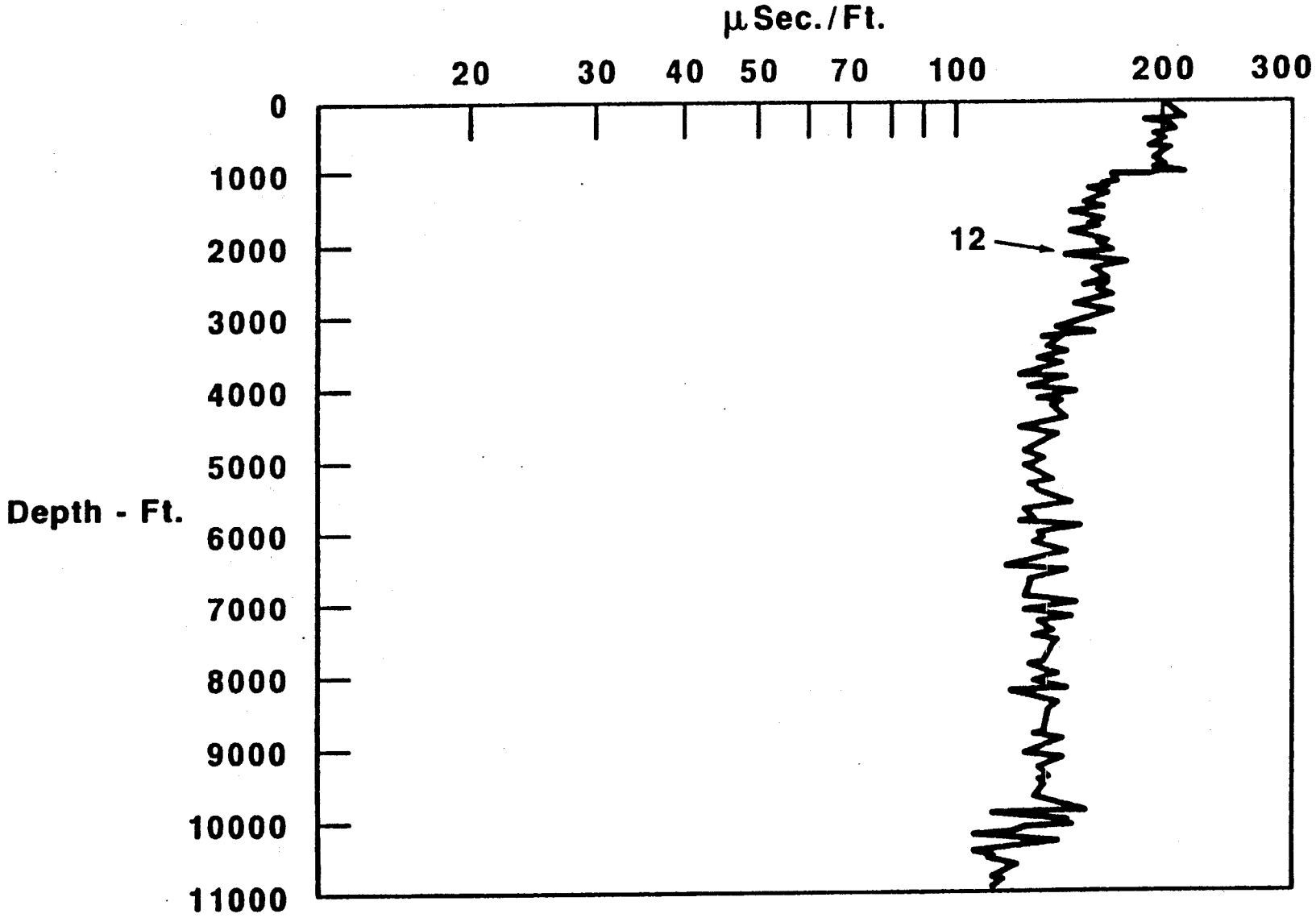
FIG. 3 is a plot on semi-logarithmic scale, similar to FIG. 2, generated utilizing both stacking velocities and seismic amplitudes, of interval velocities versus depth for a given common depth, or mid-point, of stacked traces on a seismic line. This curve is termed an Interval Transit Time or "ITT" curve.
Figure 4:
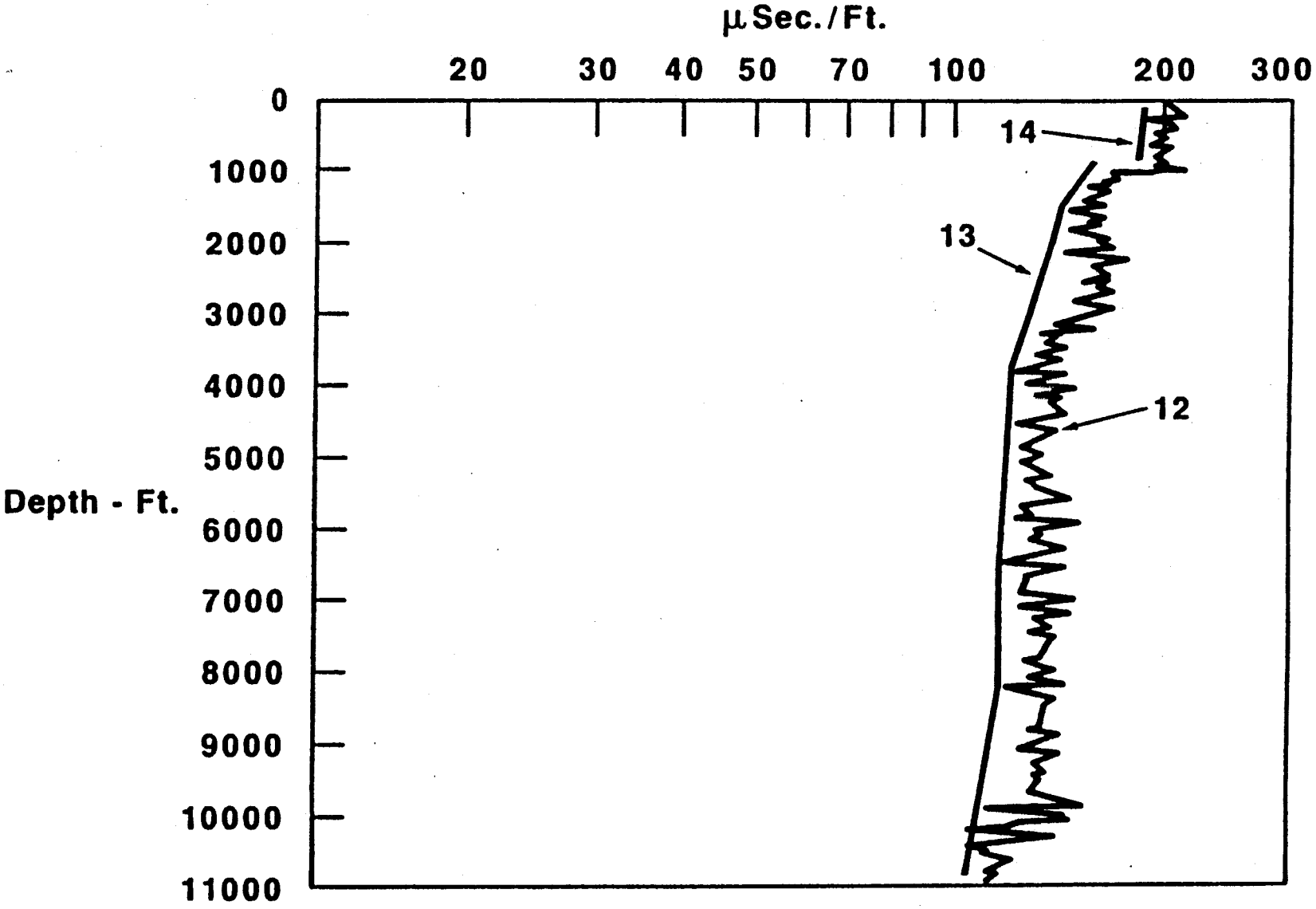
FIG. 4 is a refined ITT plot of FIG. 3 with the addition of smooth "trend lines" representing the compactional trend along the recorded curve, representing subterranean geological structure along the downward projection of the surface stacking point.

In a preferred embodiment of the present invention an ITT curve 12, typified in FIG. 3, indicates a seismic trace of stacked seismic amplitudes versus interval transit times. Recorded ITT curve 12 then may be refined, as in FIG. 4, by generating smooth or "trend" lines 13 and 14 adjacent curve 12 to represent the seismic compactional trend. Trend lines 13 and 14 also serve to highlight abrupt changes in the "normal" velocity trend for lithology changes encountered, as indicated by abrupt changes or breaks at a given depth. It is at these velocity breaks or change points in the velocity curve, where grain to grain contact may be observed in rocks making up the earth formations, rather than the fluid pressures within the rock pore spaces. However, it will be noted that below the transition from trend line 14 to line 13, as in FIG. 4, curve 13 progresses downwardly with no additional abrupt shift in the curve, that would indicate additional significant lithological changes.

Figure 5:
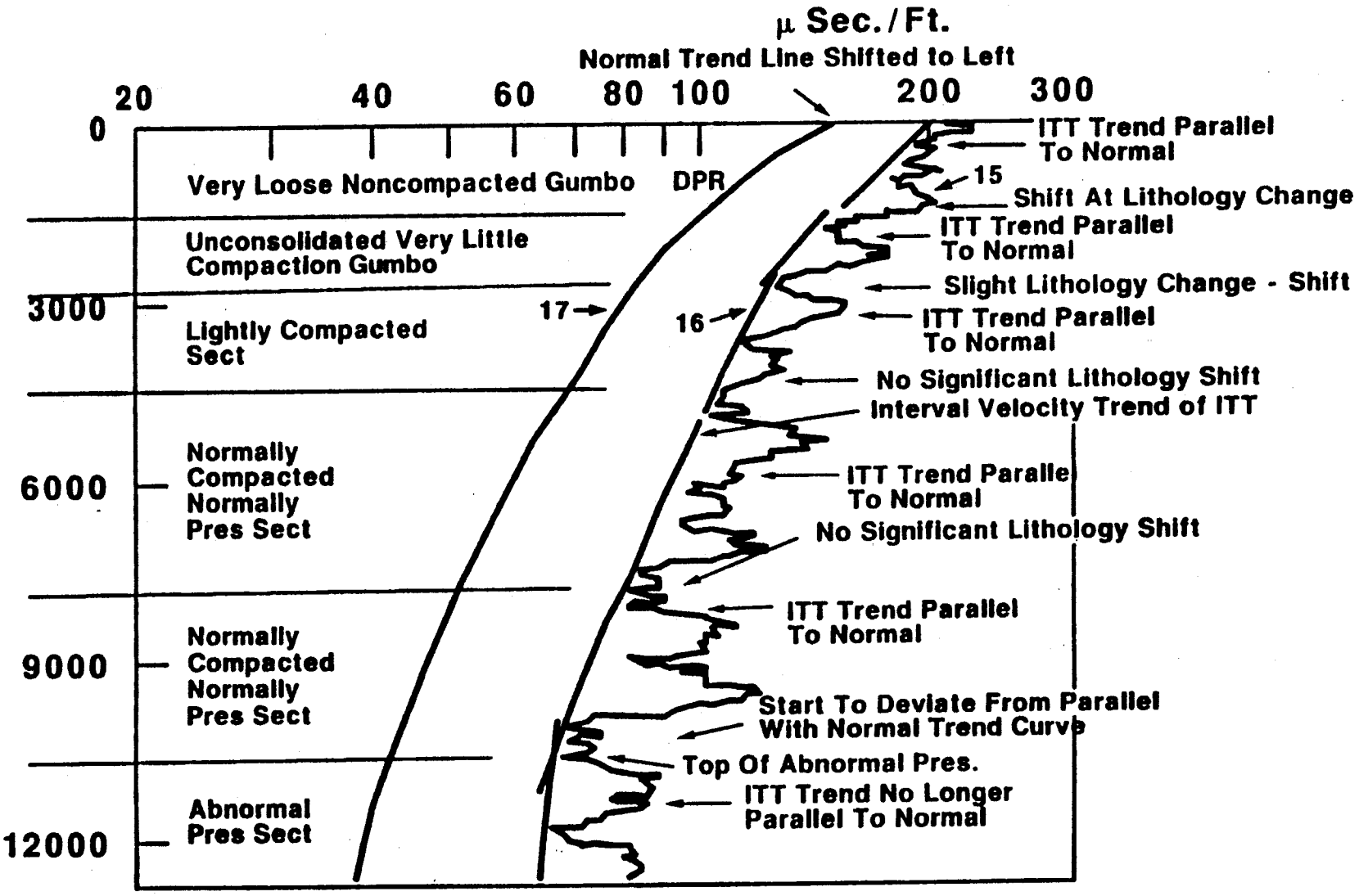
FIG. 5 is a plot of the trend lines of FIG. 4 comparing graphically the calculated normal interval velocities of rocks of a single age, such as those shown in FIG. 2, with the addition of representative information regarding various lithological sections, and notes comparing the curves with one another.

As shown in FIG. 5, by way of example, another ITT seismic curve 15 is taken from seismic data for CMP's at a location where (1) the top of the abnormal pressure zone was known to be relatively deep and (2) strata above that zone is normally pressured. Such synthetic sonic log is plotted along a plot of a normal trend of velocities as indicated by curve 16. If one compares the normal velocity trend of an ITT curve of normally pressured formations, as in FIG. 2, but that curve is shifted to the left, as is done to curve 17, the two curves do not overlap, and may be more easily interpreted. Additional information as to the geological environment may be added to the plot. As shown in FIG. 5, such additional data, indicates for each depth interval the lithological section and the potential depths for changes in the trend line with respect to the interval velocity curve. Also as shown in FIG. 5, trend curve 16, following curve 15, generally parallels a geopressure curve 17 for each lithological section. It also shows that at shallower depths in this exemplary sand-shale geological environment, trend line 16 abruptly shifts either right or left as different lithologies are encountered. It will also be particularly noted that at greater depths none of the lithological changes (as distinguished from abnormal pressure) causes such an abrupt shift in interval velocity.

From multiple observations of this type, I have concluded that the general shape of the interval transit time curve is most meaningful to drilling engineers for determining pore pressure. Only minor errors are introduced by smoothing of data and application of trend lines. Thus, they may properly be neglected. In the illustrated example of a sand-shale environment, significant lithology changes tend to occur far enough above the normally compacted and normally pressured section so that a much simplified interval velocity curve may be generated. For example, using stacking velocities only, and employing a smoothing function on the data, a very smooth ITT curve such as curve 17 is obtained. In drilling environments more complex than sands and shales, the smoothing of the data may not provide enough character to the curve for accurate prediction of lithologic changes at depth. Therefore, using a curve including both starting velocities and amplitudes to establishing such trend lines is preferred. Trend line 16 may then be connected across the lithological "tops" (changes in seismic velocities) and the resulting curve used as the ITT curve. With an ITT curve generated as described above, it is then possible to more accurately determine pore pressures at given depths over the geological column below a proposed drilling location. The method of the present invention for calibrating the normal trend line is then developed from ITT seismic data for CMP's at an adjacent site where a well has been drilled in conjunction with well logs, as confirmed by the geology and other well based measurements.

From the adjacent well, interval transit times similar to the seismic ITT data may be directly determined from a sonic log or computed from other logs, such as resistivity, conductivity, density or $d_c$ exponents. Pore pressures may be determined from such logs by equations developed by Eaton ("The Effect of Overburden Stress on Geopressure Prediction from Well Logs" Journal of Petroleum Tech. Aug. 1972). Specifically the Eaton equation for pore pressures based on an Interval Transit Time, derived from a well bore sonic log, is as follows:

$$G_p = G_o - [G_o - G_n]\left(\frac{\Delta\tau_n}{\Delta\tau_o}\right)^X$$

where:
$G_p$=pore pressure gradient, psi/ft;
$G_o$=overburden gradient, psi/ft;
$G_n$=normal gradient, psi/ft;
$\Delta\tau_o$=observed reading;
$\Delta\tau_n$=normal trend reading This equation relates pore pressures for a selected depth interval to a relationship between observed values of a parameter (transit time, $\Delta\tau_o$) and what the normal values $\Delta\tau_n$ would be for a normally pressured formation occurring at the same depth.

Other equations of Eaton for pore pressure based on resistivity, conductivity, density and $d_c$ exponent logs are specifically:

Resistivity:

$$G_p = G_o - [G_o - G_n]\left(\frac{R_o}{R_n}\right)^{1.2}$$

Conductivity:

$$G_p = G_o - [G_o - G_n]\left(\frac{C_n}{C_o}\right)^{1.2}$$

Density, $d_c$ Exponent:

$$G_p = G_o - [G_o - G_n]\left(\frac{d_{co}}{d_{cn}}\right)^{1.2}$$

where
$R_o$, $C_o$, $d_{co}$=observed readings; respectively, of resistivity R, conductivity C, and density, $d_c$.
$R_n$, $C_n$, $d_{cn}$=normal trend reading.
In this way pressures at any selected depth in an offset well may be calculated, where resistivity, conductivity, density, sonic or a combination of such logs are available.

The equations also require the values of the overburden stress gradient for the depth in question, and the matrix stress coefficient for that same depth:

$$\text{Frac Grad } G_f-(G_o-G_p)(\text{MSC})+G_p$$

where:

$$MSC = \text{Matric Stress Coefficient, } K_E = \frac{\upsilon}{1-\upsilon}$$

where
$\upsilon$=Poisson's ratio.

EXAMPLE I

With pore pressures known from the Eaton equations, the following describes a method for predicting pore pressures at a proposed location utilizing seismic interval transit time curves. The method is described utilizing example data and representative plots, shown in FIGS. 6 to 15 by which the various steps achieved the desired calibration of the normal trend. It will be particularly noted that a precise knowledge of the normal trend value is critical to calculate each of the above formulae.

An offset location should be selected where a well has been drilled through comparable depths of interest and the quality of well log information is satisfactory. At this selected offset location, an ITT curve is generated using seismic information recorded so that a mid-point of a substantial number of pairs of sources and detectors each generates a trace whose reflector point, or mid-point, is common, but each pair has a different path through the earth.

The common mid, or reflection, point method provides a multiplicity of wave travel paths which allow direct determination of velocities associated with such paths. Hyperbolic searches for semblance among appropriately gathered arrays of traces form the basis upon which velocities are estimated. Measured semblances are presented as a velocity spectral display. Velocity spectral displays help to determine the velocity function needed for optimum stacking. A further description of stacking velocities and modern linear seismic reflection methods is given in Section 5.2 of *Reflections Seismology*, 2nd Edition, by Kenneth H. Waters (1981, John Wiley & Sons), and is incorporated by reference herein.

Figure 6:
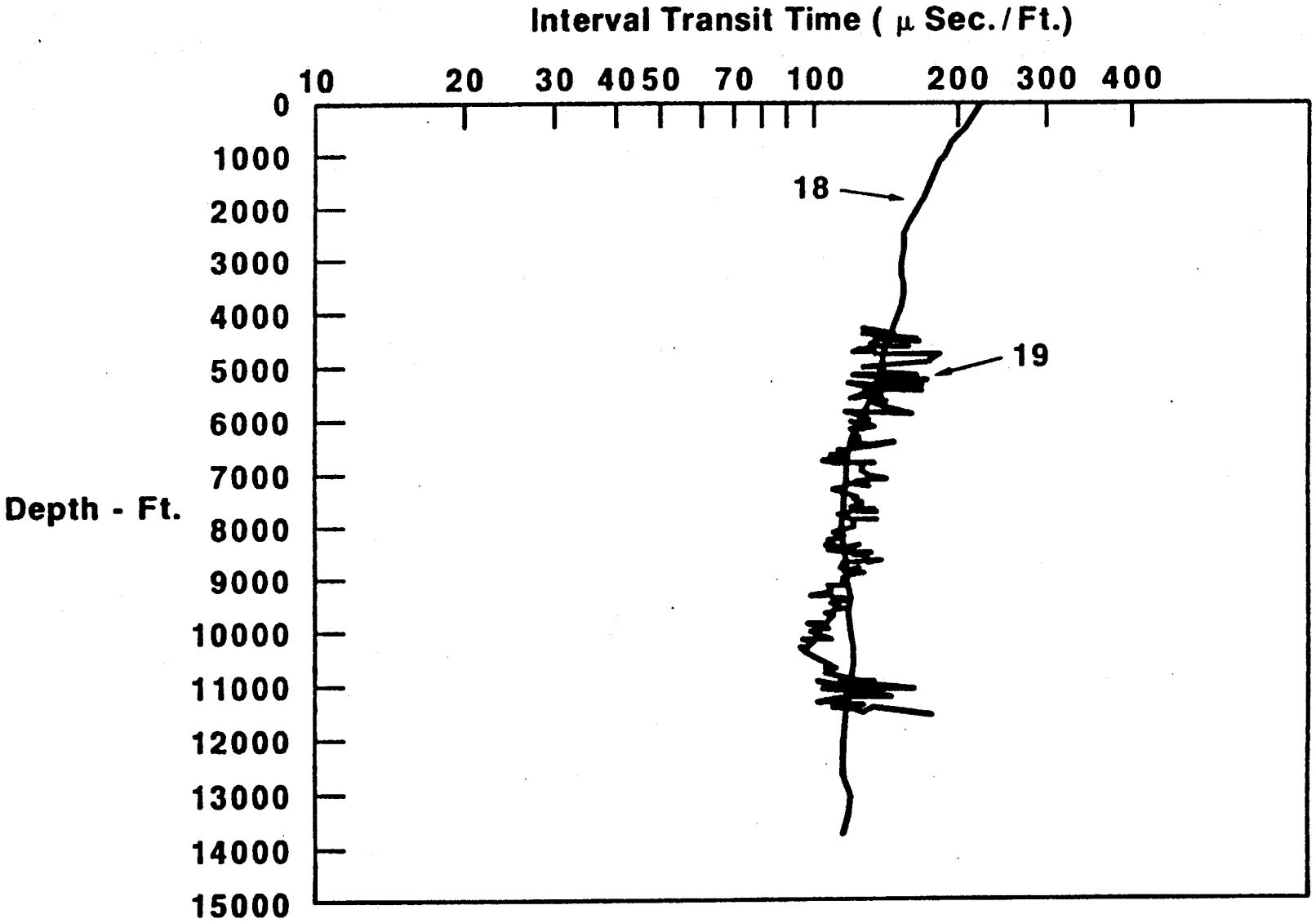
FIG. 6 is a plot of Interval Transit Times (ITT) versus depth for a previously drilled well bore at an offset location, where the smooth curve is representative of a gather of seismic common mid-point traces taken from seismic lines extending downward from a point very close to the offset, (previously drilled) wellbore. The second, more erratic curve is a sonic log from the same offset wellbore.
Figure 7:
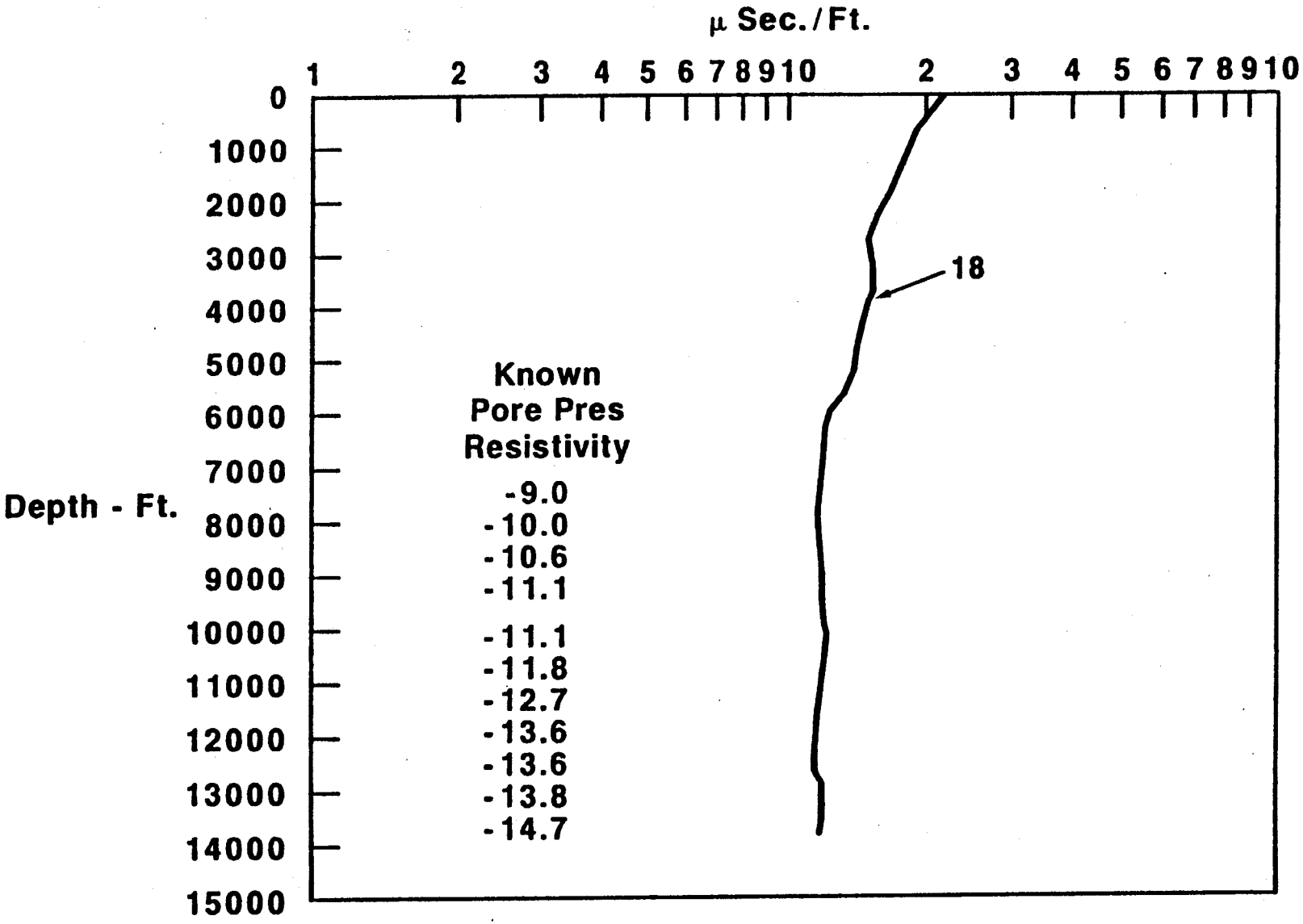
FIG. 7 is the ITT plot of FIG. 6 with the addition of actual pore pressures in equivalent drilling fluid (or mud) weights (lbs/gal) at depths indicated by dash lines to the left of the number values, as taken from logs run in the offset wellbore and wellbore records.

Smooth curve 18 of FIG. 6 is such a seismic ITT curve representative of data obtained from multiple traces, suitably time adjusted for differences in distance from each shot point to a detector on seismic lines, which have a common mid-point as close to the wellbore as reasonably possible. The second, more erratic, curve 19 represents a sonic log from the same well. ITT curve 19, as derived from the well bore sonic log, actually measures interval velocities over substantial depth intervals along the length of this offset wellbore. As shown, seismic ITT curve 18 approximates curve 19, but because it is derived from surface seismic data it must be correctly calibrated to curve 19. For this calibration all data is conveniently displayed on two-cycle semi-logarithmic paper with a linear vertical depth scale in thousands of feet and a horizontal log scale in microseconds per foot. Next, in accordance with this invention, pore pressure calculations from the logs from the drilled wells are generated and actual pore pressures are measured from well data (drilling and geological) for as many intervals as possible. The resulting discrete pore pressure values, expressed as equivalent mud weight in pounds per gallon, are then plotted next to seismic ITT curve 18, as shown by FIG. 7. The depth of each such well derived value is indicated by the dash adjacent the numerical pore pressure.

Figure 8:
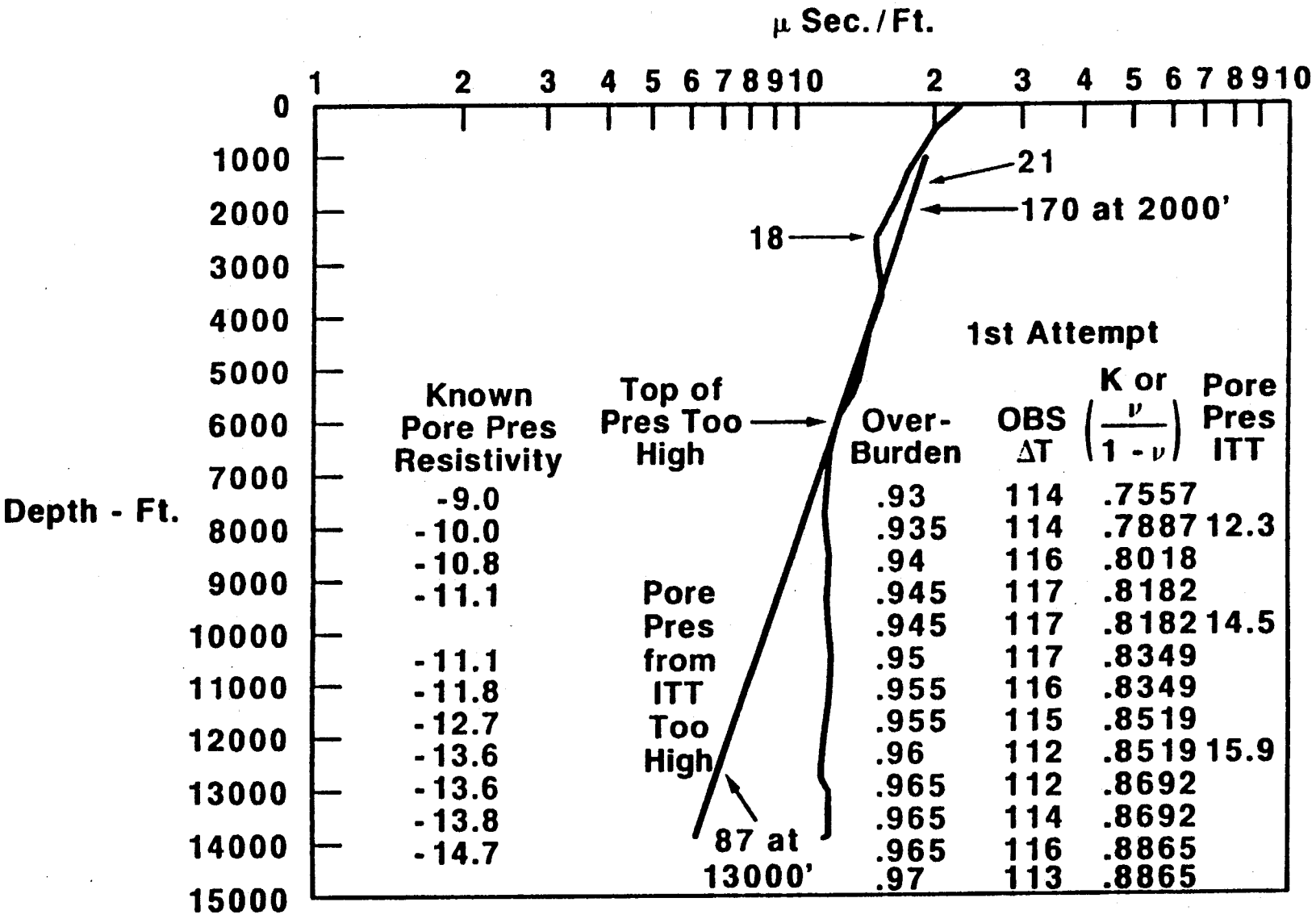
FIG. 8 is a graphic representation of pore pressures calculated from a first attempt to graphically fit calculated pore pressure values (lbs/gal) from an assumed overburden normal velocity trend line and the seismic ITT curve to the actual pore pressures, as shown in FIG. 7. The table of values for "overburden", "observed ΔT", "Matrix Stress Coefficient", or $K_E$ and "Pore Pressure ITT" are respectively aligned with the Depth scale values.

As a next step a straight line, termed a normal trend line 21 is constructed upon seismic ITT curve 18, and pore pressures from these curves are calculated using the Eaton equations. For convenience these may be displayed as shown in FIG. 8. Normal trend line 21, is then realigned to whatever position is necessary so that the pore pressures derived from the ITT more closely match those derived from the logs. This matching procedure improves the accuracy of the ultimate prediction of pore pressures through the method of the present invention. The matching process may be accomplished using a trial and error technique and in some cases several attempts may be required to achieve a desired match. The match may also be through an appropriately programmed digital computer to accomplish the trial and error matching process. Many least squares programs for curve matching either graphically or statistically are available to perform and optimize this matching process.

For simplicity in explanation of the present method, the trial and error process is demonstrated by several figures; first, in FIG. 8 it will be noted that the ITT pore pressures (right side) calculated from the Eaton equations are too high when compared to the resistivity "Known Pore Pressures". From this first attempt at drawing a trend line upon the log derived data of FIG. 8, it is observed that the normal trend has a transit time of 87 μsec./ft. at a depth of 13,000 ft and 170 μSec./ft. at 2,000 feet. The Eaton equations then predict a pore pressure too high when compared to the known pore pressure derived from a resistivity log at the same depth, and accordingly it is necessary to adjust trend line 21.

Figure 9:
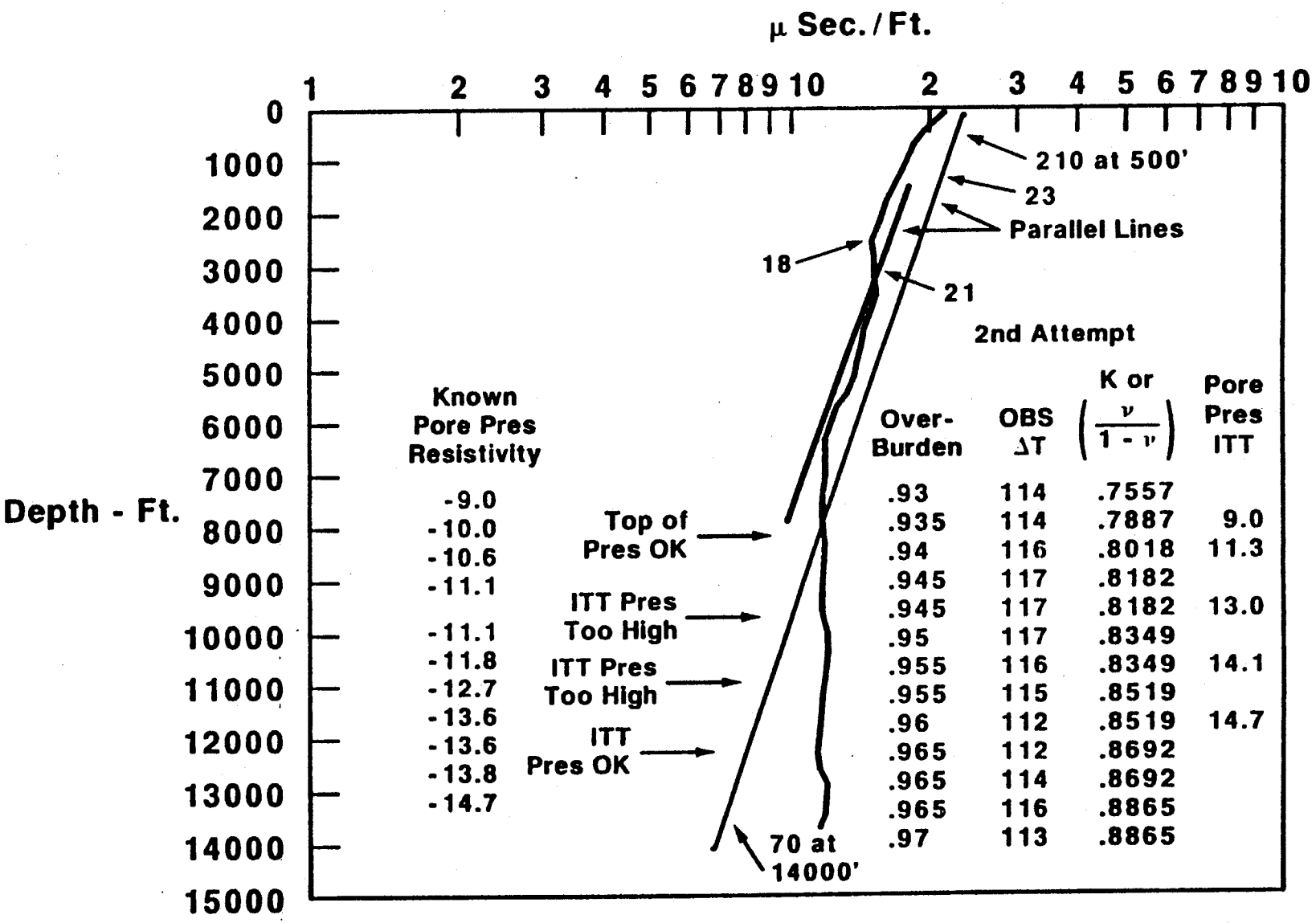
FIG. 9 is the resulting plot of calculated pore pressures, similar to FIG. 8, from a second attempt to graphically fit a revised normal trend line to the seismic ITT curve.

FIG. 9 shows a second trend line 23 that is shifted slightly to the right, but parallel to trend line 21 from FIG. 8. Again the Eaton equations are used to calculate pore pressures as predicted from ITT trend line 23, and compared to known pore pressures derived from the resistivity the log. FIG. 9, therefore, shows a somewhat better fit, but a still close match of the ITT and log derived pore pressures may be achieved by better adjustment of the trend line. While the top of the abnormal pressure coincides for the two curves and the seismic ITT pore pressures at the bottom are correct, the ITT pore pressures through the critical mid-section of the well are still too high.

Figure 10:
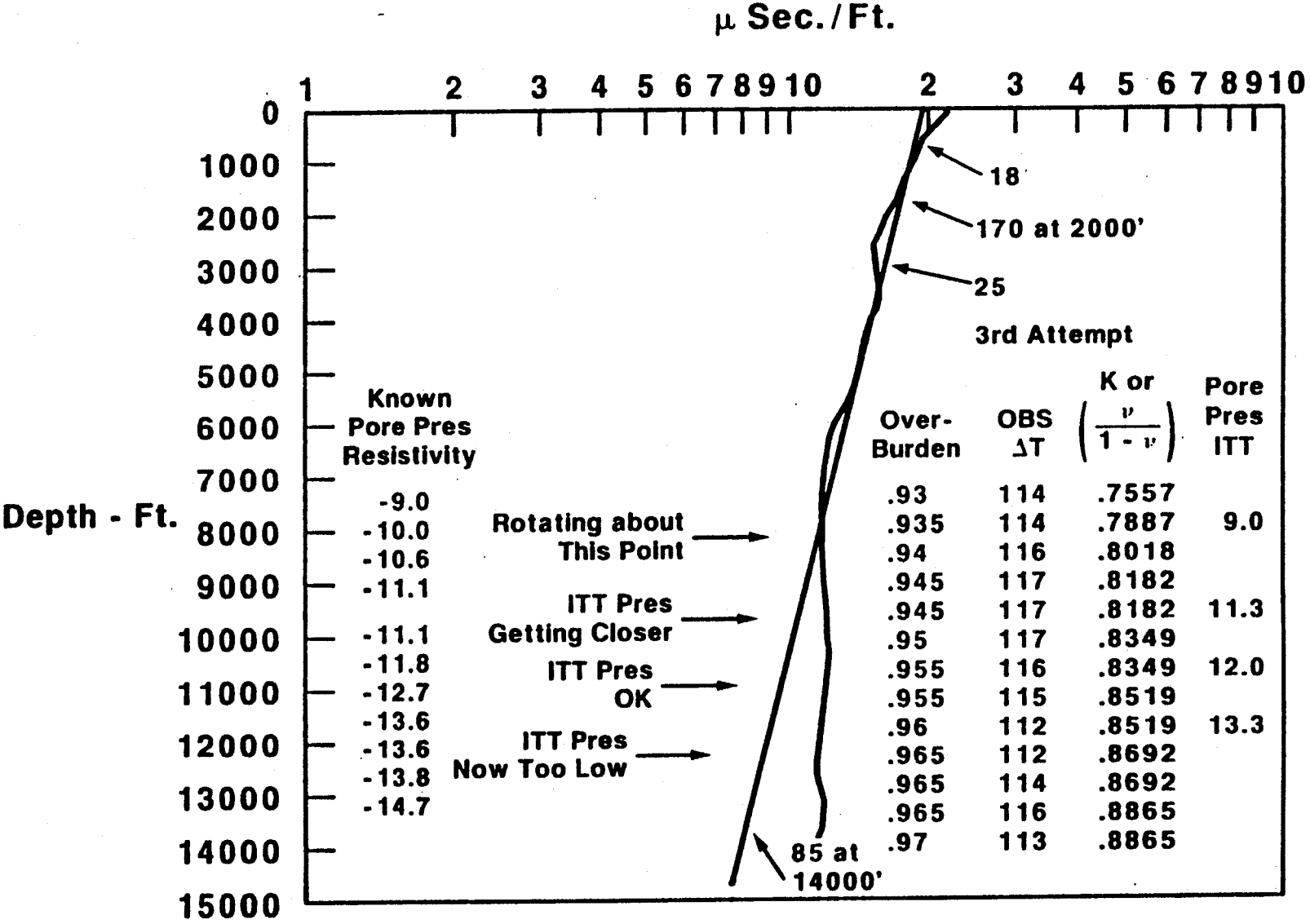
FIG. 10 is similar to FIGS. 8 and 9 showing the resulting plot of pore pressures calculated from a third attempt to graphically fit a further revision of the normal trend line and seismic ITT curves to the well data logs, the normal trend line of FIG. 9 has been rotated for a better match with the log-derived data.

In FIG. 10, trend line 25 has been rotated about a point at the top to give a better fit through the mid-section that more closely match pore pressures predicted by the ITT trend line and pore pressure solutions by the Eaton equations of the resistivity log. However, such a rotation of trend line 25 as shown in FIG. 10 does not achieve an optimum match. As particularly indicated the calculated pore pressures at the bottom of ITT curve 25 are too low.

Figure 12:
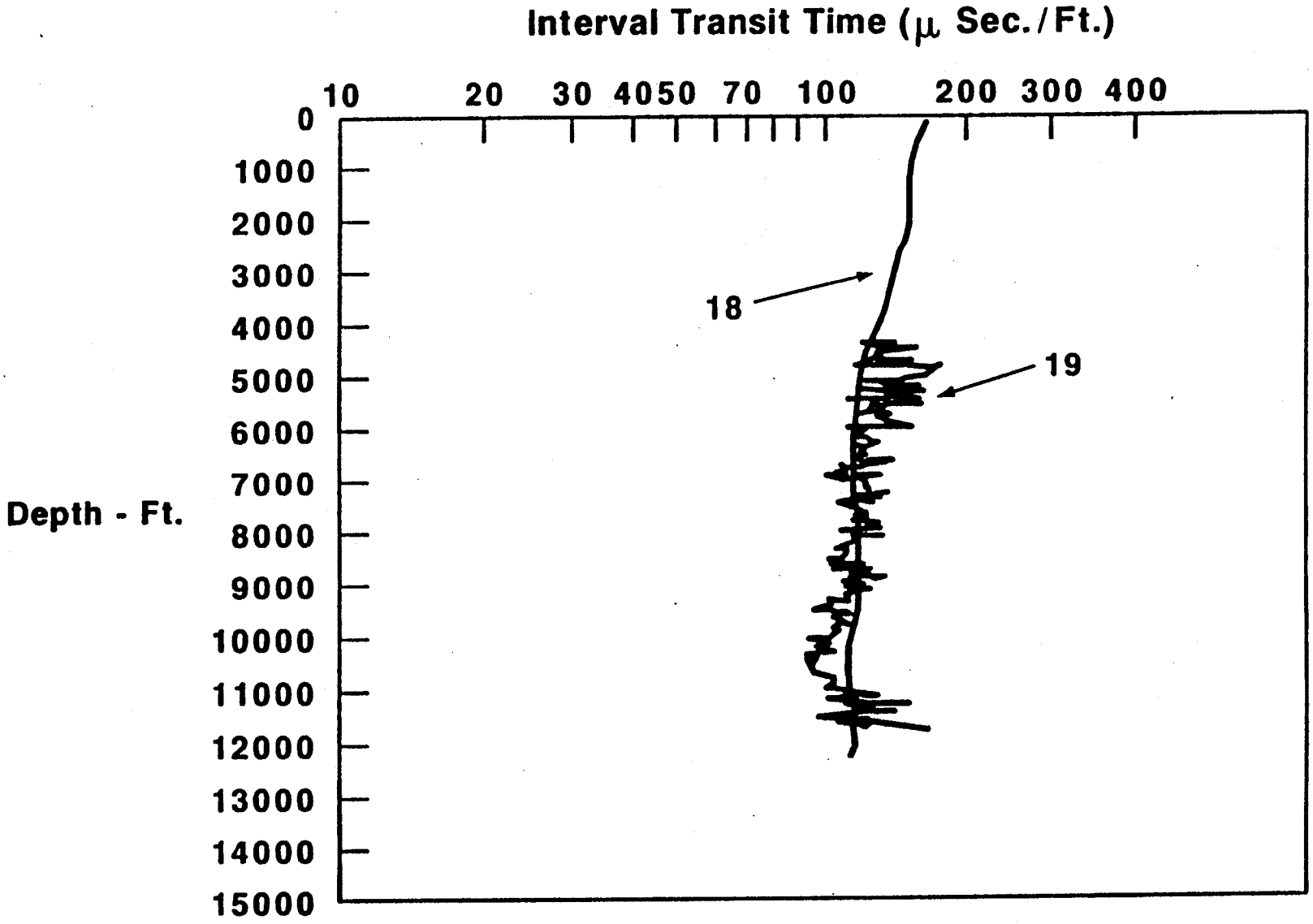
FIG. 12 is a plot resulting from the depth adjustment of the seismic generated ITT to match the corrected normal trend with respect to the sonic log recorded in the drilled well. This plot represents the graphical solution of the curve matching process as calculated from FIG. 11.

Because, as discussed above, the interval velocity data determined from seismic stacking velocities are often not entirely precise, the ITT curve 18 may, as in this case, also require adjustment for depth. For the purpose of arriving at a correct depth adjustment, it is again useful to compare the seismic curve ITT to the sonic log of the subject offset well. As previously noted in FIG. 6, at approximately 10,200 feet, sonic log curve 19 drifts to the left while seismic ITT curve 18 drifts right. Shortly below, the two curves drift in opposite directions. A light table may be useful in analyzing a proper depth adjustment, allowing independent movements for a proper alignment of the curves 18 and 19. FIG. 12 shows that a proper match is obtained by shifting the ITT curve 18A 1,700 feet upward relative to sonic log 19. By such a shift, the two curves break in the same direction (to the right) at the same depth. While in most cases, such a dramatic adjustment may not be necessary, this actual example clearly demonstrates the importance of the step of correctly calibrating the normal trend and the seismic ITT curve to the well measured pore pressures in accordance with the present invention.

Figure 11:
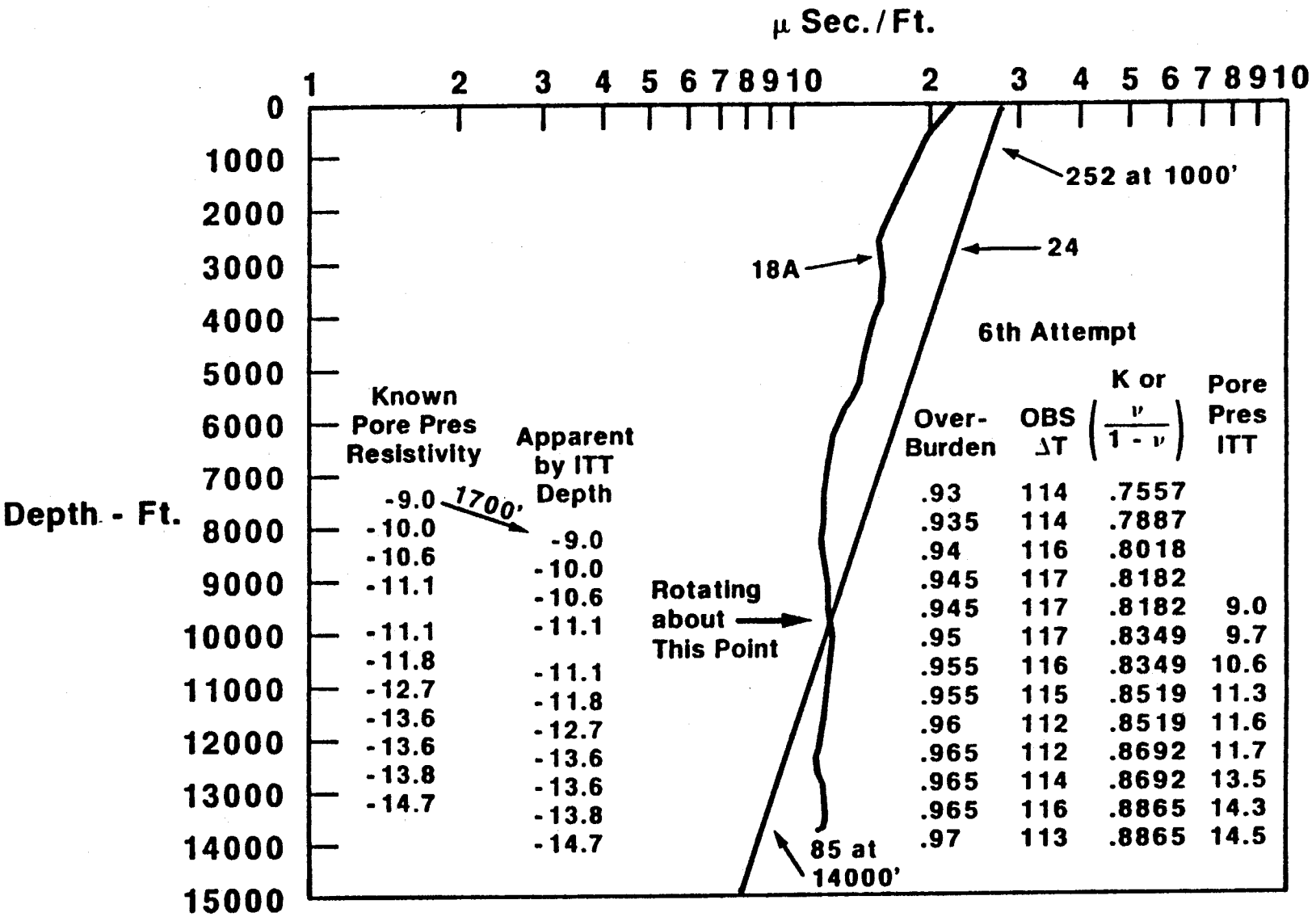
FIG. 11 is a plot of the corrected normal trend line and the known suite of pore pressures, derived from the logs after a sixth trial. The calculated values are also shown after depth adjustment, as noted, to demonstrate a good match.

With a proper depth adjustment of 1,700 feet made in the example, as illustrated, and pore pressure values correctly calculated from the calibrated normal trend and ITT curve 18A, a corrected normal trend line 24 may be drawn as shown by FIG. 11.

Figure 13:
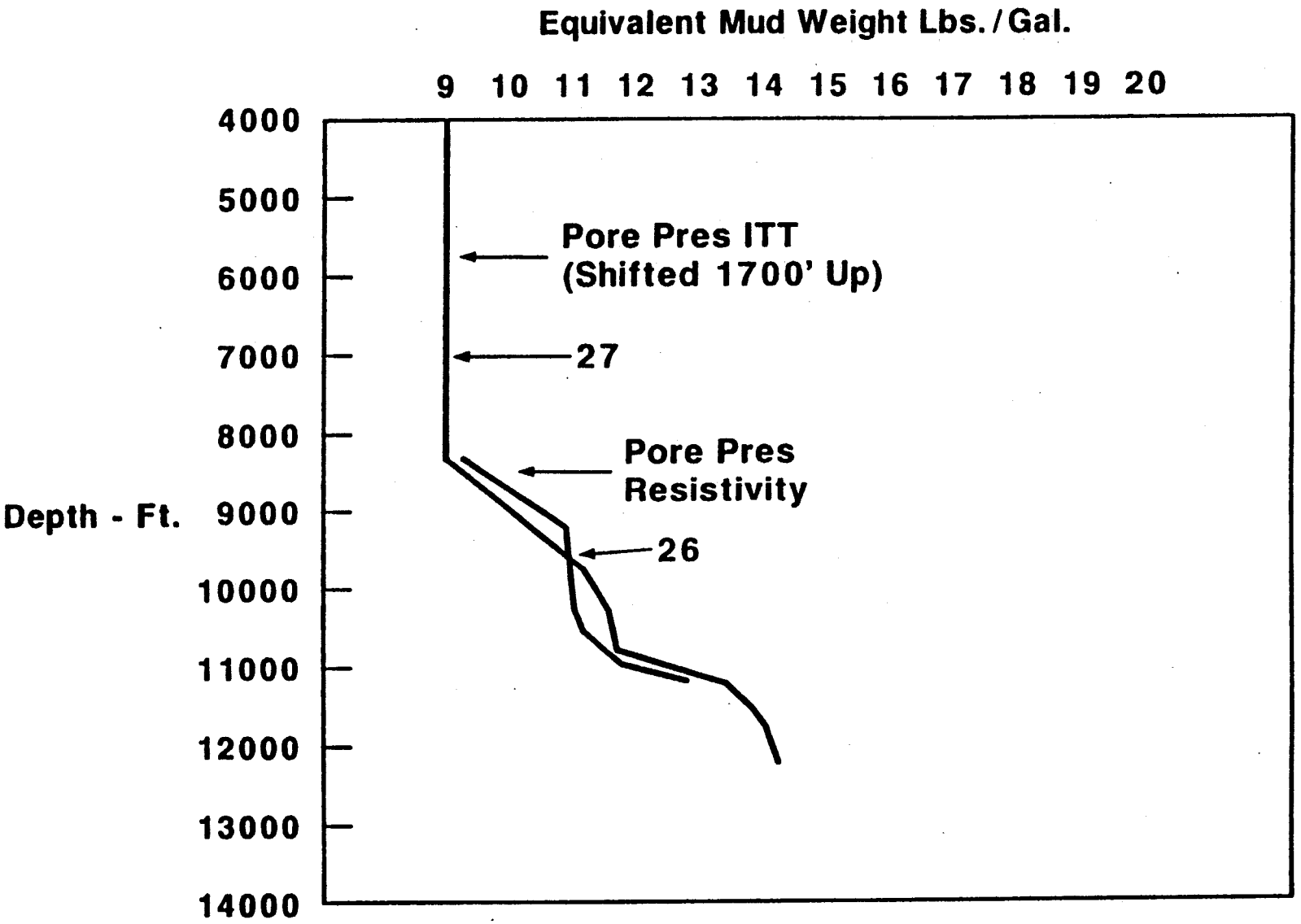
FIG. 13 compares a pair of curves respectively representing (1) a suite of pore pressures derived from ITT data, as correctly adjusted for depth and (2) a suite of pore pressures derived from a well bore resistivity log, showing excellent agreement between the two curves.

It is now seen that pore pressures calculated from the ITT very closely match log-derived pore pressures. Therefore, a calibration on the normal velocity trend through this stratigraphic interval for this particular drilling area has been made. To verify this calibration, pore pressures versus depths derived from both the well log data and from calculations based on the calibrated, or depth adjusted, seismic ITT curve may be plotted as curves 26 and 27, respectively, as shown in FIG. 13. This graphic representation clearly verifies a close match and a reasonable calibration of the normal velocity trend line to the actual values along the drilled well bore.

Figure 14:
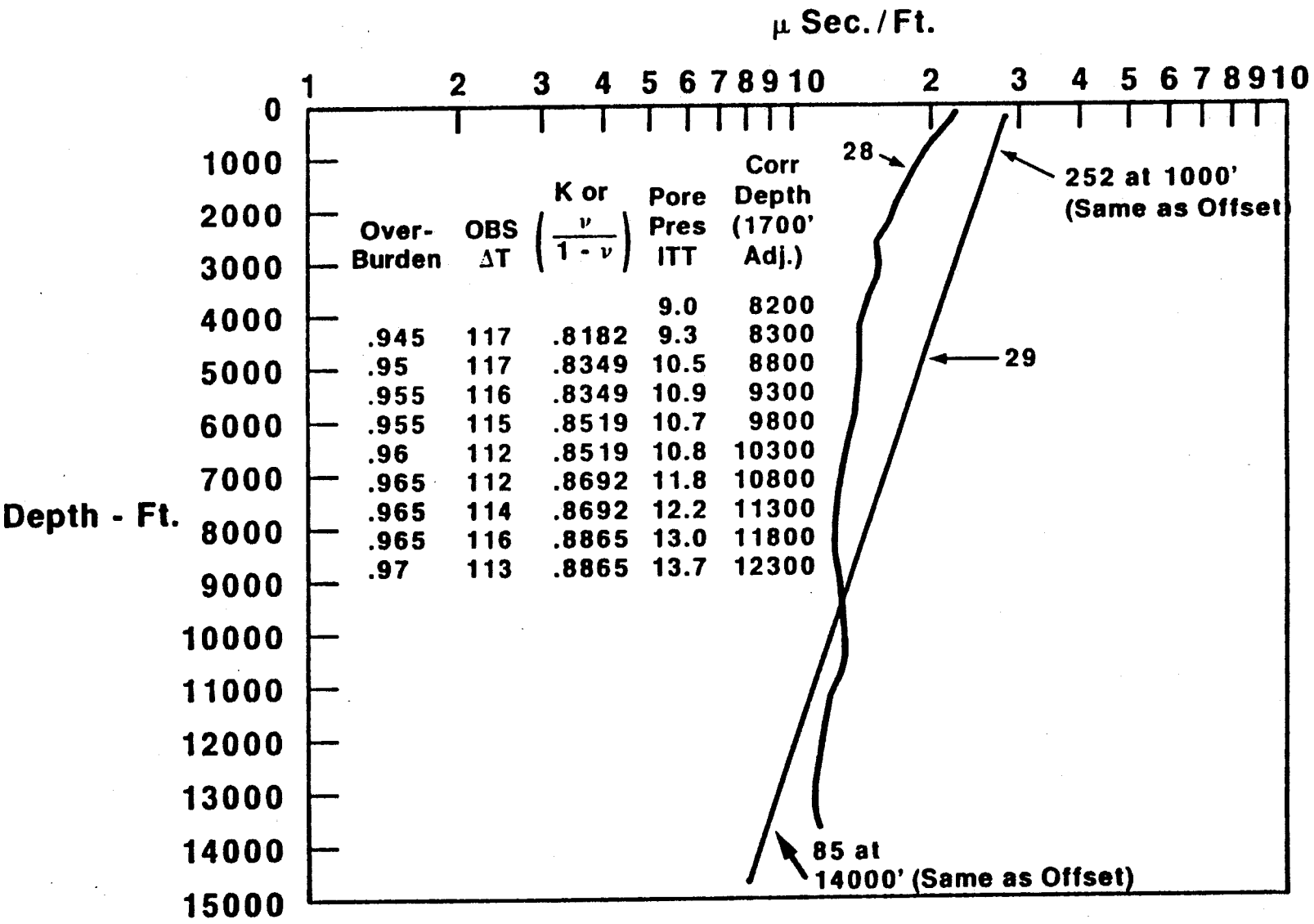
FIG. 14 is a plot of an ITT curve generated for a proposed drilling location in the vicinity of the offset well bore and seismic pore pressures derived from data as shown in FIGS. 6 to 13. It will be noted that, numerical solutions of the Eaton equations, based on the calibrated normal trend, are depth corrected as indicated by the column "Corr. Depth".
Figure 15:
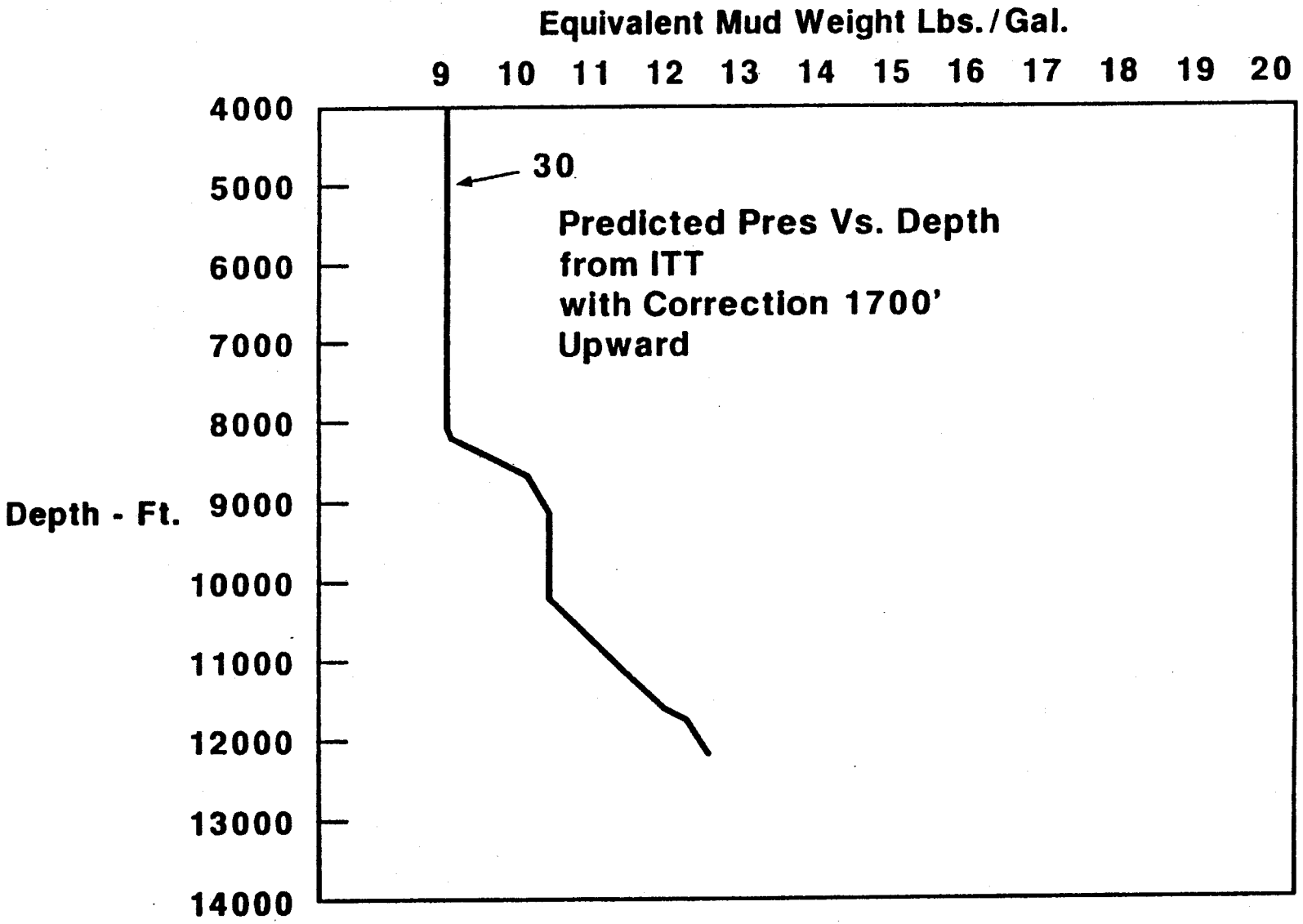
FIG. 15 is a plot similar to FIG. 13 of predicted pore pressures versus depth from the data of FIG. 14, for a proposed drilling location as derived from the seismic ITT data corrected by using the method of the present invention to calibrate the normal trend curve.

To calculate pore pressure at a proposed drilling location, at ITT curve is developed in the same manner for the proposed location and plotted as curve 28 in FIG. 14. The normal velocity trend line 29 developed and adjusted or calibrated for the drilled well is then used over the same stratigraphic intervals. The Eaton equations for Interval Transit Time are similarly used to calculate pore pressures with comparable values of observed to normal Interval Transit Times and to calculate pore pressures, after making the required depth adjustment at the offset location. FIG. 15 shows the resulting plot 30 of predicted pore pressures at the proposed drilling location versus depth using the calibrated normal trend line and the seismic ITT computed values of pore pressure (in equivalent mud weight in pounds per gallon).

In accordance with the present invention, the normal velocity trend of the drilled offset well may be independently computed from a suite of measured pore pressures at known depths and the seismic ITT. The pore pressures are desirably actual pore pressures measured from geological or core data. In such method the Eaton equations are rearranged to complete a corresponding $\Delta\tau_n$ rather than pore pressure gradient, $G_p$, as follows:

$$G_p = G_o - [G_o - G_n]\left(\frac{\Delta\tau_n}{\Delta\tau_o}\right)^X$$

is converted to $$\Delta\tau_n = (\Delta\tau_o)\left[\frac{G_p - G_o}{G_n - G_o}\right]^{1/X}$$

or $$\Delta\tau_n = d(\text{ITT vel})\left[\frac{G_p - G_o}{.468 - G_o}\right]^{\frac{1}{3}}$$

Figure 16:
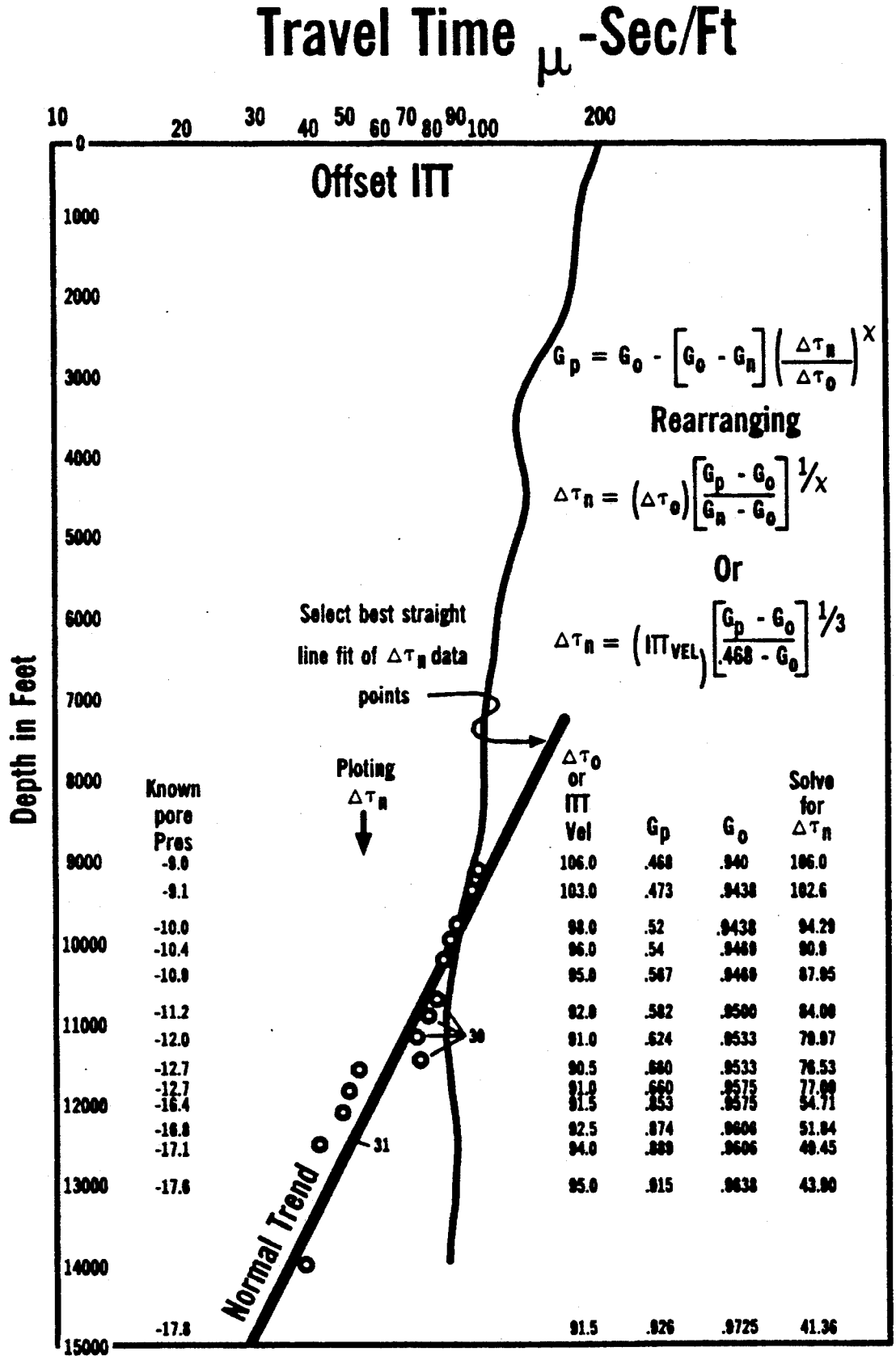
FIG. 16 is a plot similar to FIG. 7 but in which the normal interval transit times $\Delta\tau_n$ are calculated from the observed travel time $\Delta\tau_o$, pore pressure gradients, $G_p$ and the overburden gradient, $G_o$ which are listed at depths corresponding to the known pore pressures. The calculated values are plotted to establish the normal trend gradient of the overburden with respect to the ITT at the offset well.

FIG. 16 particularly illustrates the application of the above-noted calculations to define a calibrated normal velocity (or pressure) trend line relative to the seismic ITT curve. As there shown, the suite of $\Delta\tau_n$ values over the significant portions of the two curves are plotted in Interval Travel-Time (microseconds per foot) rather than as pore pressures (pounds per gallon). The known pore pressures are plotted numerically along the left side of FIG. 16 and the corresponding $\Delta\tau_o$ or ITT velocities, are plotted alongside the seismic ITT curve 18. The calculated suites of values of $\Delta\tau_n$, the normal trend of interval transit times, (for normally pressured and normally compacted rock of the same type at the same depths) is indicated in the right hand column. A plot of a properly calibrated normal trend may then be drawn through plotted points 30 as straight line 31.

The foregoing method of constructing a calibrated normal pressure trend curve may be used either alone or as confirmation of the accuracy of curve fitting the pore pressures calculated from graphic fitting of a normal trend curve and the seismic ITT curve to the suite of measured borehole pore pressures. The position of normal curve 31 may be fitted to points 30 by least square calculations generated by a computer program, in a manner well known in the art.

Figure 17:
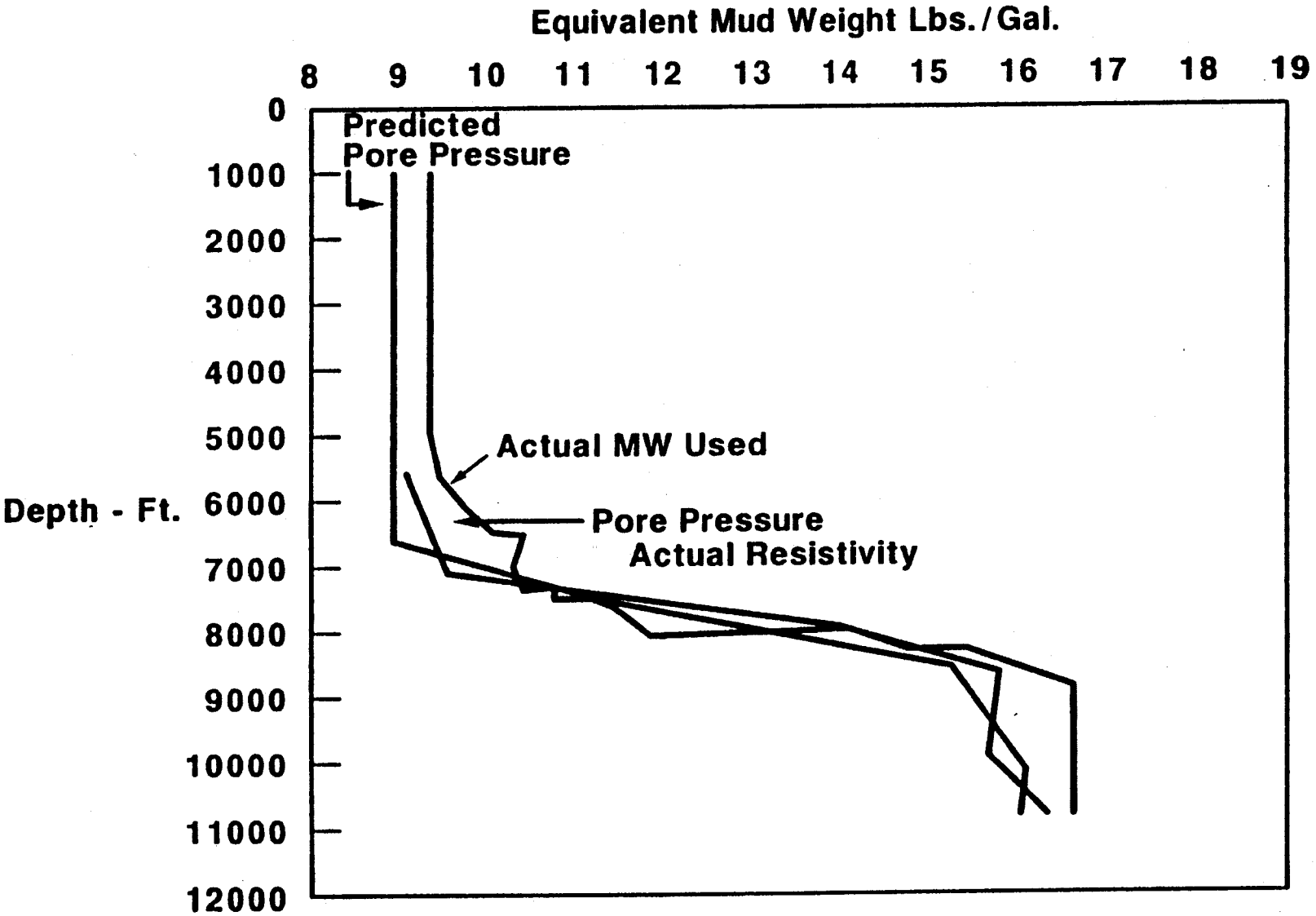
FIG. 17 is an example of the method of the present invention in which the predicted pore pressures from a properly calibrated normal trend line and a seismic ITT curve are compared to show close correlation to measured pore pressures and mud weights used in actual drilling of the well.

FIG. 17 shows application of the present method to a well drilled after computing predicted pore pressures. As indicated, substantial increases in pore pressure were expected below 6,500 ft. Accordingly, the well was drilled with drilling fluid having a mud weight of 9.5 pounds per gallon down to 5,000 feet and then gradually increased to 10 pounds per gallon at about 6,200 feet and 10.5 pounds at 6,500 feet. As shown the pore pressures, both predicted and actual (as measured by resistivity) correspond closely through the vertical course of the well.

EXAMPLE II

The present method was applied to analysis of seismic correlative and seismic volocity (ITT) to predict pore pressures in a North Sea exploratory well prior to drilling. Actual mud weights used in drilling the prospect well are compared to the predicted pressures encountered in the well.

The steps used to predict such pore pressures included sonic log, pore pressure analysis correlated to the prospect, development of a regional pore pressure overlay for interval transit times, and analysis of ITT information developed from seismic shot mid-points both at the prospect and at a previously drilled offset well. The predicted pore pressures show that the actual pressures, determined after drilling the well, indicate the effectiveness of the present invention to predict the measured pore pressure.

This example identifies the steps necessary to predict pore pressures in most wells, including exploratory and delineation wells. It also illustrates that even with little knowledge of the actual formations to be drilled, whether or not a proposed prospect well is hydraulically related to a drilled offset well, the pore pressure profile can be reliably predicted for the prospect well.

The following steps were taken on one such prospect well in the North Sea to best show application of the present method. These results show that this technology can be applied to areas other than the Gulf of Mexico.

To develop a prediction for the prospect well it is most desirable to acquire to the extent possible certain geologic, geophysical, and drilling information for the general area. These were as follows:

- A structure map of the area with the proposed and offset (drilled) wells identified.
- A seismic base map of the area with proposed and offset wells identified.
- Sonic and Bulk Density logs from the offset wells.
- Drilling summaries and mud logs.
- Virgin Bottom Hole Pressure information (i.e.: DST, RFT, Well control data, etc.)
- Geological cross-sections between wells and the prospect location.
- Identified and interpreted seismic lines between locations.
- Time/Depth conversion charts or tables for the area.
- Geologic descriptions including lithology types and approximate depths, types of faults (depositional, post depositional), and geologic age.
- ITT curves generated from seismic shot points at offset and proposed well locations (pseudo sonic logs).

After acquiring such available information, the next step in this process was to identify the closest offset wells to the prospect location and ascertain information on these wells that would be sufficient to conduct a comprehensive pore pressure analysis in such a well or wells. Ideally more than one offset well is suggested, but one well can provide enough information to predict pressures to be encountered. The more control wells available the more reliable the prediction will be. For the North Sea example, only one offset well was evaluated but the steps are identical for multiple offset wells. The offset well for this example was drilled to approximately 13,800 ft. The well reached total depth with a 13.0 ppg. mud weight.

The prospect location was approximately 6 miles from this offset well. The objective in the prospect well was to test sands at approximatley 11,500 feet.

As indicated above, a vital step in predicting pore pressures was to accurately determine the pressures in the offset well. Since seismic information used to generate the required interval transit time curves, to derive pore pressure in the offset well from such sonic log interpretation, requires that the seismic ITT curve be calibrated and compared to the sonic log analysis curve.

Figure 18:
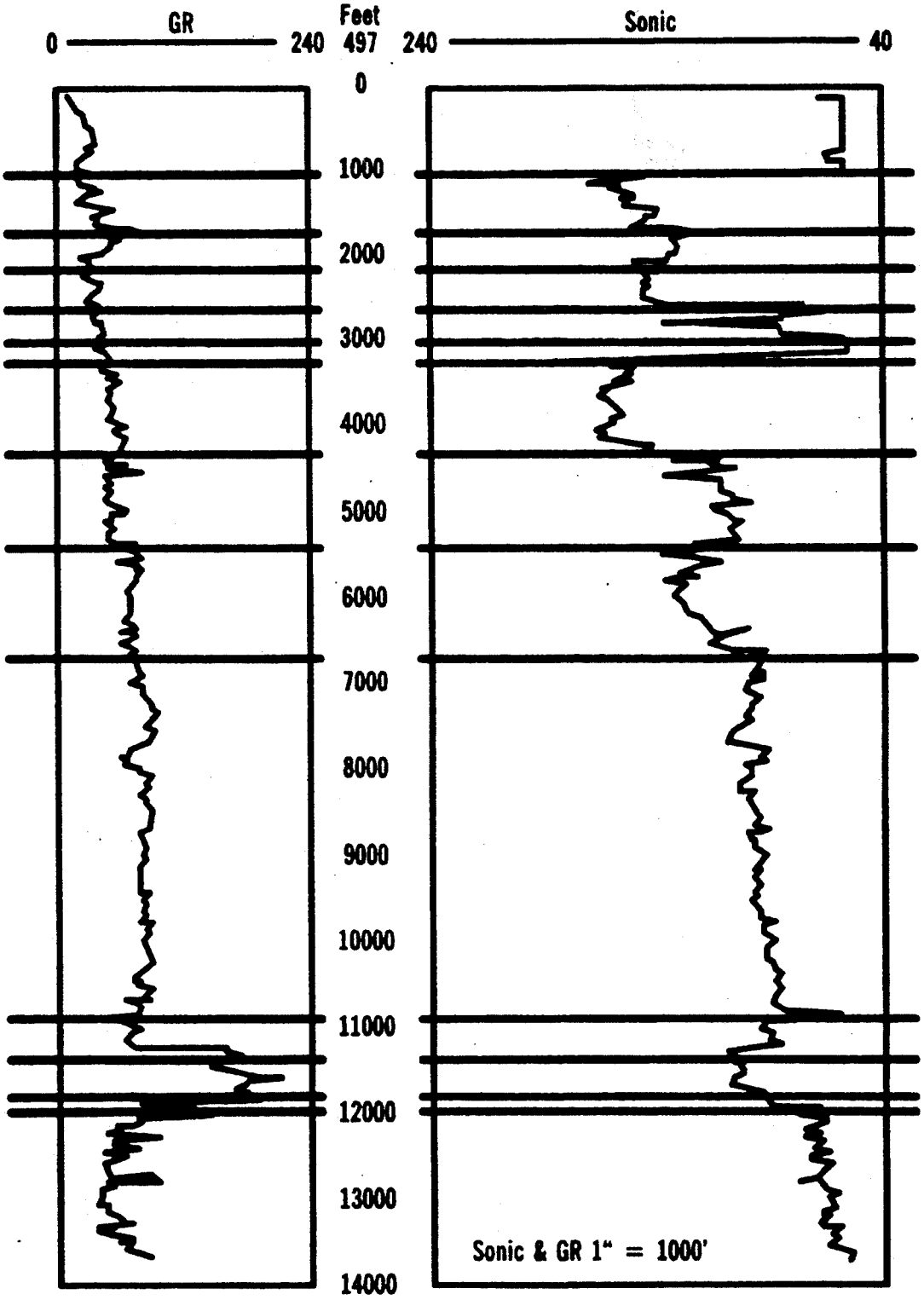

FIG. 18 shows a redisplayed sonic log for the offset well. The log is displayed at one inch equals one thousand feet (along the well bore) to enhance determination of changes in lithology penetrated by the well bore. This log identifies abrupt shifts in the gamma ray (GR) and SP (not shown) log tracks which correspond to shifts in the interval transit time (Sonic) logs. These shifts show that interval transit times are primarily influenced by lithology and not by pore pressure changes. Such shifts are marked on the log and used as recalibration points in these analyses.

The indicated lithology changes are preferably compared to lithological information provided by drill chips, cores or other geological data. The lithology changes affecting interval transit time can thus be confirmed or amended.

Figure 19:
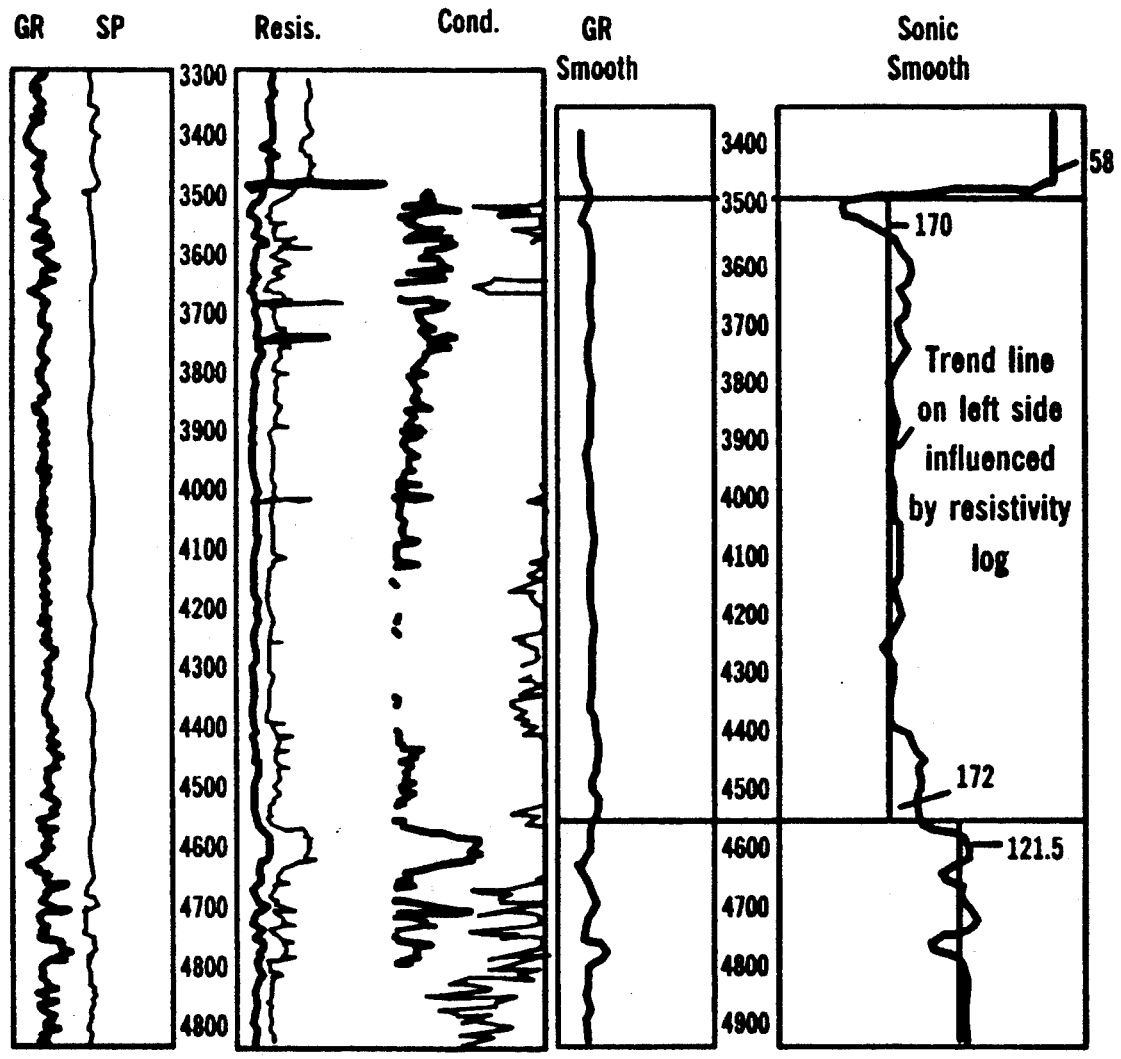

The identified lithology shifts were then relocated to an expanded sonic log display and marked accordingly. This is depicted in FIG. 19. A sonic log display of one inch equals one hundred feet is most suitable for determination of interval transit time trends and values.

Trend lines are drawn on the $\Delta\tau$ trace (Sonic Smooth) identifying those areas considered to represent the most uniform shales for each lithological section as shown in FIG. 19. As shown, it is not necessary to connect trend lines across recalibration points on the log since changes in absolute $\Delta\tau$ values are deemed to be due wholly to lithology changes, which result in different log measured values.

Figure 20:
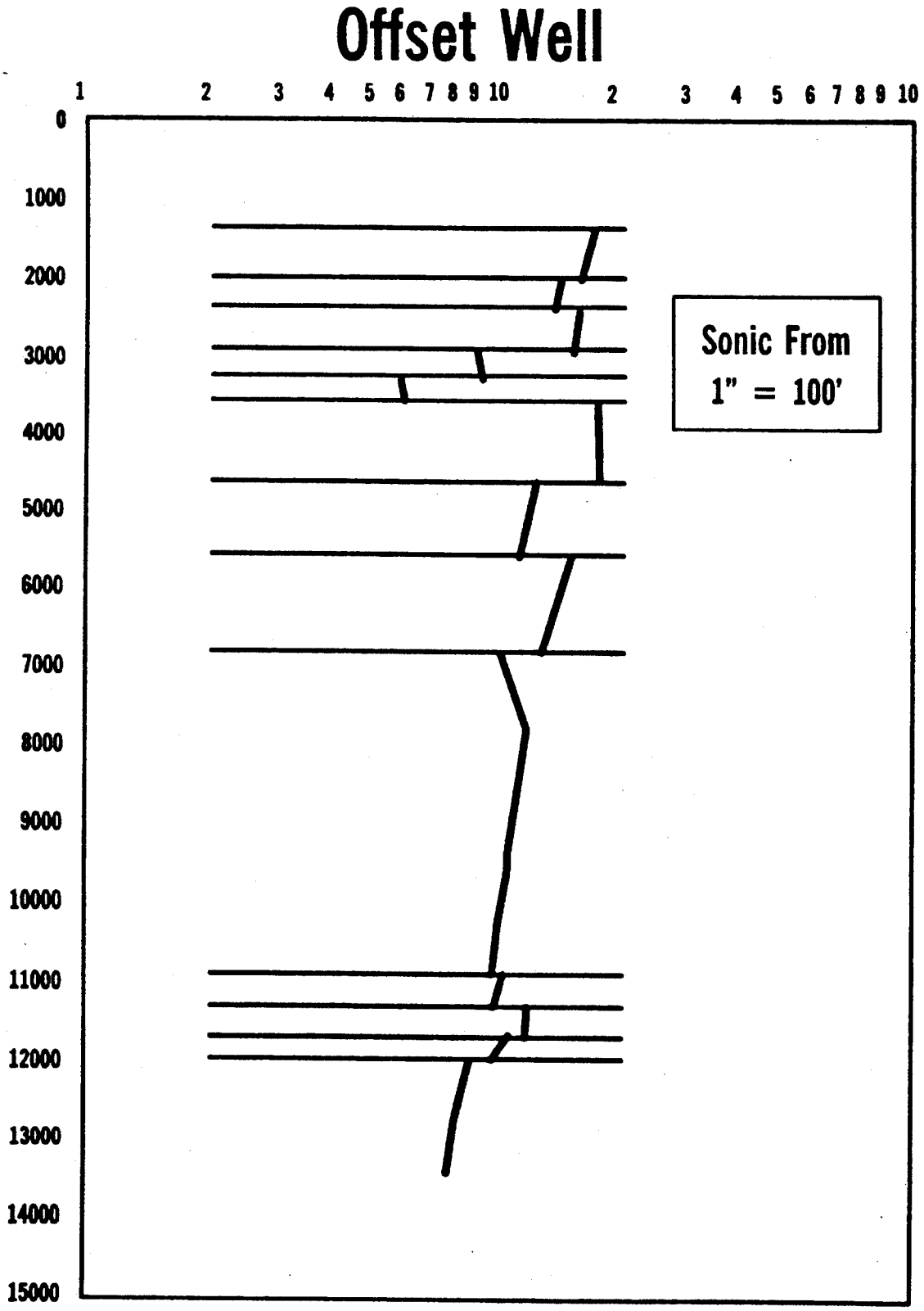

Next, the trend lines and lithology shifts are transposed onto semi-log paper. As shown in FIG. 20, $\Delta\tau$, in microseconds per foot, is displayed versus in 1000 ft. increments. of Total Vertical Depth. Although Pennebaker, as noted before, suggested a linear relationship for interval transit times plotted logarithmically, the present method, preferably, uses semi-log plots. These have been found to be very close to actual measured and interpreted pore pressures.

Figure 21:
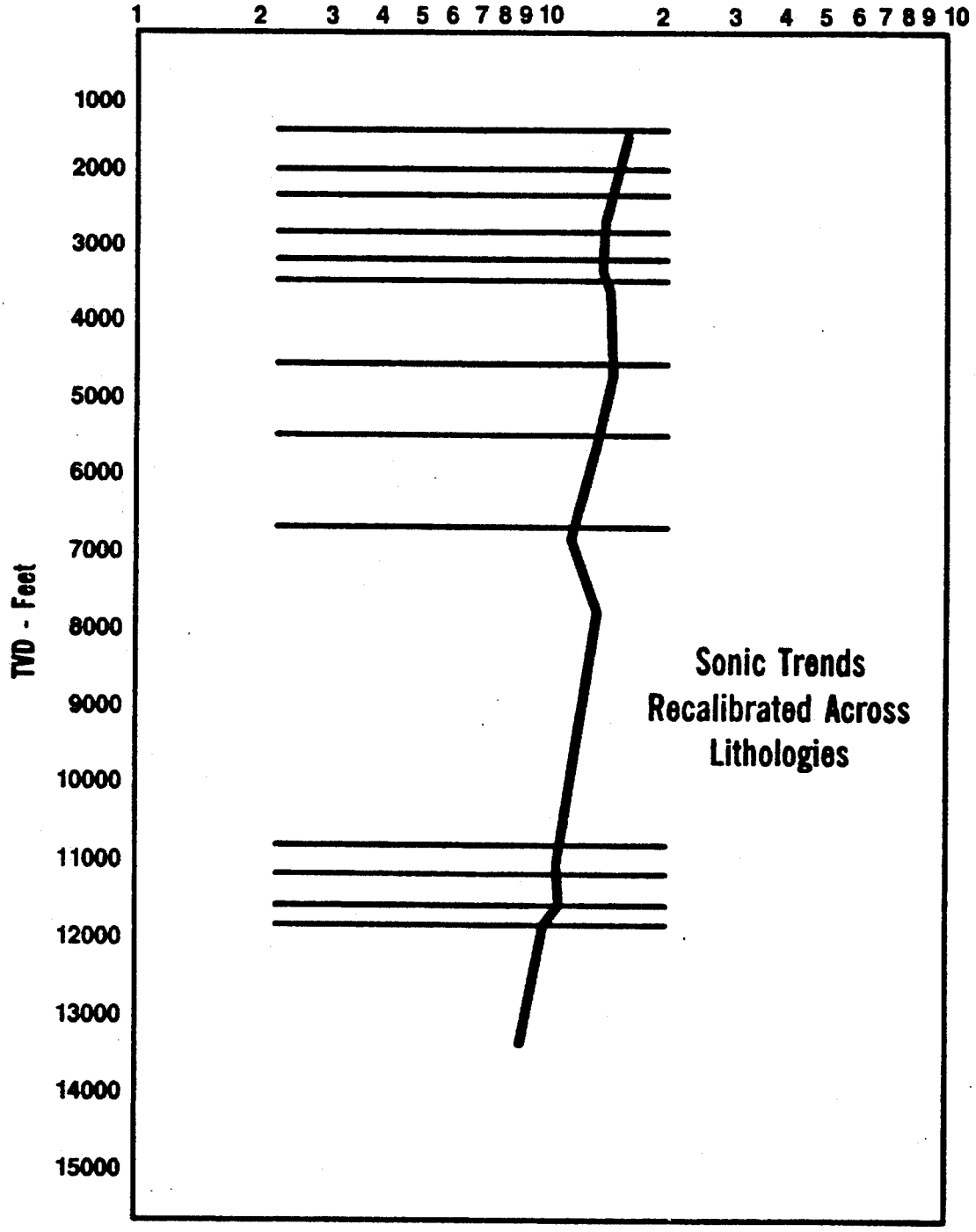

As depicted in FIG. 21, the trend lines are shifted horizontally, starting with the uppermost trend for reference to form one continuous curve. This "recalibration" across lithologies is based on the assumption that the lithology picks are the influential factor in 666 $\tau$ variations, not pore pressures. This then allows for recalibration since the pore pressures immediately above and below a lithology change are normally the same. A continuous trend curve depicts interval transit time values for different lithologies and pore pressure environments penetrated by the drilled offset well. This curve eliminates the influence of lithology changes on $\Delta\tau$, and thus the remaining factor that influences the curve is pore pressure.

Before an analysis of this curve can be performed to determine acutual pressures in the offset, one accurate pressure point was identified from drilling and completion summaries for the offset well. DST, RFT, or shut-in pressure information can also supply this information. In this example the offset well had a known pore pressure equivalent to 11.8 ppg at 12,175 ft. as measured in a drill stem test.

Figure 22:
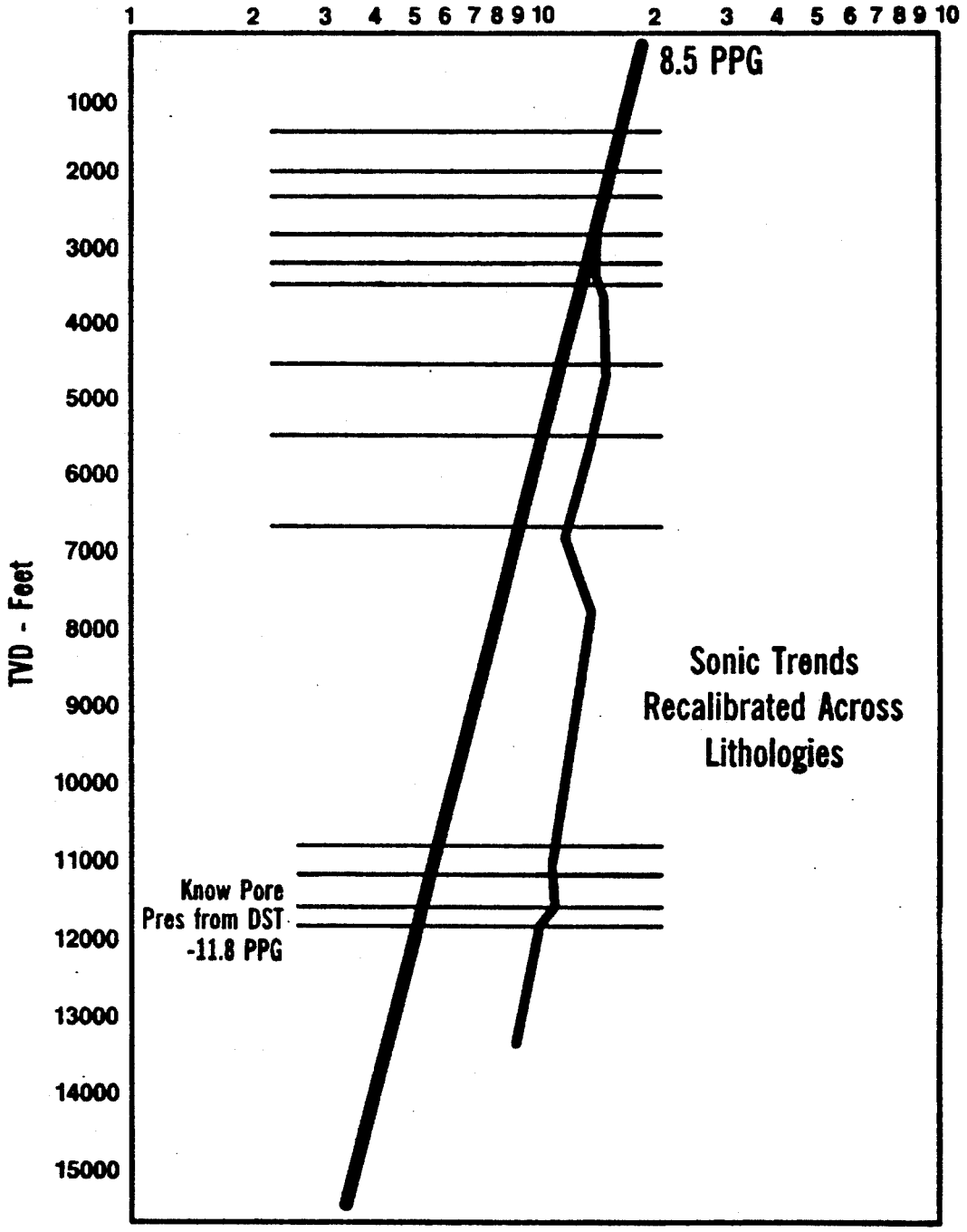

FIG. 22 shows the interpreted normal trend line for the offset well. As seen in this figure, the trend is based on that portion of the curve above 3000 ft.

To identify a normal compaction, a normal pressure trend line must favorably recalibrate that curve. This step is important for this analysis and those following to form usable ITT curves, as generated from seismic data. Desirably, all available information should be evaluated to best determine which part of the recalibrated trend line represents normal pressure trends.

Without an analysis of other information, including drilling fluid and bit records, this determination would have been very difficult to make. This stresses the need to have available all information related to the project.

Having identified the normal compaction, normal pressure line for our recalibrated curve, we now interpret pressures using our (Drill Stem Test) DST pressure as a reference. As Eaton presented, a pore pressure gradient can be determined from interval transit time information using the following equation (3):

$$G_p = G_o - (G_o - G_{pn})(\Delta\tau_n/\Delta\tau_o)^x$$

Because the exponent x was experimentally determined to be 3 for the Gulf of Mexico, based on an evaluation of regionally averaged data, the present example required evaluation of pore pressures for the North Sea case to determine the correct exponent for this area.

Rearranging equation 1 to solve for x:

$$x = \log((G_p - G_o)/(g_{pn} - G_o))/\log(\Delta\tau_n/\Delta\tau_o)$$

Solving for x requries input of the normal pore pressure gradient for the area $G_{pn}=0.442$ psi/ft, observed abnormal pressure point at 12,175 ft., $G_p=0.6136$ psi/ft, and values for $\Delta\tau_n$ and $\Delta\tau_o$ determined from the semi-log plot at 12,175 ft. (FIG. 22). The exponent x is now determined as follows:

$$x = \log((0.6136-1)/(0.442-1))/\log(45.5/92) = 0.5219$$

This value of x can now be used in equation 1 to generate a sonic pore pressure overlay by solving for $\Delta\tau_o$ for various assumed pore pressures. Equation 1 is rearranged to solve for $\Delta\tau_o$ as follows:

$$\Delta\tau_o = \Delta\tau_n/((G_p - G_o)/G_{pn} - G_o))^{1/x}$$

Various pore pressure gradients, based on mud weight equivalents, are, for example: 9 ppg=0.468 psi/ft, 10 ppg=0.520 psi/ft, etc. As an example, solving for $\Delta\tau_o$ for a 10 ppg gradient equivalent results in:

$$\Delta\tau_o = 45.5/((0.520-1)/(0.442-1))\ 1/0.5219 = 60.7$$

Figure 23:
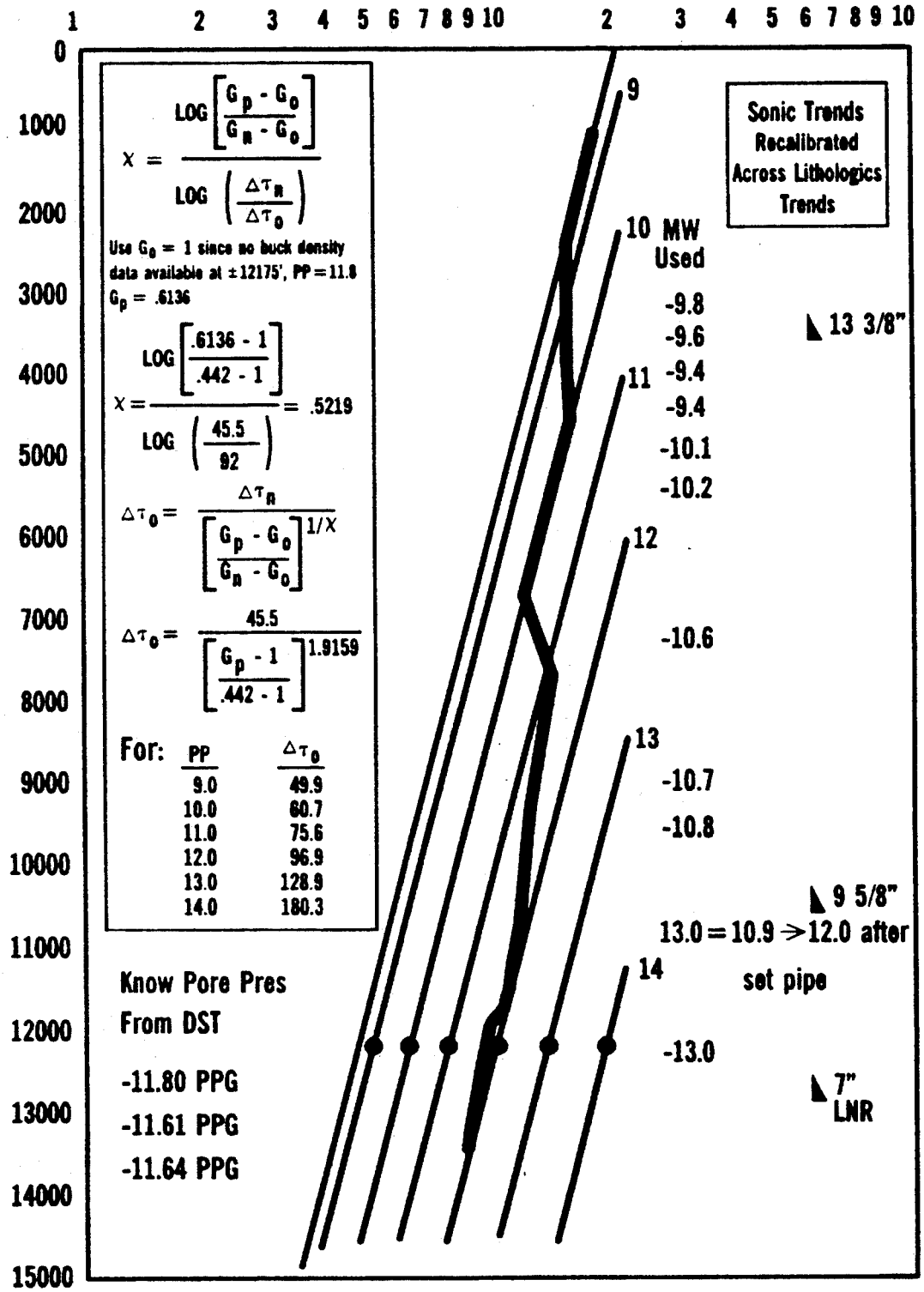

In this manner the overlay for different pore pressures may be developed by drawing parallel trend lines to the normal pressure line through the calculated $\Delta\tau_o$ points at 12,175 ft, as shown in FIG. 23.

Figure 24:
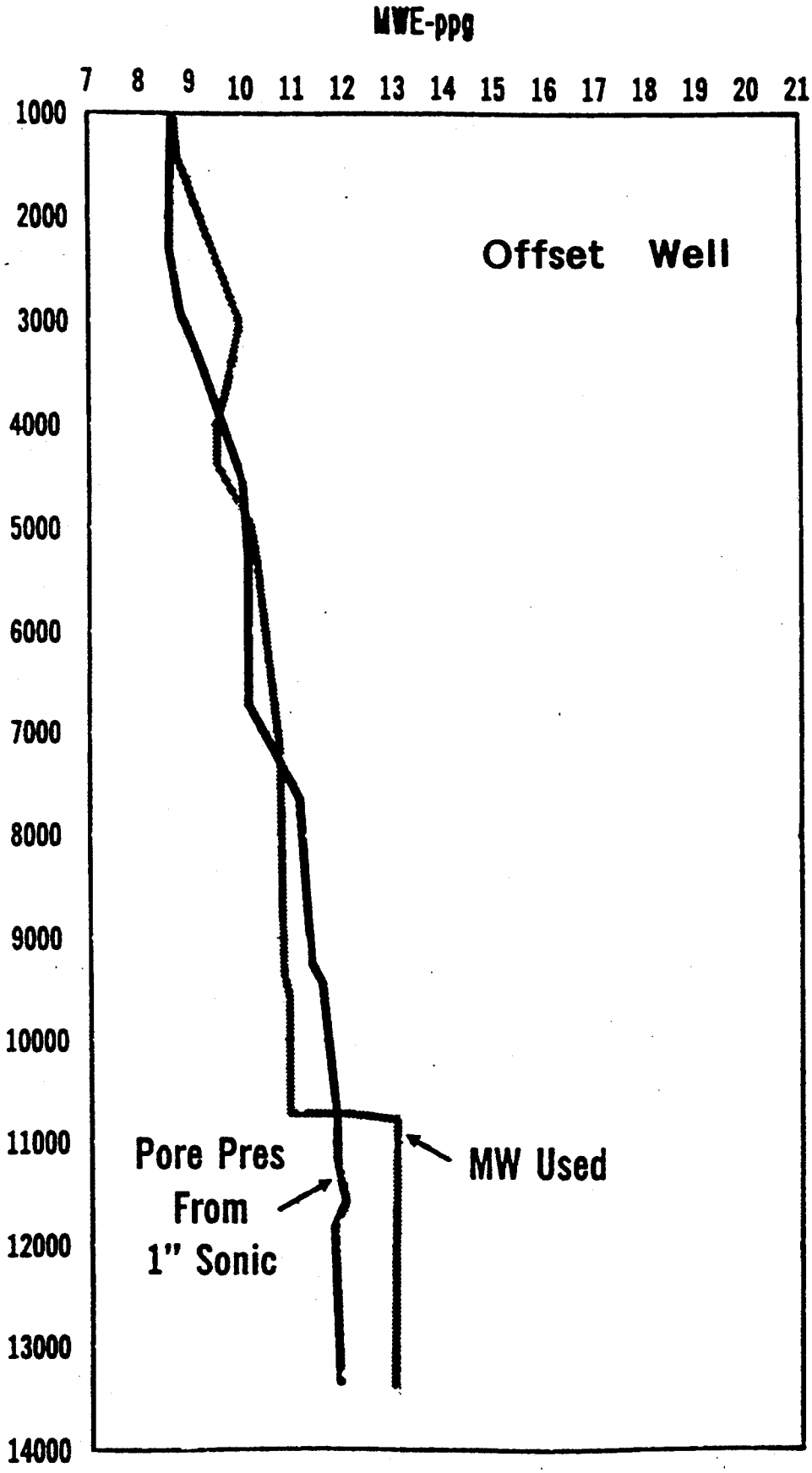

An actual pore pressure plot for the offset well is now determined by plotting pore pressures vs depth at inflection points from the recalibrated sonic trends, as in FIG. 24.

SEISMIC CORRELATION TO PROSPECT LOCATION

The next step in the method of the present invention is to correlate known pore pressure points in the offset well to the prospect well location. This step requires interpreted seismic lines which pass through or very near both the offset well, and the prospect well, locations. Additional interpreted lines may be required to tie the two well lines together. A seismic base map may be necessary to determine which lines to evaluate. Desirably, as many pore pressure points as feasible are plotted on the offset well trajectory for the best correlative prediction.

In this example, three interpreted seismic lines were used to tie the offset and prospect well together. Using the time/depth conversion for the offset well, known pore pressures were plotted on the actual well bore trajectory for the offset.

Figure 25:
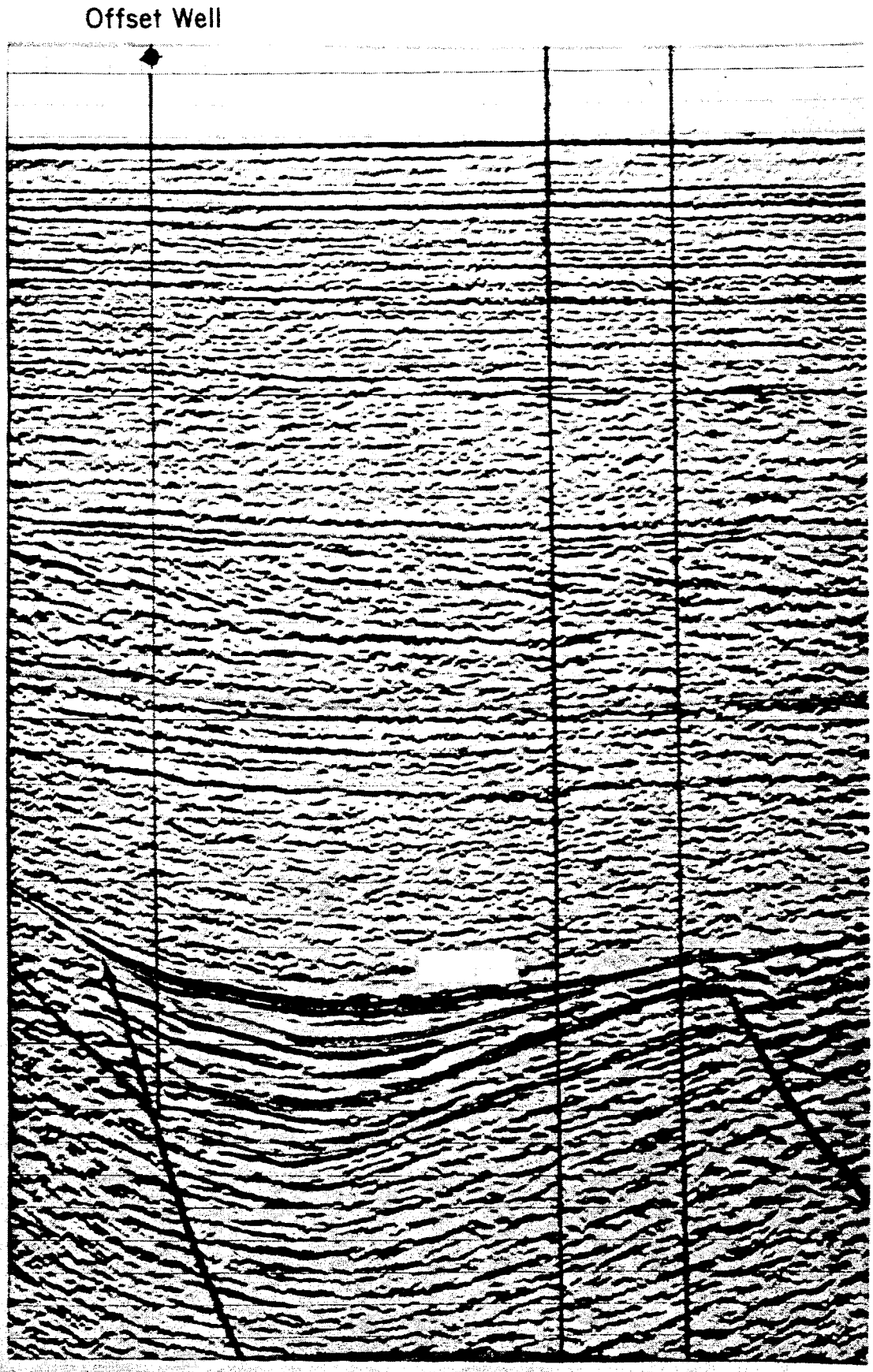
Figure 26:
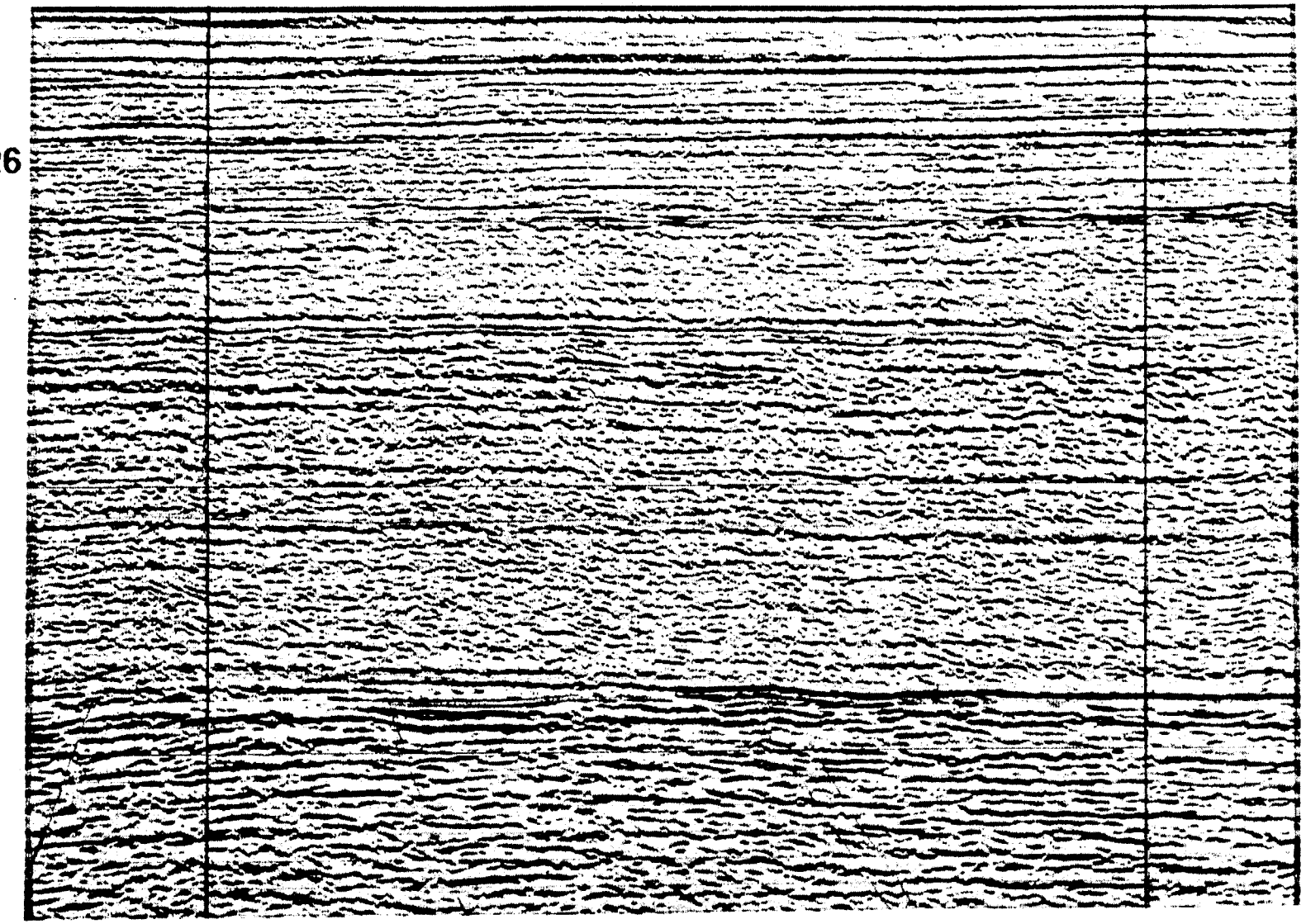
Figure 27:
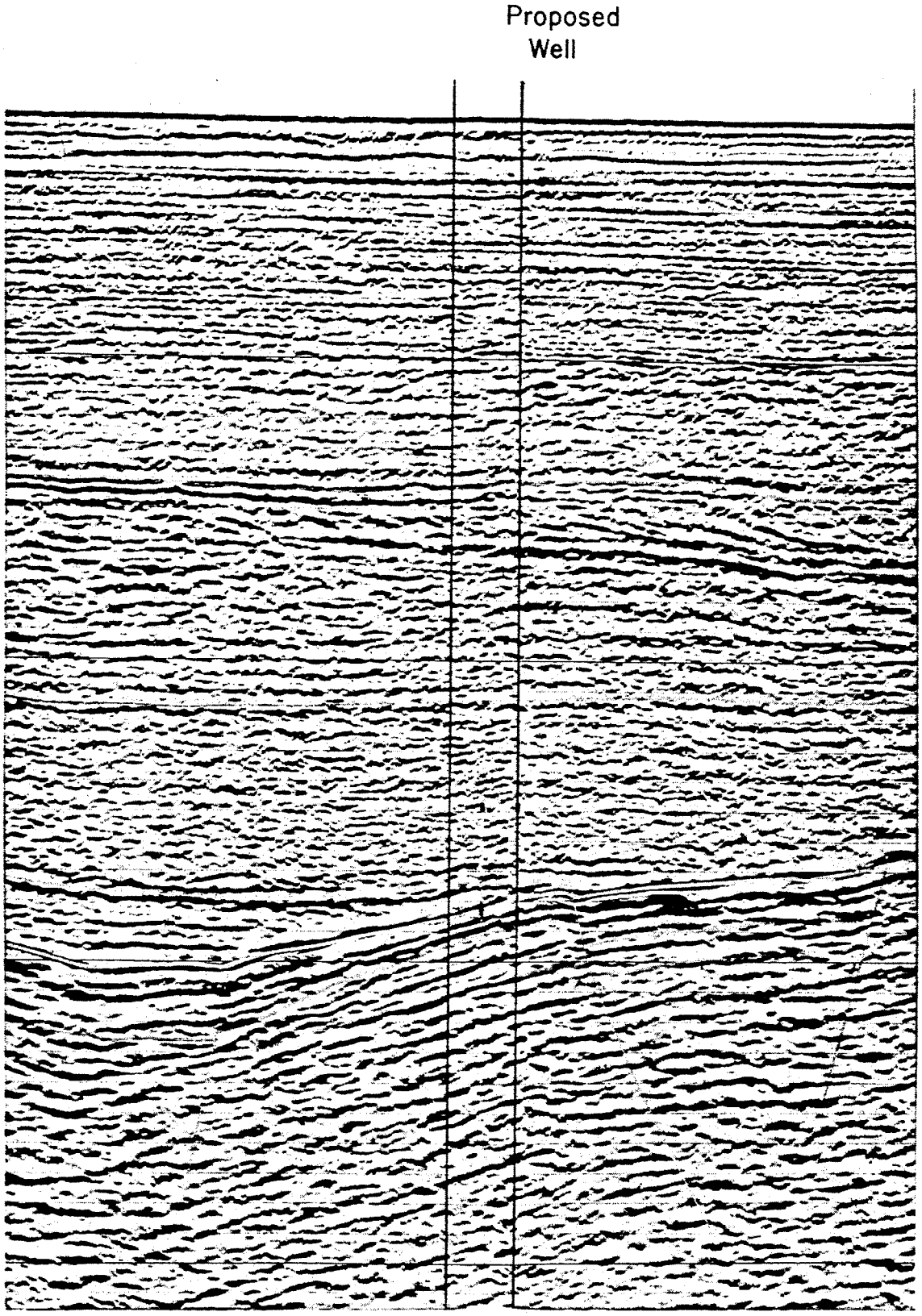

The subsurface horizons corresponding to these points were then identified and mapped from the drilled offset well through the prospect well location. FIGS. 25, 26 and 27 show this correlation. Because, as is usually the case, faults or "pinching" eliminates some of the identified horizons, all horizons may not correlate completely through the prospect site. In the present example, much correlation through the seismic lines indicated that three plotted pore pressure horizons, found in the offset well, were not present in the prospect location.

After seismically mapping to the prospect, the depths for correlated horizons were determined. This step requires use of the time/depth conversion from the offset. It is possible that the correlation may identify significant thickening or thinning of some horizons at the offset well which will affect the accuracy of the time/depth conversion at that well for correlation with the offset well. If thickening or thinning occurs, time/depth conversions are determined by converting velocity values at the offset well into interval velocities for each plotted horizon. These interval velocities from the offset well are then applied to the corresponding formations at the prospect well to determine the correct depths correlated to the pore pressure horizons. The three columns represent (1) depth in the well (2) pore pressure (PP) in mud weight equivalents of pounds per gallon and (3) two-way seismic wave travel time.

The results of the interpretation are presented in FIG. 28. This correlation indicates that there was no significant structural relief (e.g. pinch outs or faults) between the two wells. Therefore, well pressures in the prospect well were not expected to be significantly different from those in the drilled offset well.

After determing correlative formation depths in the prospect, the pore pressures were then corrected for structural relief between wells. This analysis assumed that the two locations were hydraulically related and that the pore fluid was water, which is usually the case. Pressures were then corrected in FIG. 28 by simply adding or subtracting the hydrostatic pressure of the normal hydrostatic pressure (HP) fluid gradient, exerting pressure equal to 0.442 psi/ft. For example, the pressure in the offset at 10,800 ft determined from analysis of the sonic log was:

$$HP - MWE*.052*TVD =$$
$$11.8\ \text{ppg}*.052*10{,}800 = 6627\ \text{psi}$$

Since this horizon was identified as being 280 ft deeper in the prospect well, the pressure at 11,080 ft. in mud weight equivalent was obtained by adding the pressure exerted by 280 ft of water to the pressure calculated in the offset well at 10,800 ft.

$$HP = 6627\ \text{psi} + (280\ \text{ft} * .442\ \text{psi/ft})$$
$$HP = 6627\ \text{psi} + 124\ \text{psi} = 6754\ \text{psi}$$

Converting to mud weight equivalent:

$$MWE = PP/(.052*TVD) =$$
$$6754\ \text{psi}/(.052*\ 1080') = 11.7\ \text{ppg}.$$

Although this change was insignificant for the instant prediction, this step is important for any correlation to accurately predict pore pressures. Such pressures, converted to mud weight equivalent, can vary dramatically from well to well in many areas. This must be determined, as illustrated above, when predicting pressures for a prospect well using seismic correlations alone.

Figure 29:
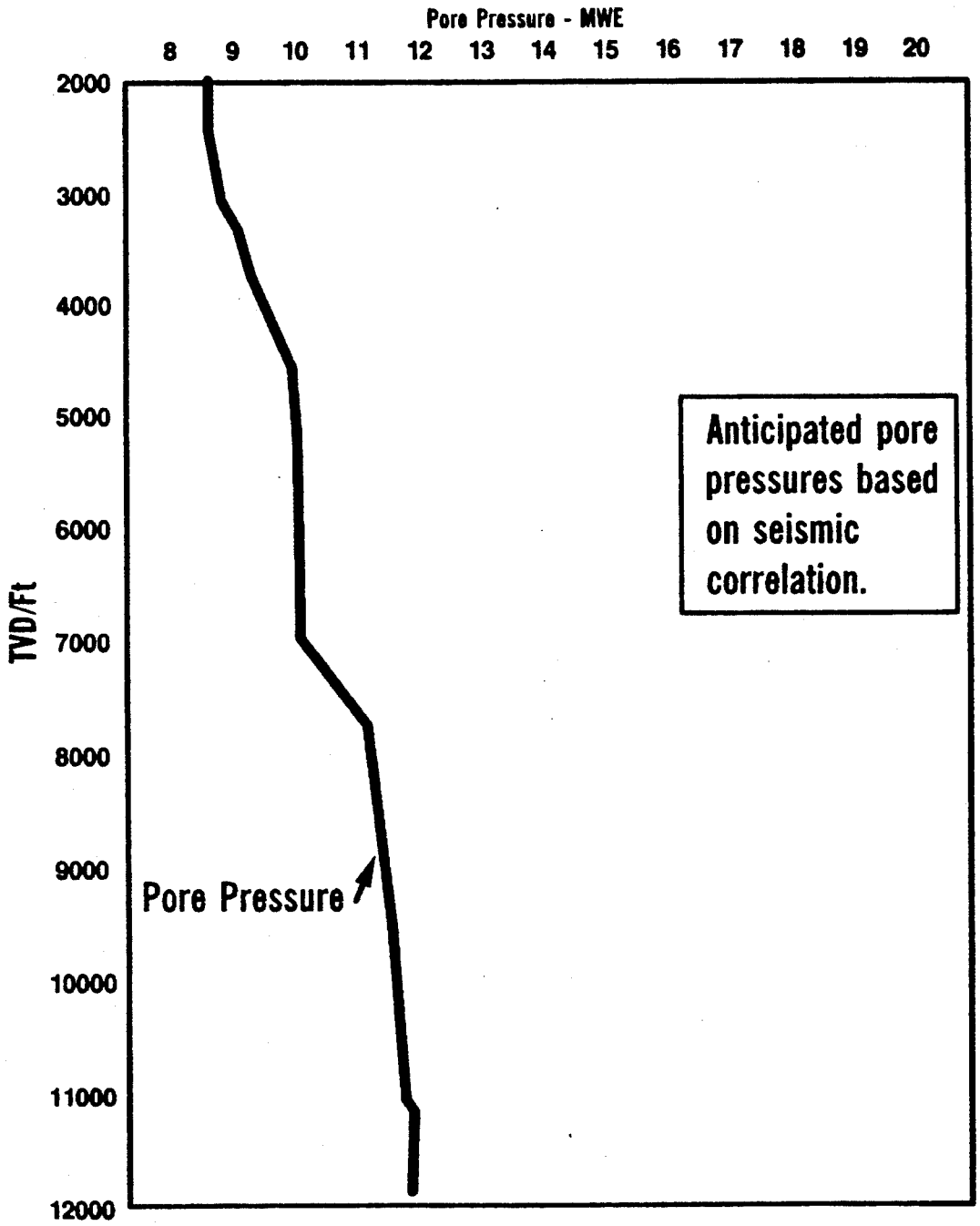

From the determined and correlated pressures, a pore pressure profile for the prospect is displayed in FIG. 29. This profile may or may not be accurate, because it assumes a hydraulic relationship between the two locations. However, as noted above, this may not be the case, because a prospect well may be in an entirely different pore pressure environment than the one that exists at the evaluated offset well. Accordingly, to determine whether the correlative prediction is legitimate, it is necessary to further analyze the seismic information.

Seismic ITT Development and Analysis

As suggested above, seismic velocity information is desirably redisplayed into interval transit time (ITT) curves.

For this step it is necessary to develop ITT curves at the closest seismic shot points to the offset and prospect locations. For the instant North Sea example two curves were generated for this analysis.

Figure 30:
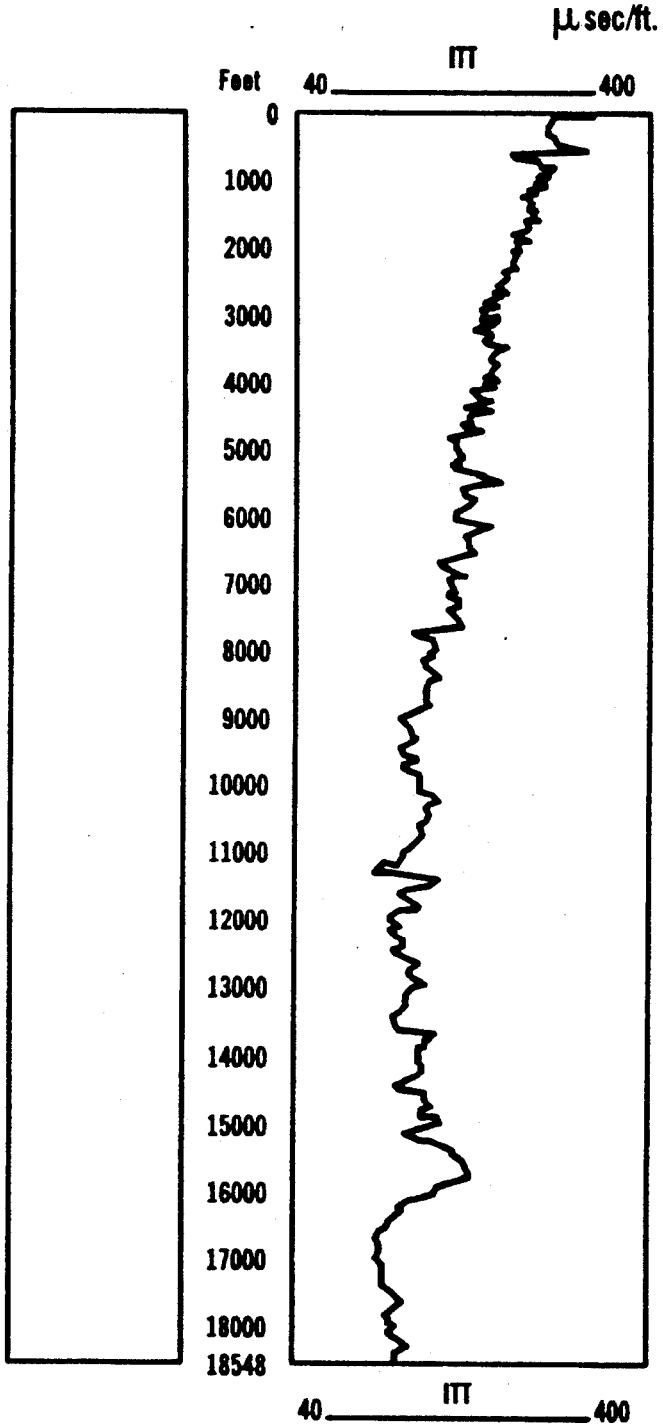

FIG. 30 shows the offset well ITT curve comparison to the sonic log in the offset well. This display is on semi-logarithmic paper with interval transit times in micro seconds per foot versus depth on a linear scale of one inch equal 1000 ft.

Figure 31:
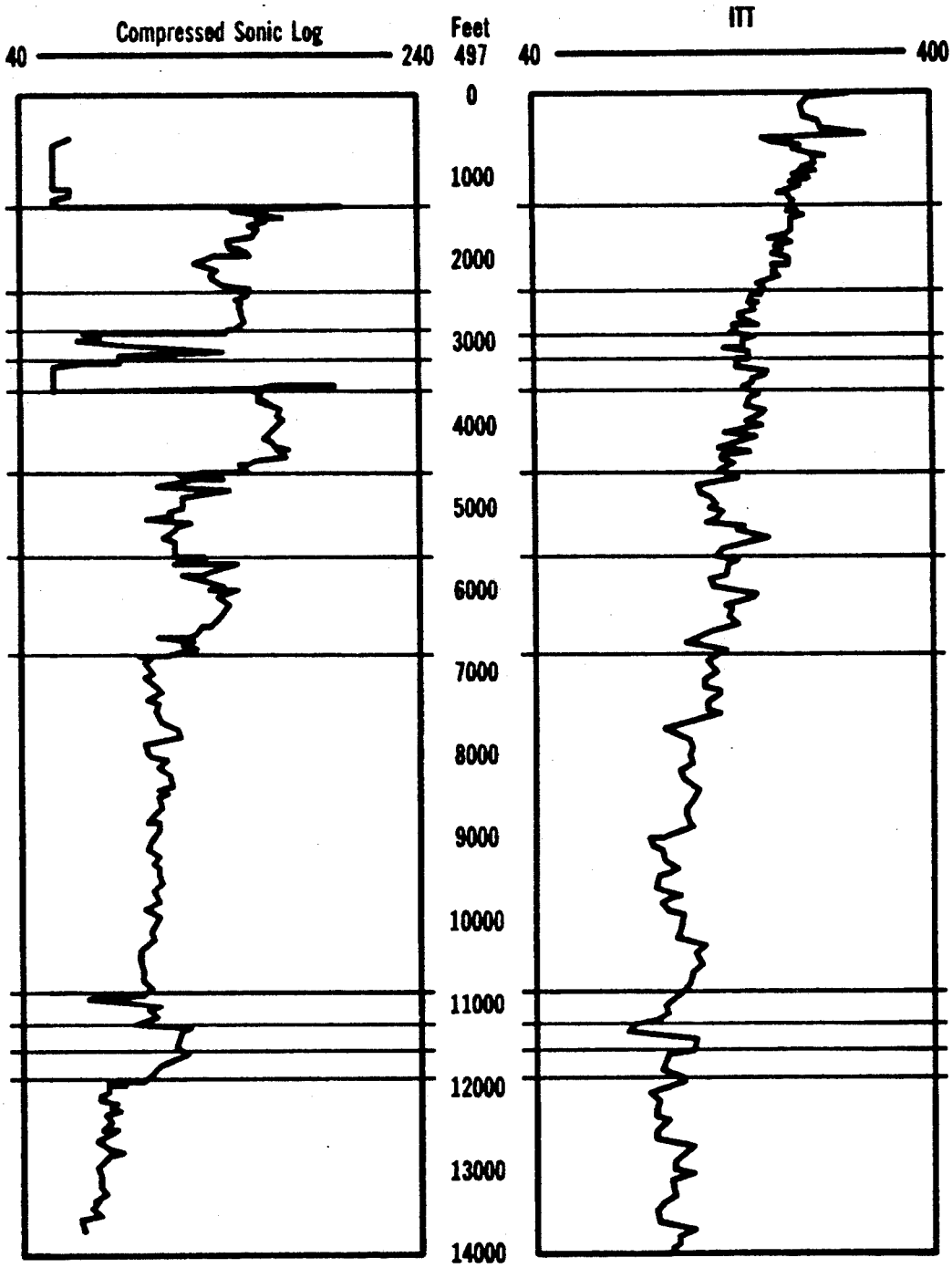

The sonic log for the offset well is compared to the ITT to determine where major lithological shifts may occur as shown in FIG. 31. Even without a gamma ray log the ITT character closely resembles the sonic log presentation so that it is satisfactory for selecting changes in lithologys. This procedure is performed to determine recalibration or shifts for ITT trend lines, as was done with the sonic log.

Figure 32:
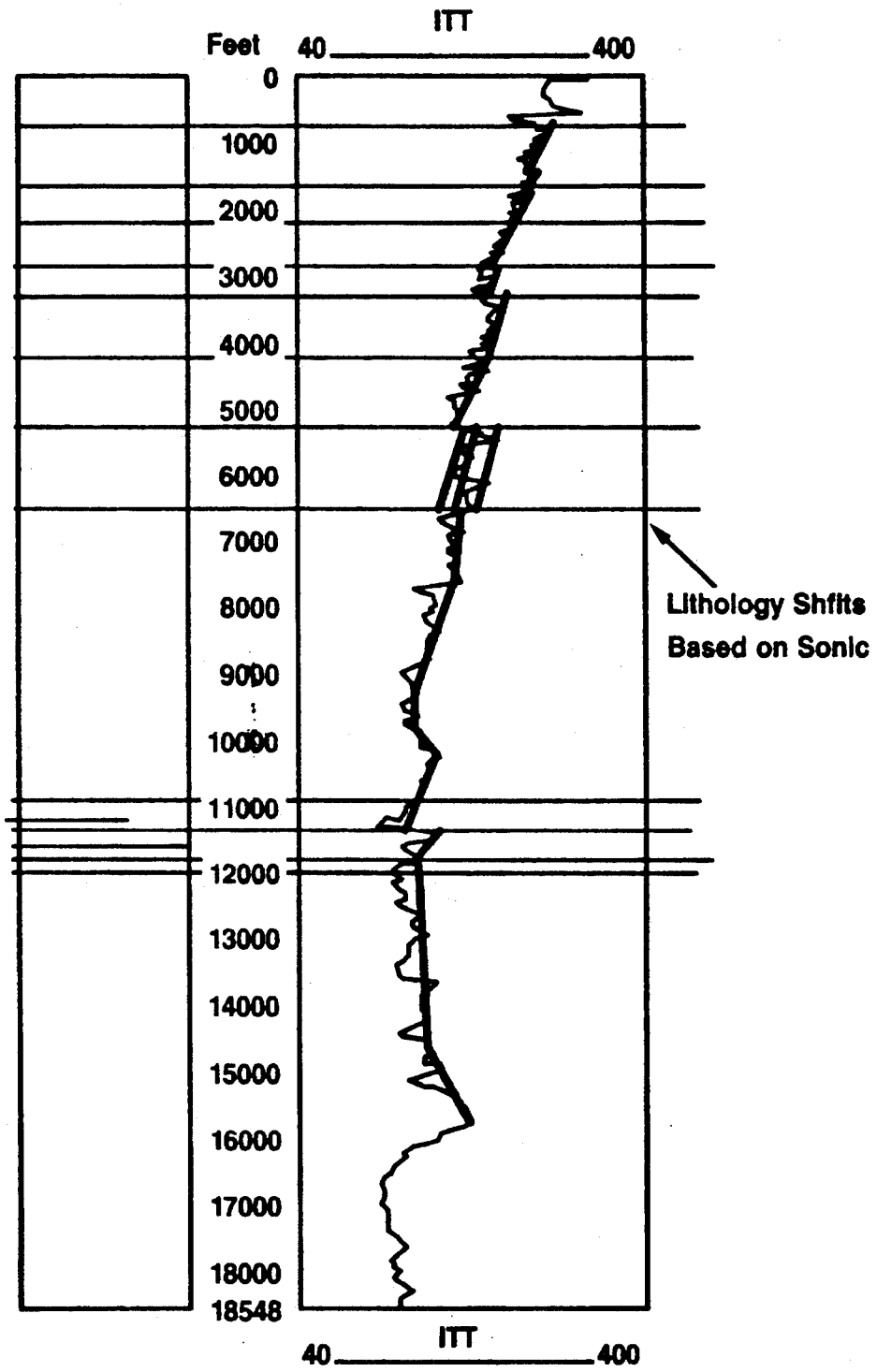
Figure 33:
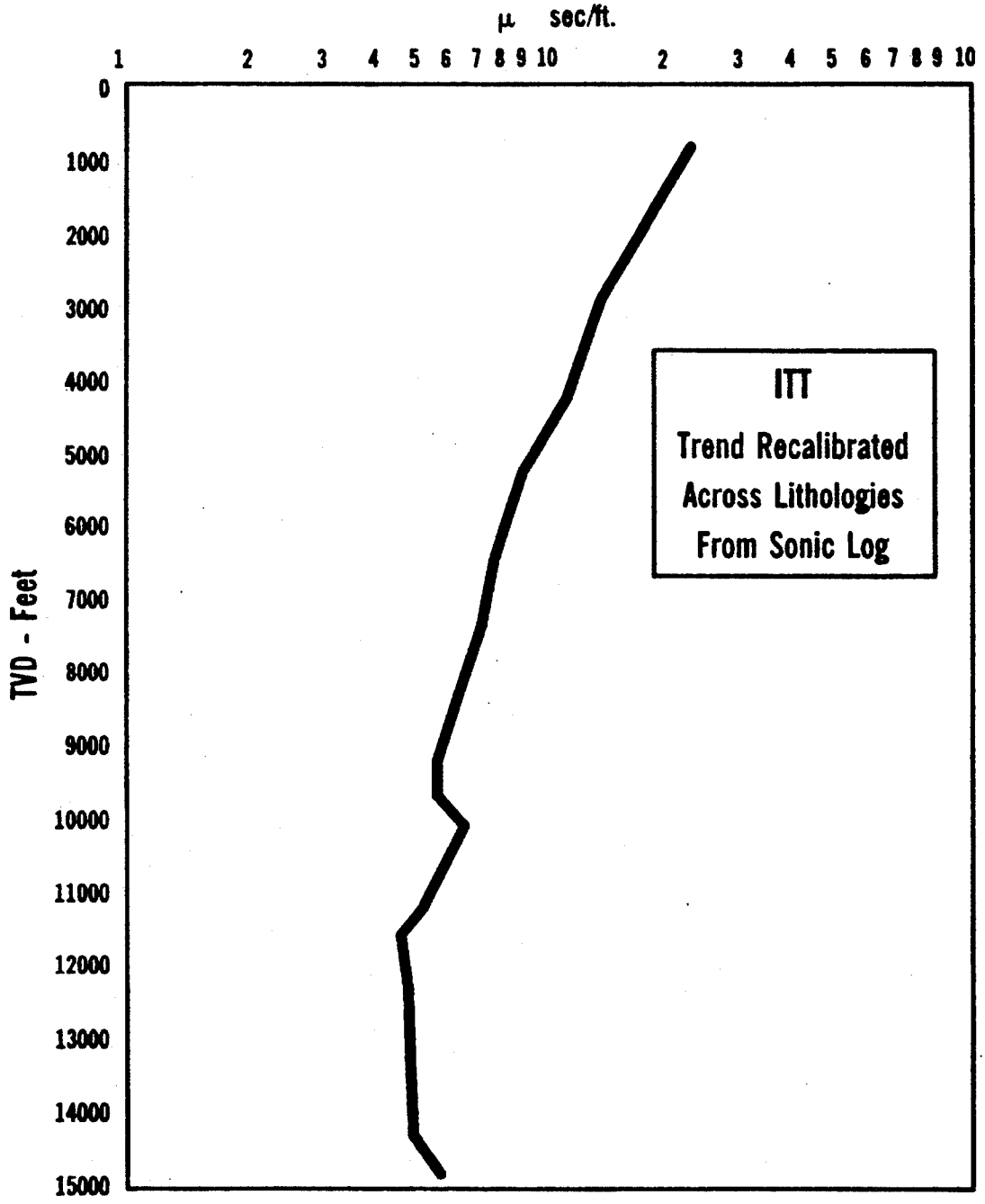

After identifying changes in lithologys, trend lines were established, as seen in FIG. 32. These trend lines were moved to a continuous curve and displayed on a semi-logarithmic scale, as seen in FIG. 33.

Evaluation of this curve was performed as described previously for interpretation and to generate an overlay from the sonic log. It is important, as in Example 1, to recall that depths assigned to the two curves may not coincide exactly between the sonic log and the ITT curve. The sonic log obviously has the most accurate depth information. After determining the normal compaction, and normal pressure trend line for the ITT curve, depths are corrected, based on the top of abnormal pressure, to match those on the sonic log. The known pore pressure point at 12,175 ft is identified in the depth corrected ITT curve to develop the ITT pore pressure overlay.

Figure 34:
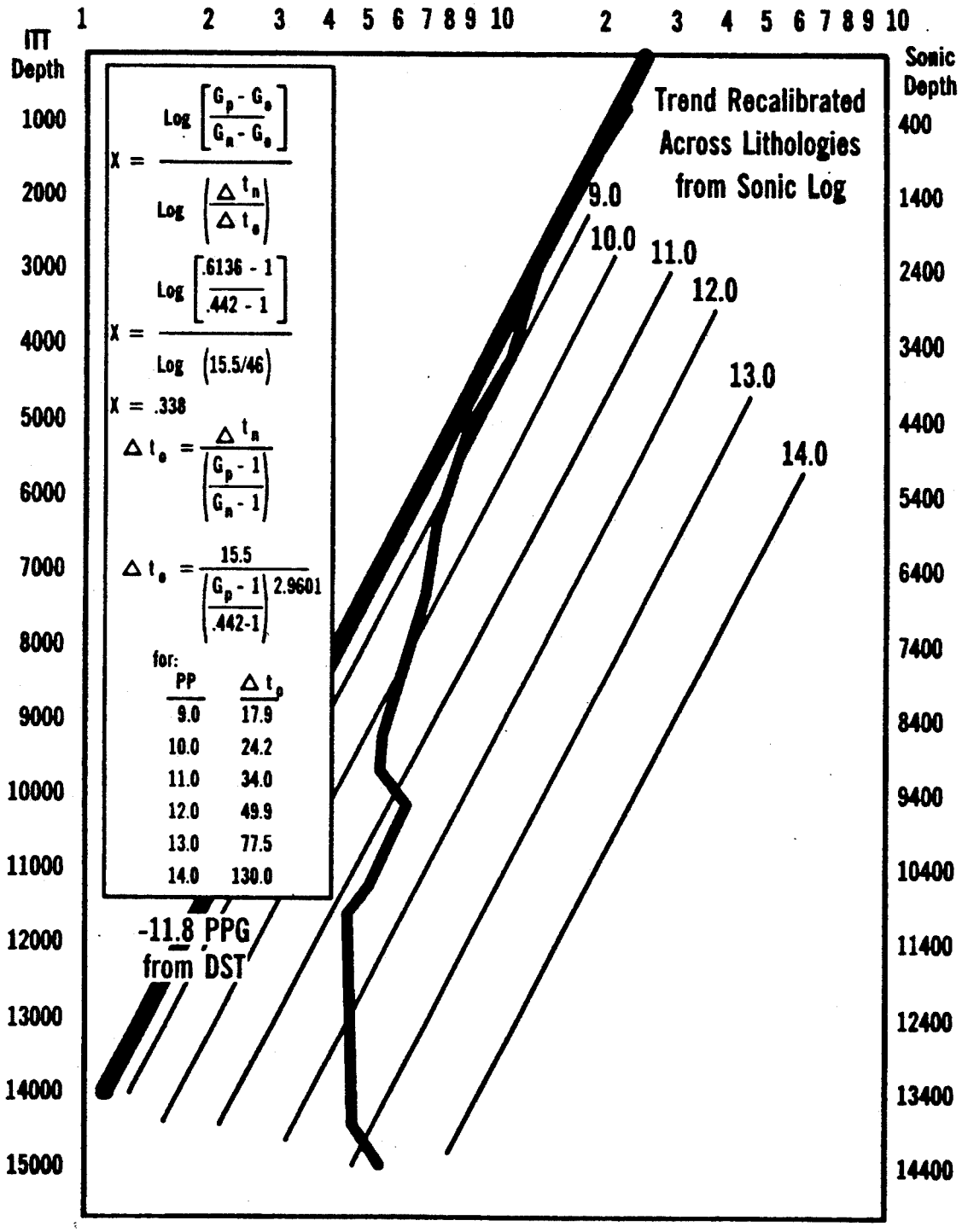

The ITT curve for the North Sea offset well is shown in FIG. 34, with pore pressure overlay developed as was done for the sonic log. In this case, the ITT curve had to be corrected 600 ft to match depths from the sonic log. Note that the exponent x determined from ITT analysis is 0.338 versus 0.5219 for the sonic log. This is expected since the interval transit time information is developed form entirely different sources.

Figure 35:
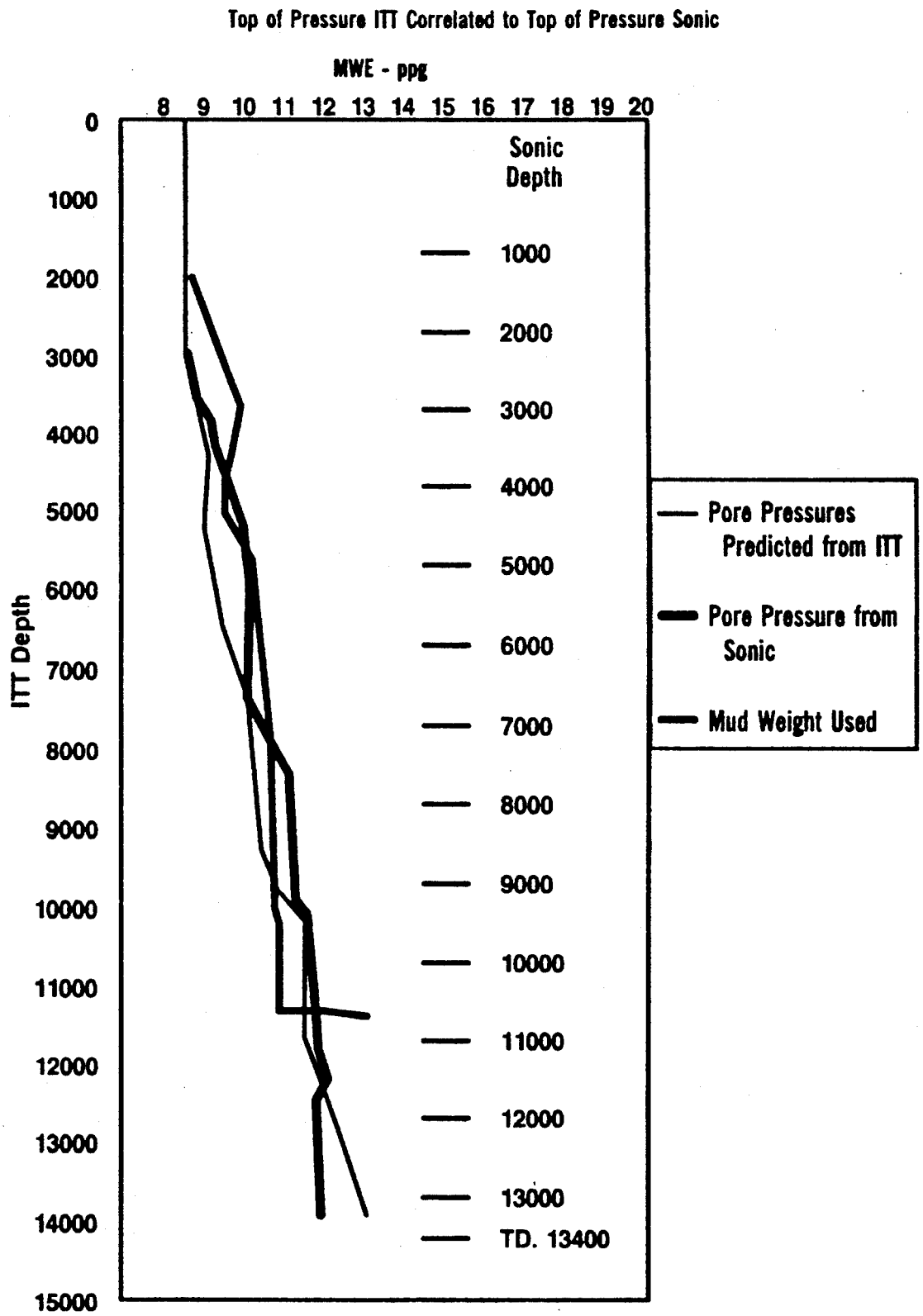
Figure 36:
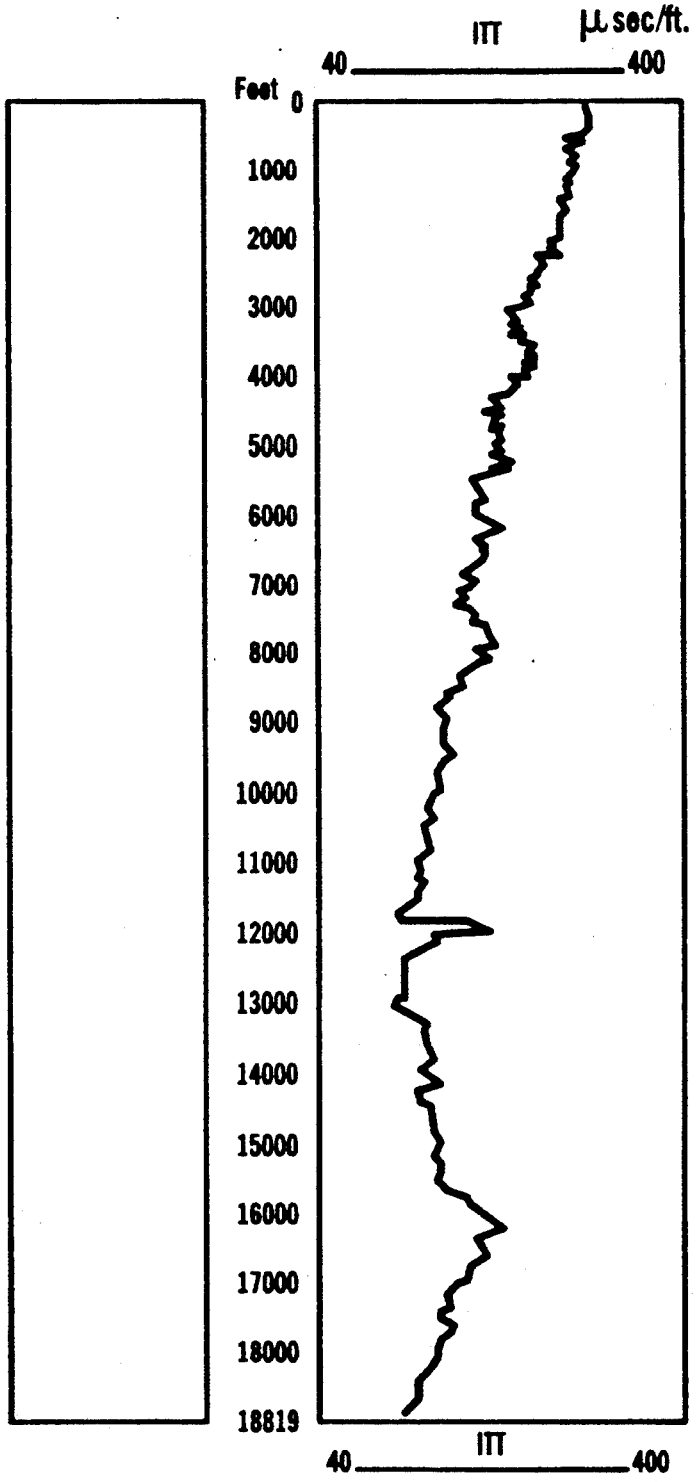
Figure 37:
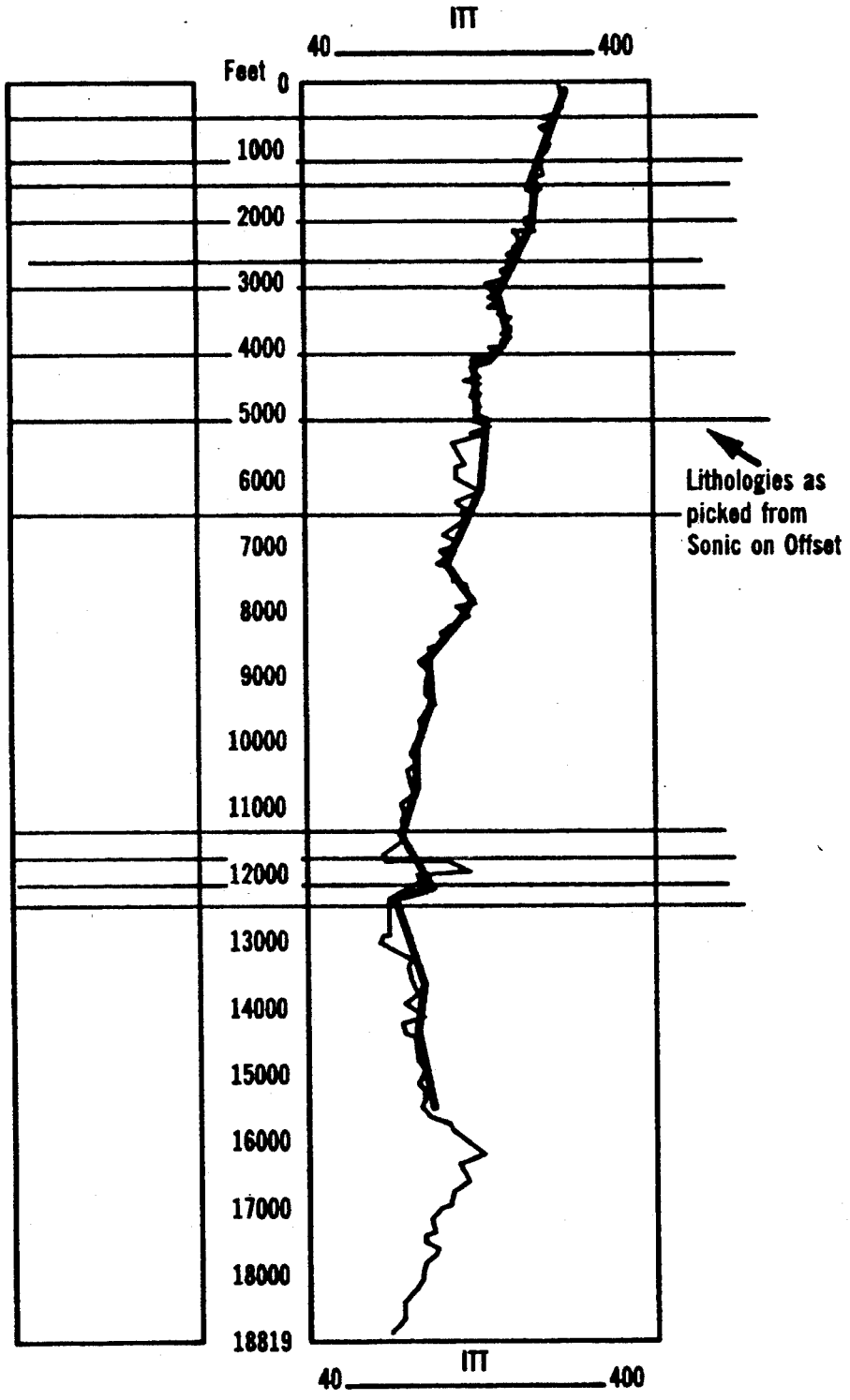
Figure 38:
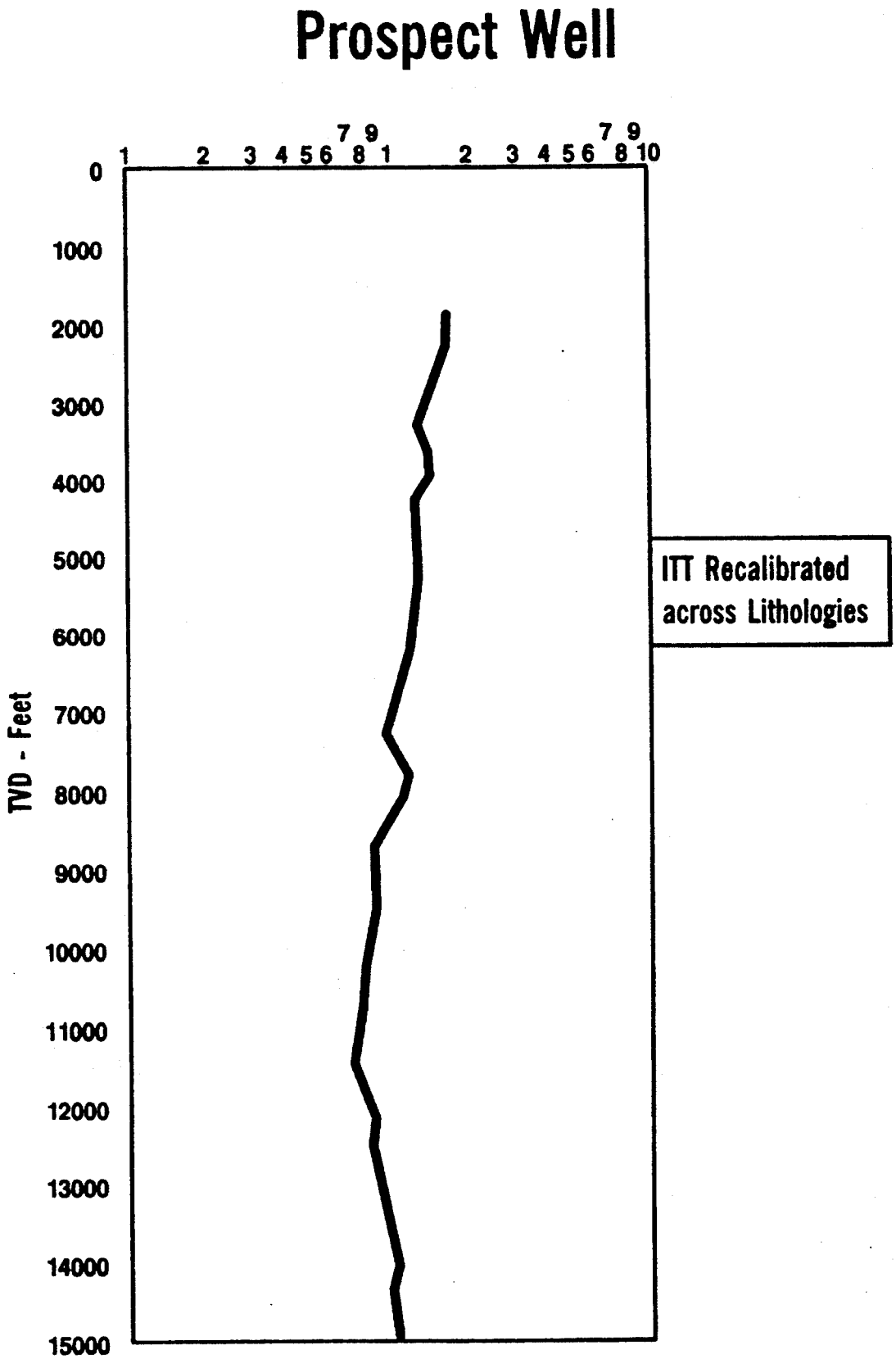
Figure 39:
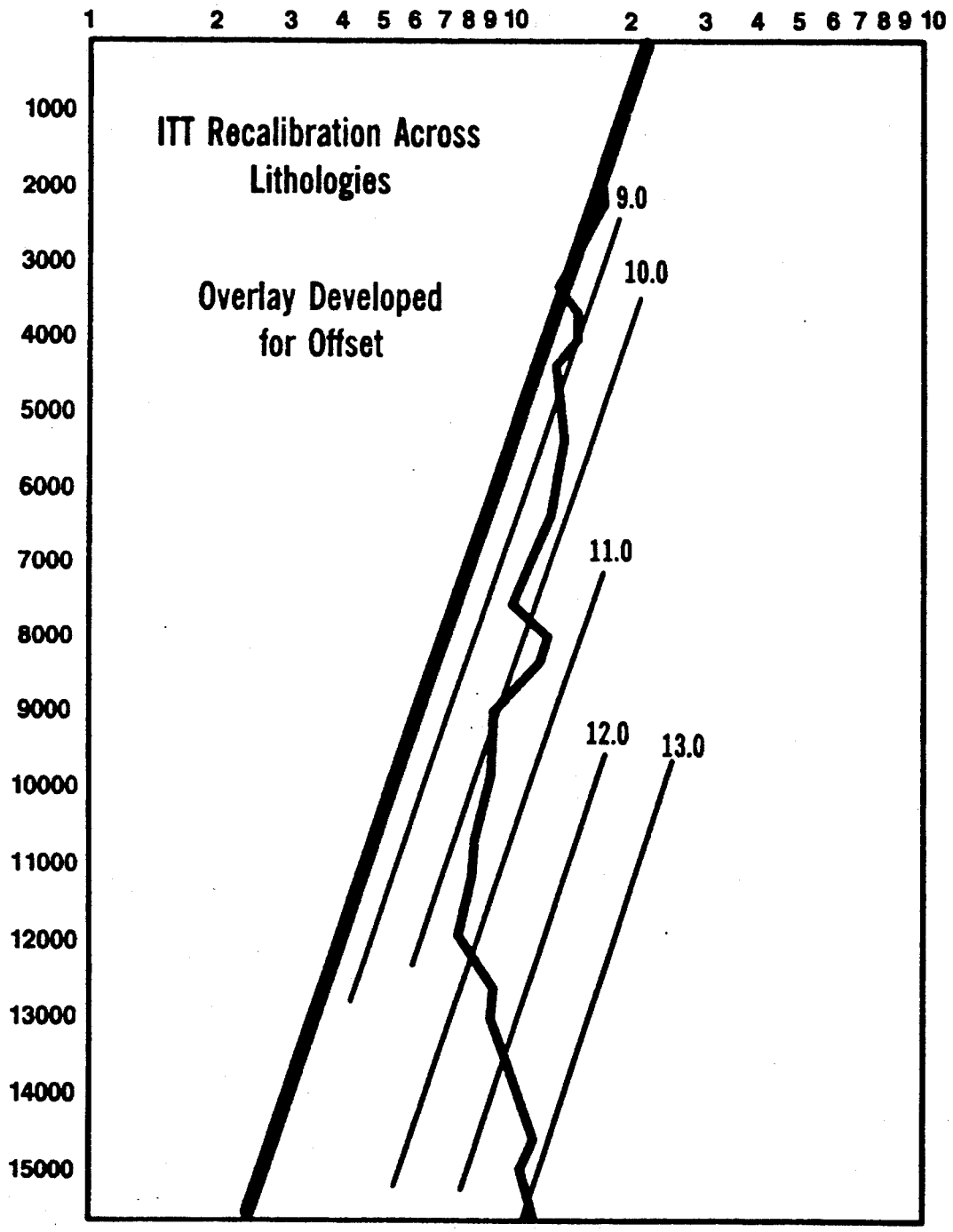

FIG. 35 shows a plot of the sonic log and ITT pore pressure interpretations and mud weights used on the well, and to check the accuracy of the overlays. As shown, the two pore pressure profiles track closely, giving confidence in the interpretation. The overlay is additionally useful for applications to other seismic generated ITT curves to predict pore pressures in other prospect wells in the same general area of the North Sea.

While it is useful to have additional offset wells, the overlay generated for the ITT on the first offset can be applied to such other ITT curves. In this manner, the accuracy of the overlay can be determined, and further refined, as it is based on additional information from such other wells.

Now in the instant example, the overlay generated for the ITT curve at the prospect location can be further evaluated. Lithologies are determined by matching the ITT's between the wells. Similarly, trend lines and recalibration of the curves are performed as before, and from these a continuous ITT curve is developed on a semi-log scale.

Pore pressures are then determined from this curve by using the overlay developed for the offset ITT. The normal compaction, normal pressure trend line, is identified using the same procedure as for the offset well. The normal pore pressure line on the overlay is then matched to the ITT normal trend line. Pore pressures are then determined by reading values from the overlay corresponding to various points and inflections on the ITT curve.

After identifying pore pressures versus depth it is necessary to depth correct these values. Because the ITT depths were corrected 600 ft for the North Sea offset well, this same correction is applied to the prospect well. FIGS. 36, 37, 38 and 39 shown these steps for the North Sea prospect well.

FINAL PORE PRESSURE PREDICTION

From the foregoing it is now possible to compare the ITT prediction to the previous correlative work. There were three possibilities. One is that the curves may match closely. The others are that they may not match at all, or they may overlay only in part. If they match, it can be assumed that the wells are hydraulically related. This correlative prediction is based on the more detailed and accurate sonic log analysis. If the curves are entirely different it is probable that there is no hydraulic relationship between the locations, and the ITT profile alone should be used for the prediction. Finally, if they match in part, the correlative prediction can be used where they match, while the ITT prediction can be used where they deviate. This condition suggest that there is only a partial hydraulic relationship in portions of the well due to a different pore pressure environment.

Figure 40:
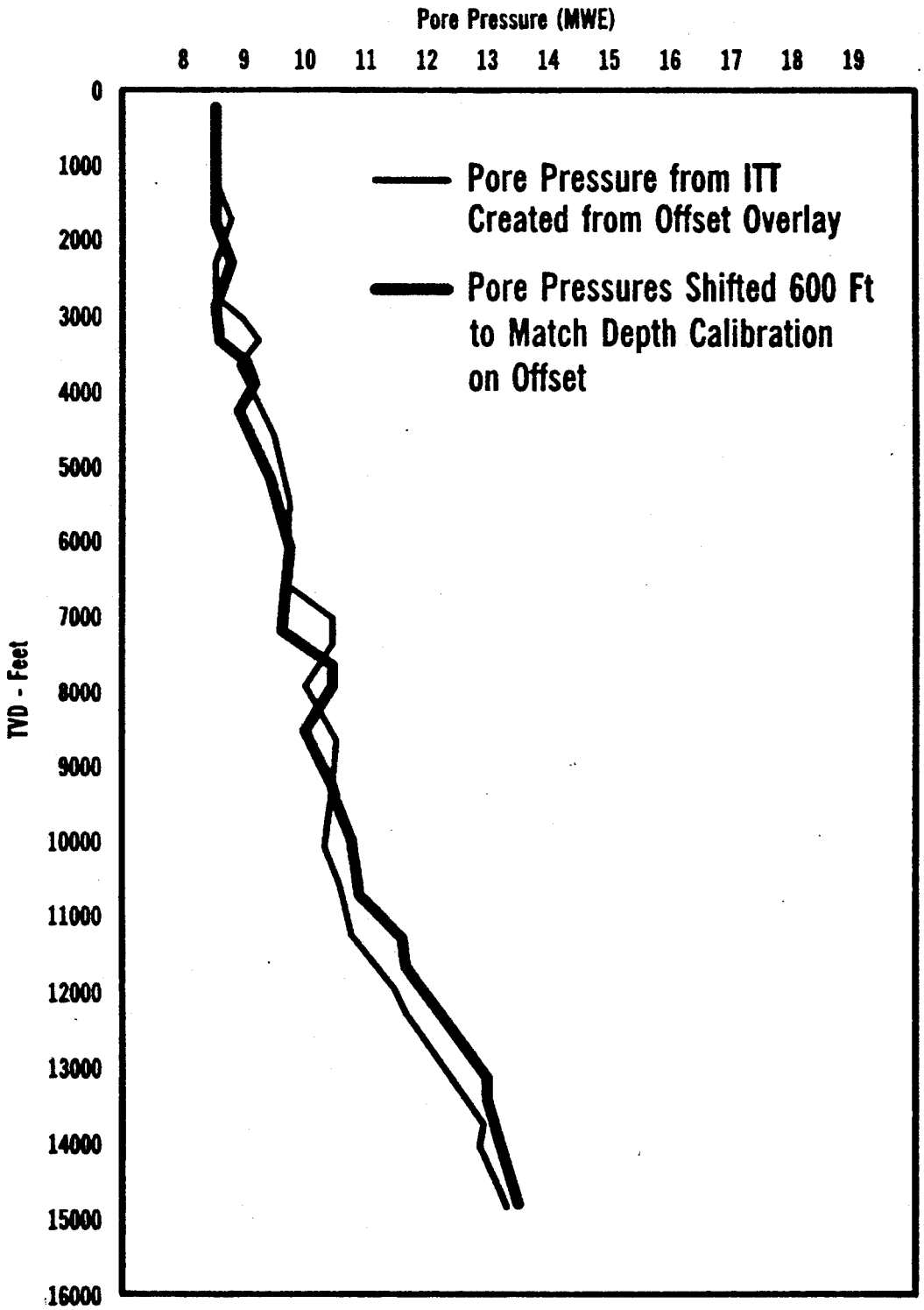

Because the curves of this example match closely throughout, as seen in FIG. 40, the relationship obviously suggested that the well would be hydraulically related and could be used for predicting the correlative profile.

Figure 41:
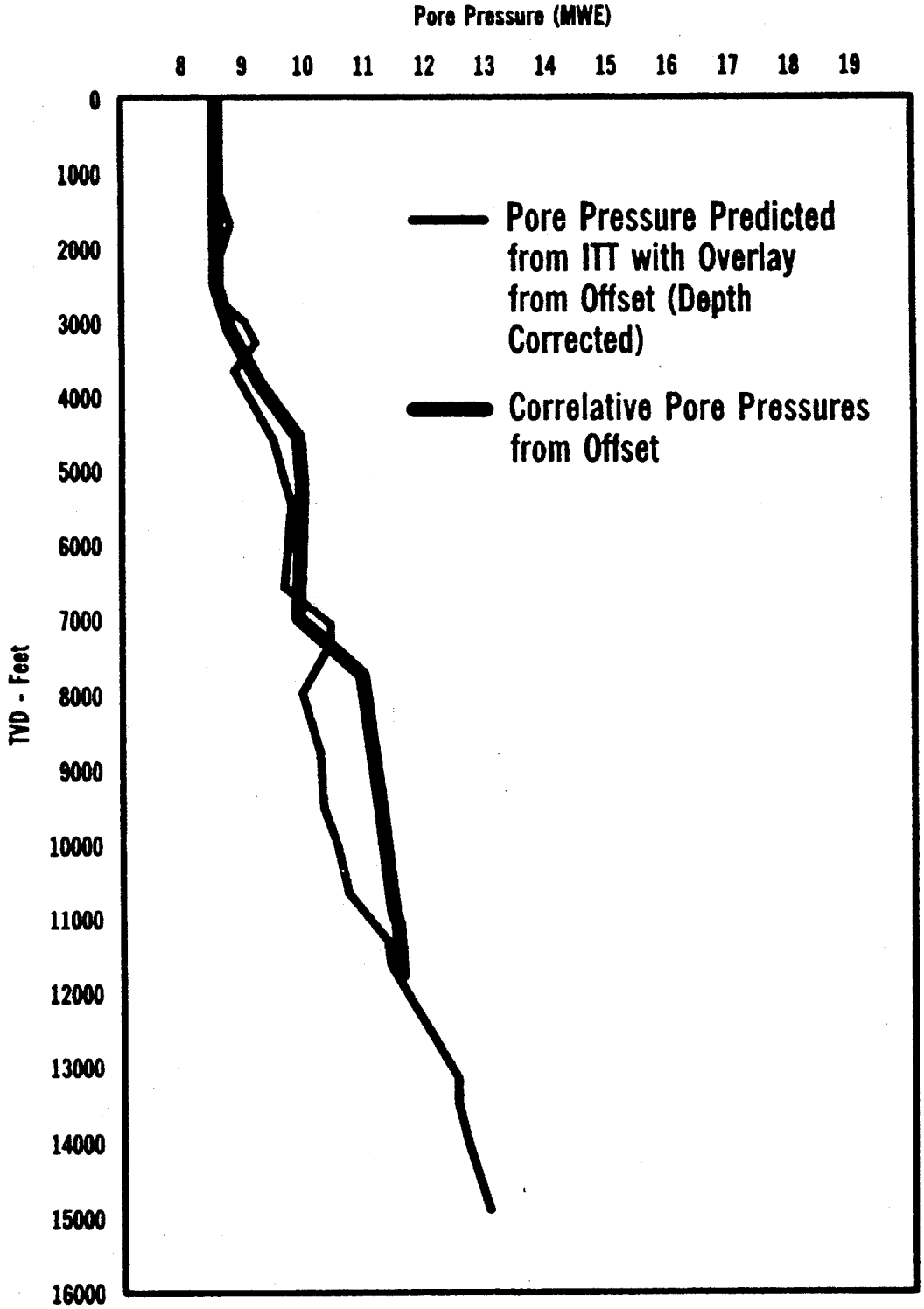

The final predicted pore pressure profile is shown in FIG. 41. Pressures from this curve can thus additionaly to used to determine the anticipated fracture gradients. The relative positions and magnitudes of the curves also can be used to determine casing setting depths, casing design, drill string design, mud and hydraulics programs, etc. for a comprehensive well plan.

POST WELL ANALYSIS

Figure 42:
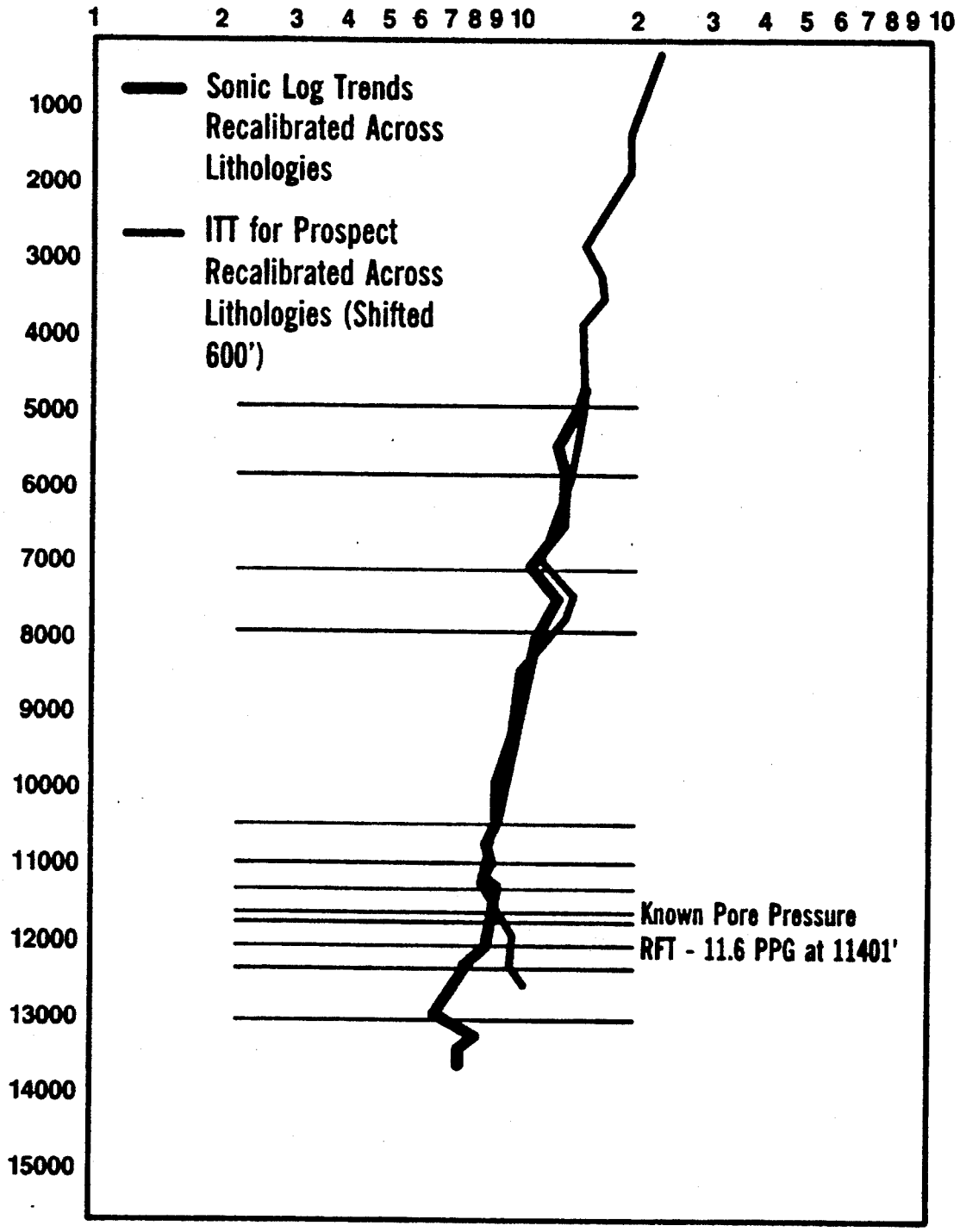
Figure 43:
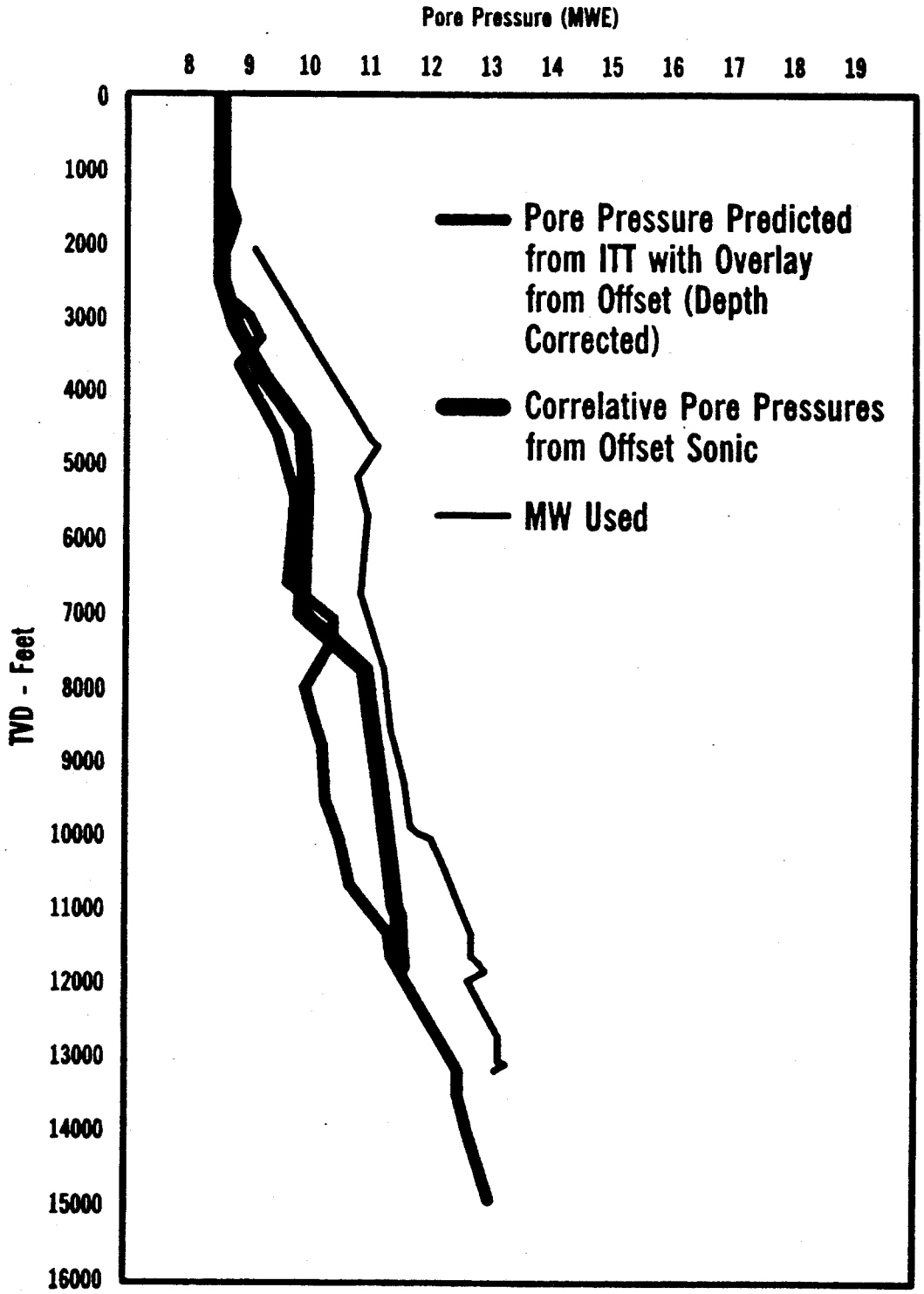

The prospect well was drilled to 13,208 ft with a final mud weight of 13.4 ppg. Logs were run in the well below 4400 ft. Since abnormal pressure was predicted and observed to develop above 4400 ft it was not possible to identify a normal pressure, normal compaction trend line from log analysis. The sonic log was plotted, however, for trend comparison to the ITT generated from seismic data at the prospect location. As seen in FIG. 42 the trends matched closely, thus giving confidence in the correctness of the predictions. A final plot of estimated pore pressures versus mud weights used to drill the offset well is shown in FIG. 43.

RFT information was obtained from sand at 11,401 ft. Recorded pressure was 6,884 psi. which equates to a 11.6 ppg equivalent pore pressure. At this depth the present method prediction had estimated an 11.8 ppg pore pressure.

EXAMPLE III

The present method has also been used in determining pore pressures in wells drilled in carbonate environments. FIGS. 44 through 60 illustrate the procedure for predicting and verifying the application to a well drilled in the Dentin Dome area of the Gulf of Mexico.

Figure 44:
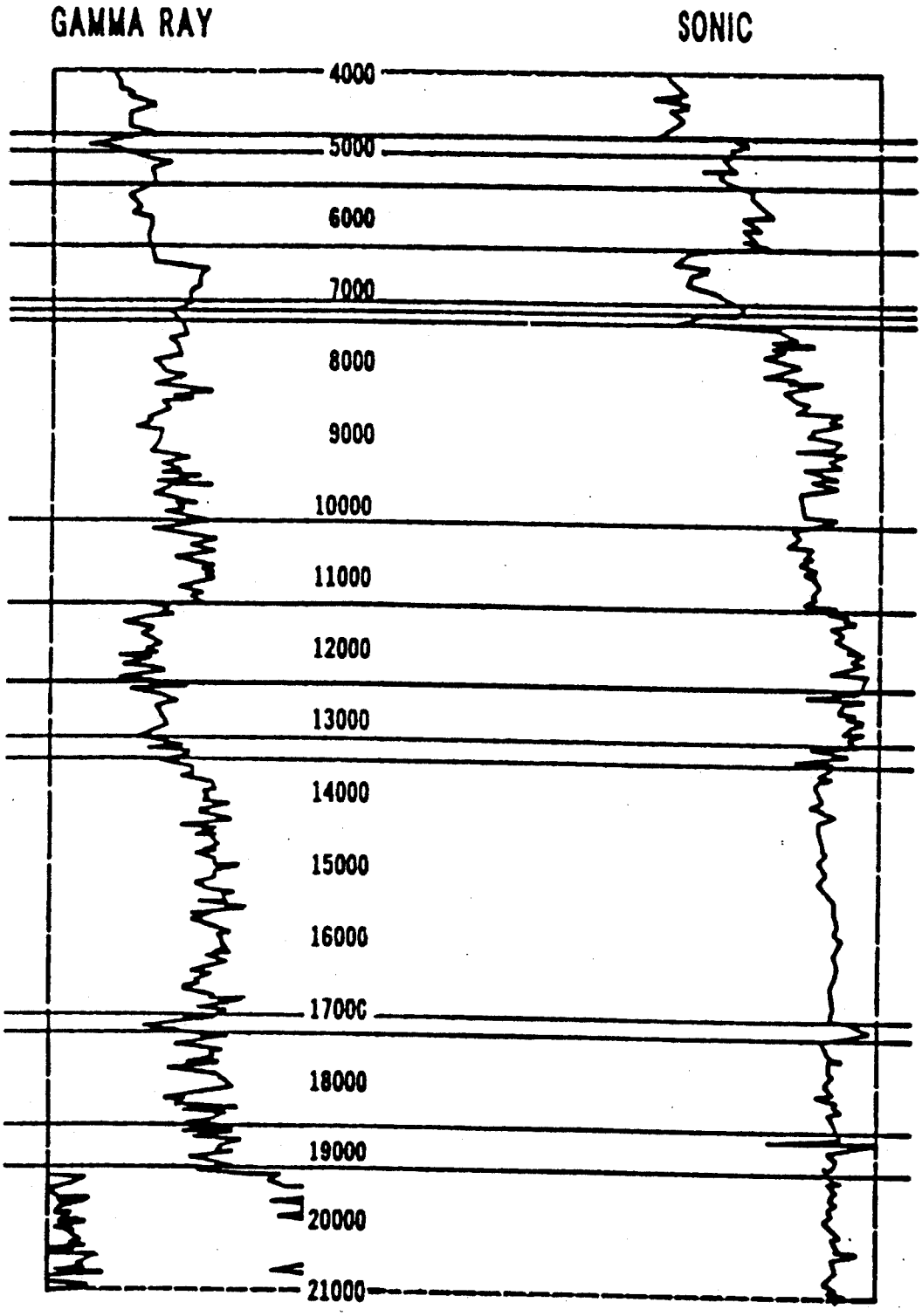
Figure 45:
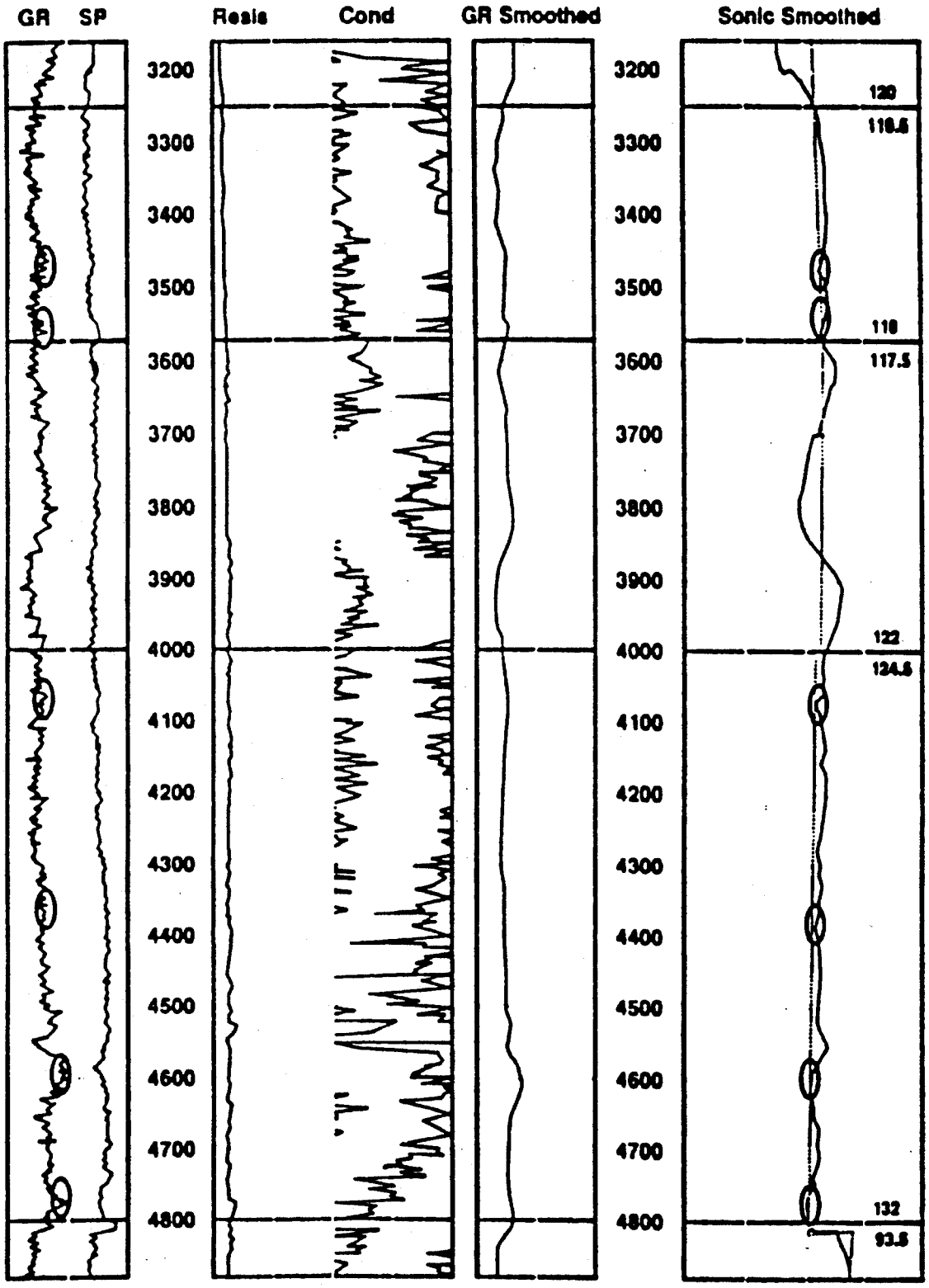
Figure 46:
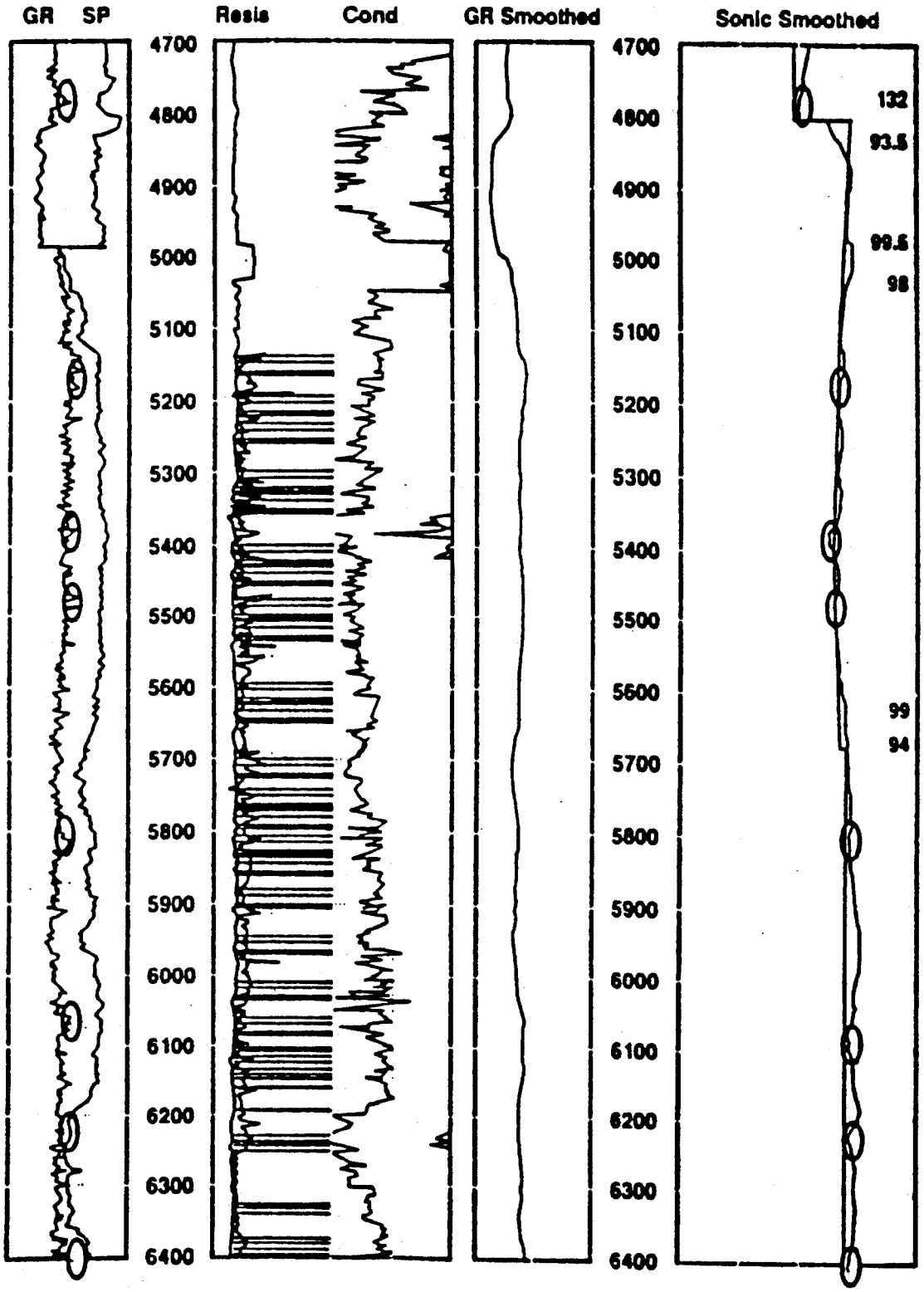
FIGS. 46 to 60 are similar plots useful in connection with Example III of this specification, as directed to predicting pore pressures in a carbonate drilling environment.
Figure 47:
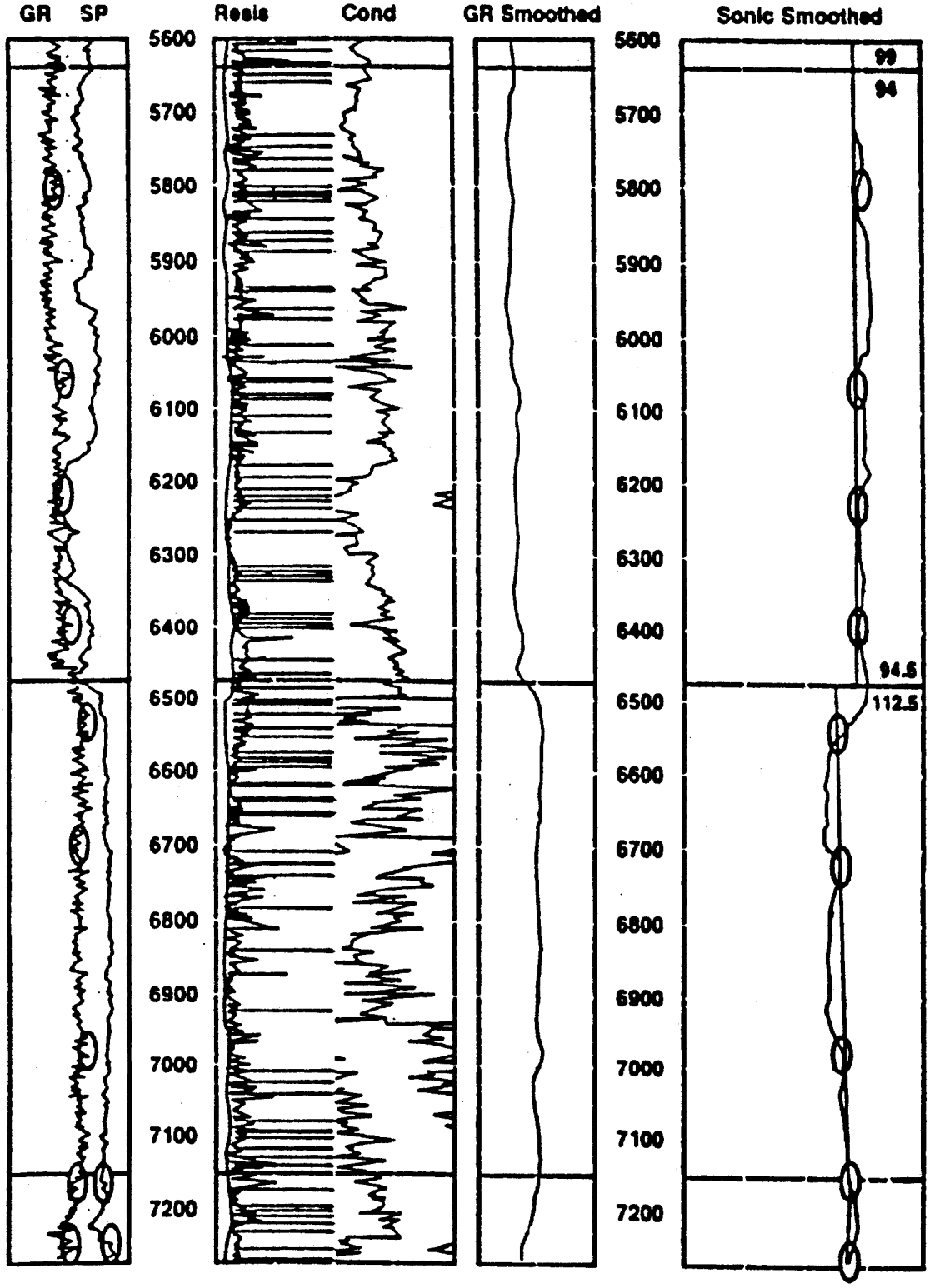
Figure 48:
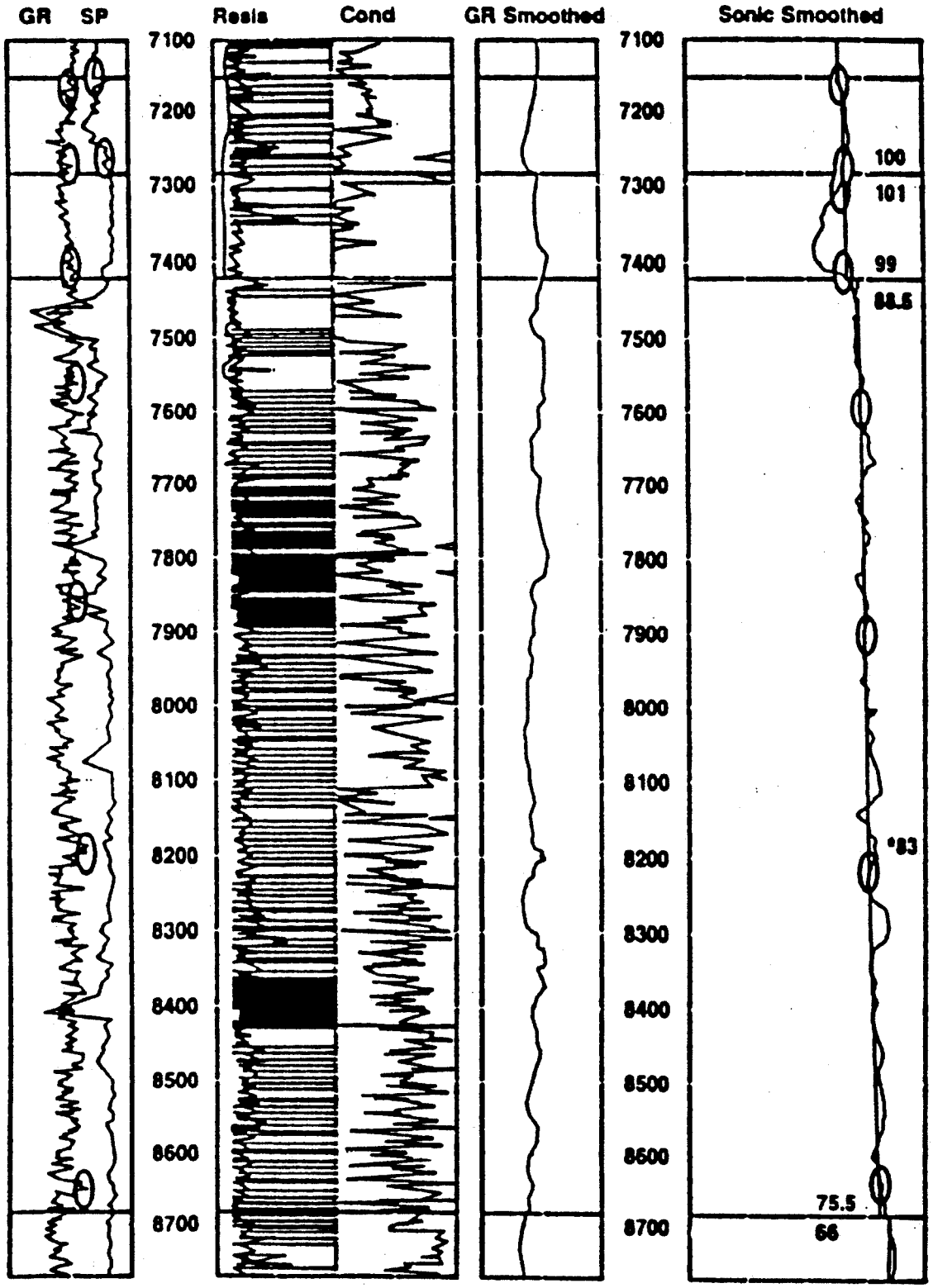
Figure 49:
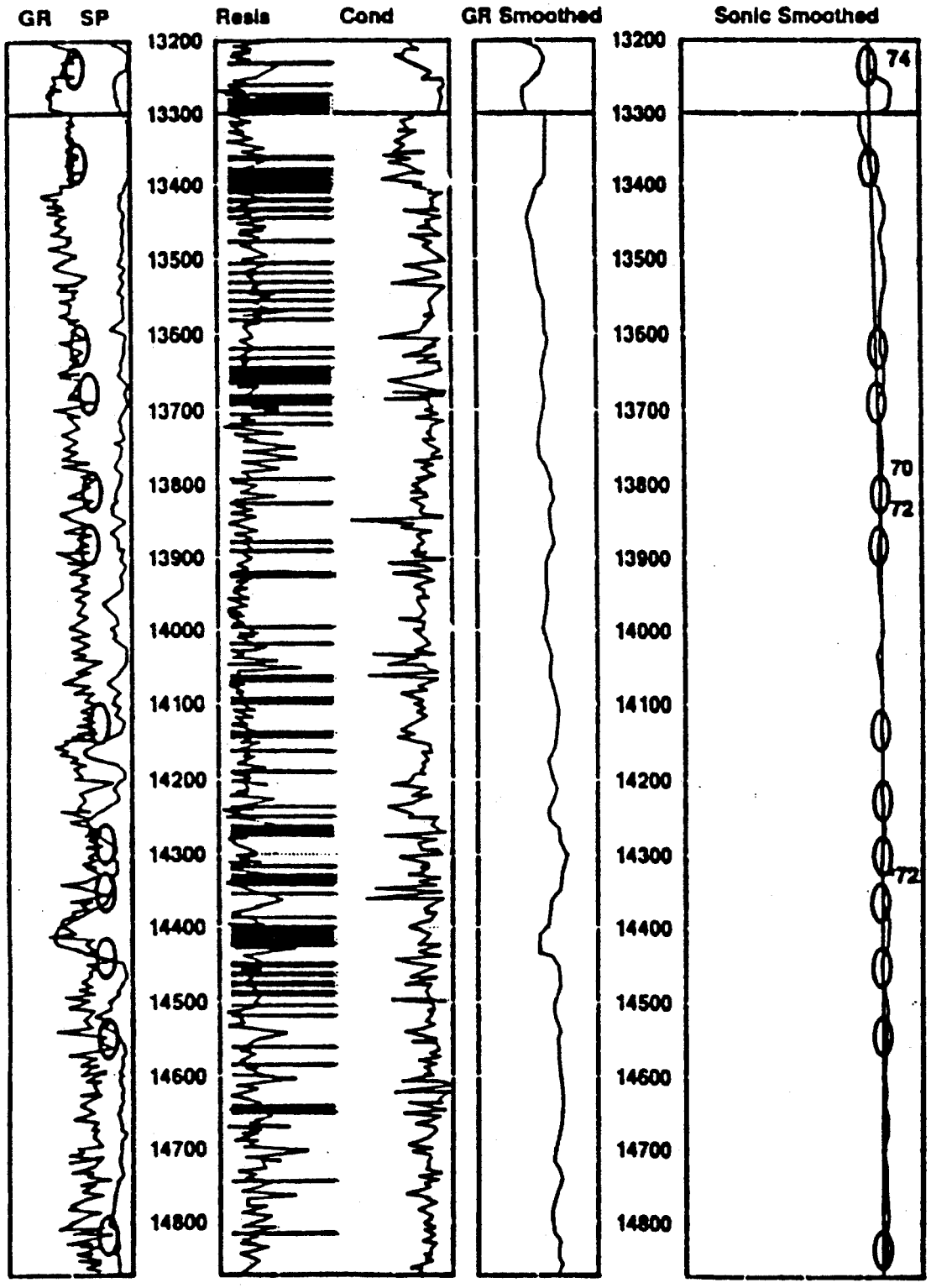
Figure 50:
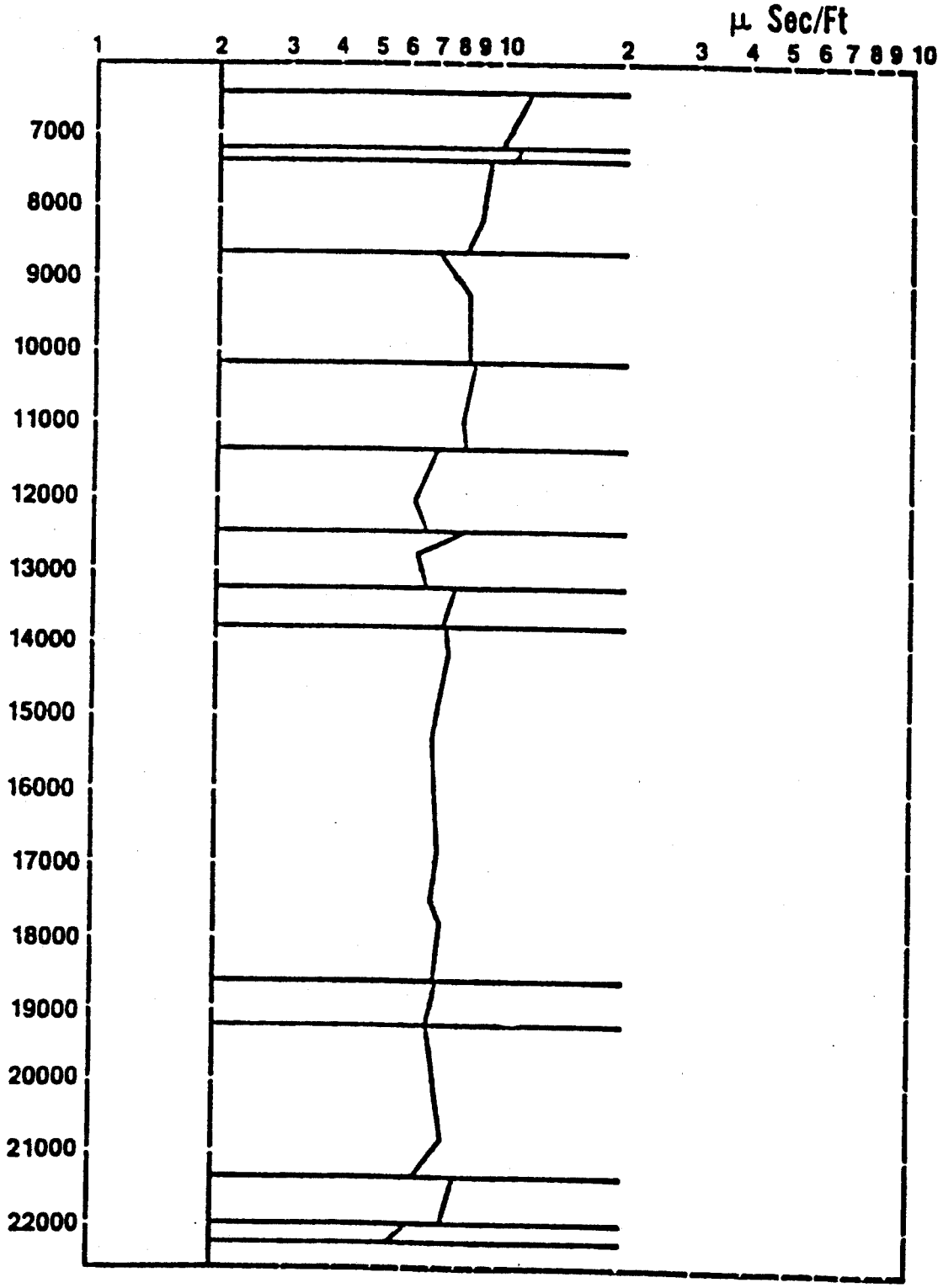
Figure 51:
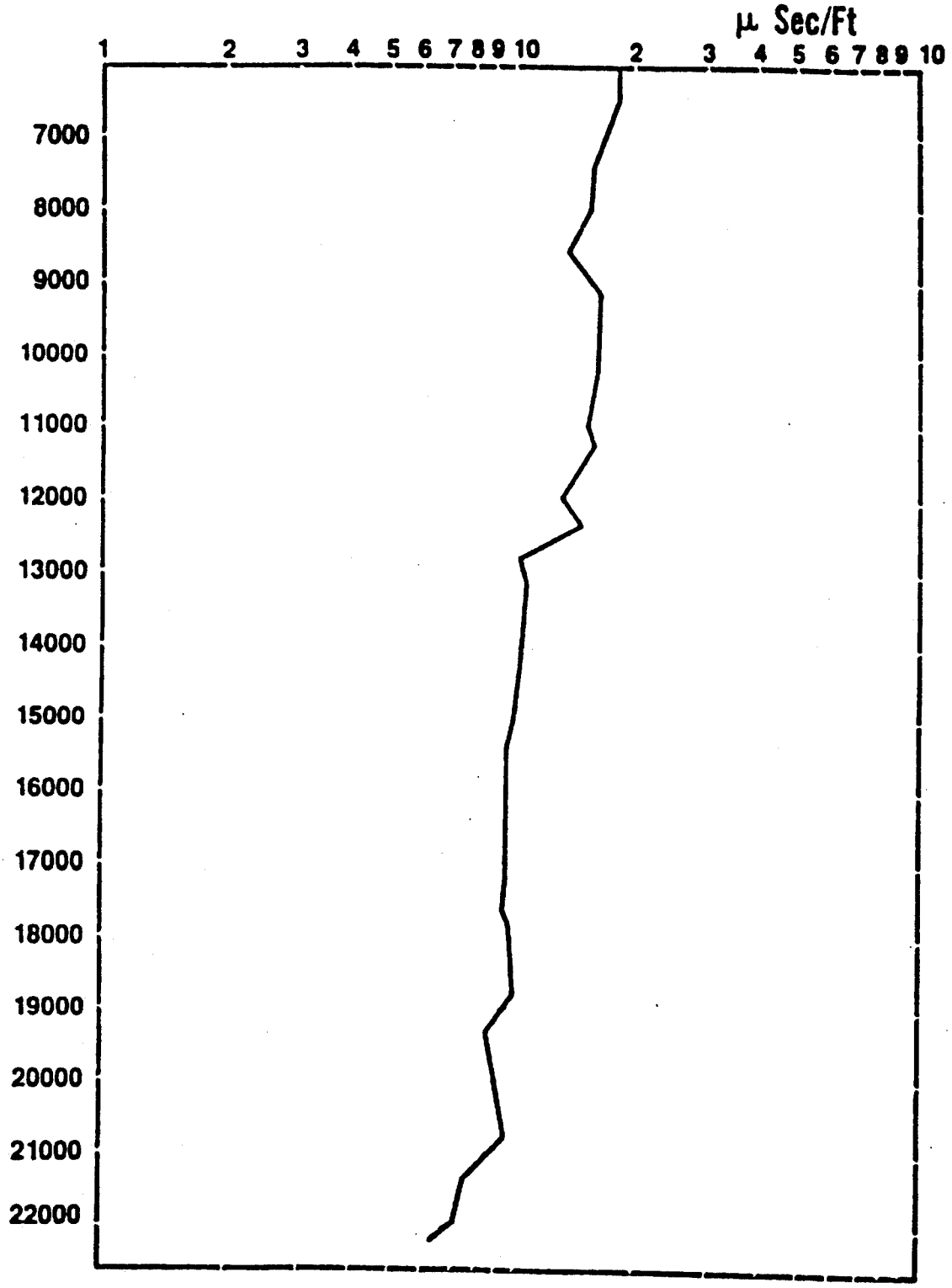

This procedure is based upon the premise that such carbonates contain some sand and some shale which particularly generate a gamma ray of either sand or shale. Further, such responses correlate with sonic log traces as indicated in FIG. 44 so that lithology tops may be picked by changes in the general trend of both logs. In FIG. 44 the lithological tops are indicated by the horizontal lines on a one inch equals 1000 feet of depth.

The gamma ray and sonic are then displayed in a one inch equals one hundred foot scales. Again smoothing may be required. The lithology tops previously determined are translated to this display. Next to this data are plotted an unsmoothed version of the gamma ray, as well as an SP (self potential) resistivity and conductivity curves, as in FIGS. 45 through 49.

Within lithological sections, the gamma ray peaks show a trend to the right in the shale direction, as circled in FIGS. 45 through 49. With respect to these gamma ray peaks to the right the sonic log velocity trend lines are drawn so that the sonic velocities correspond to the gamma ray intervals previously circled. These corresponding sonic velocities have also been circled in FIGS. 45 through 49 and the corresponding trend lines drawn. It is to be noted that in some instances in these figures that the velocity trend lines appear on the left of the sonic log, and in others on the right. The sonic velocity trend lines are then drawn on semilogrithmic paper, honoring lithology tops as in FIG. 50.

These lithology tops then become recalibration points in this method. The sonic velocity trend is traced in one lithological section. The velocity trend is recalibrated by shifting the tracing over at the lithology change, joining the last value of interval velocity in the last lithological section with the first value in the next. This results in a continuous relative interval velocity profile as in FIG. 51.

Figure 52:
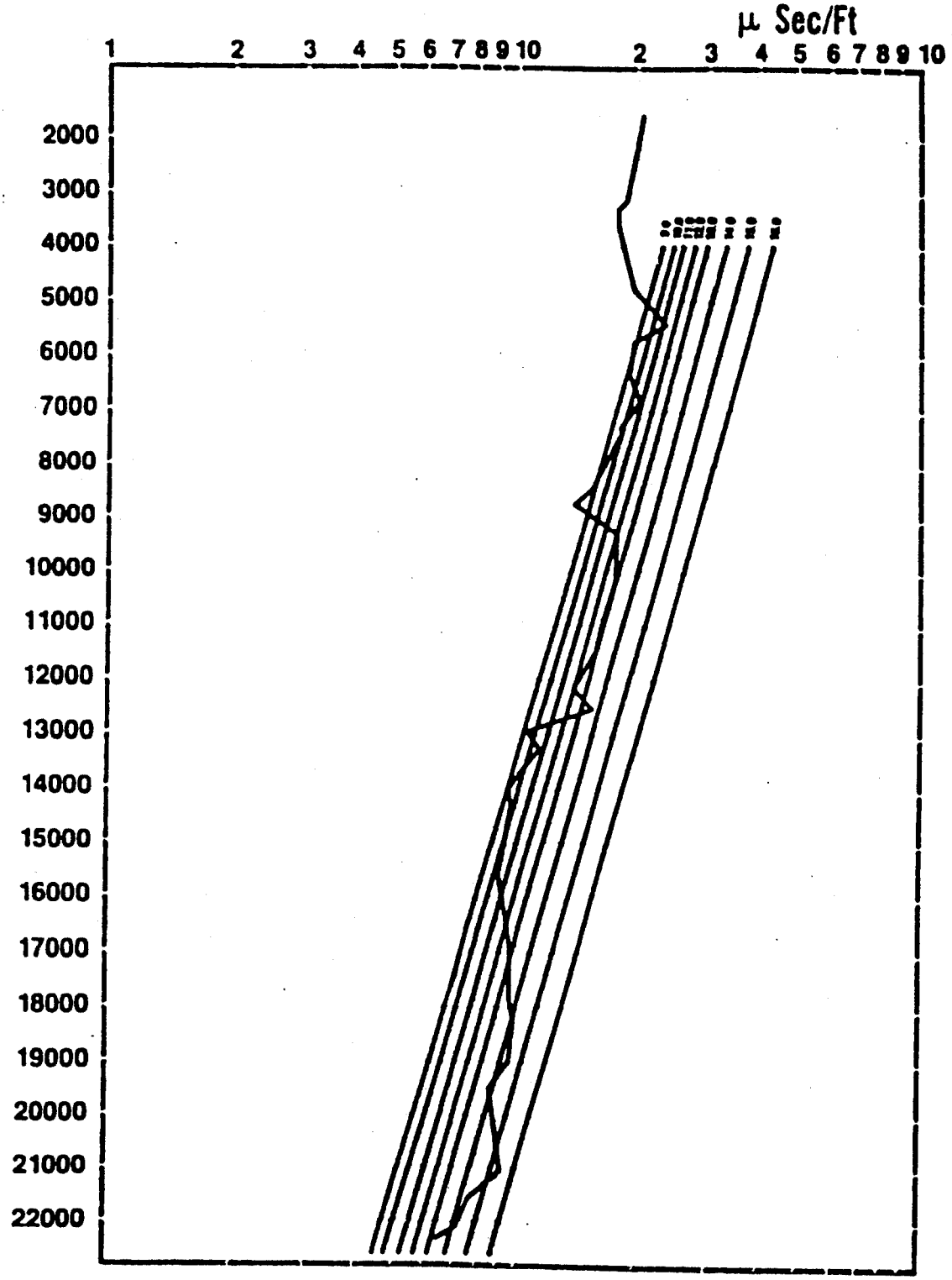
Figure 53:
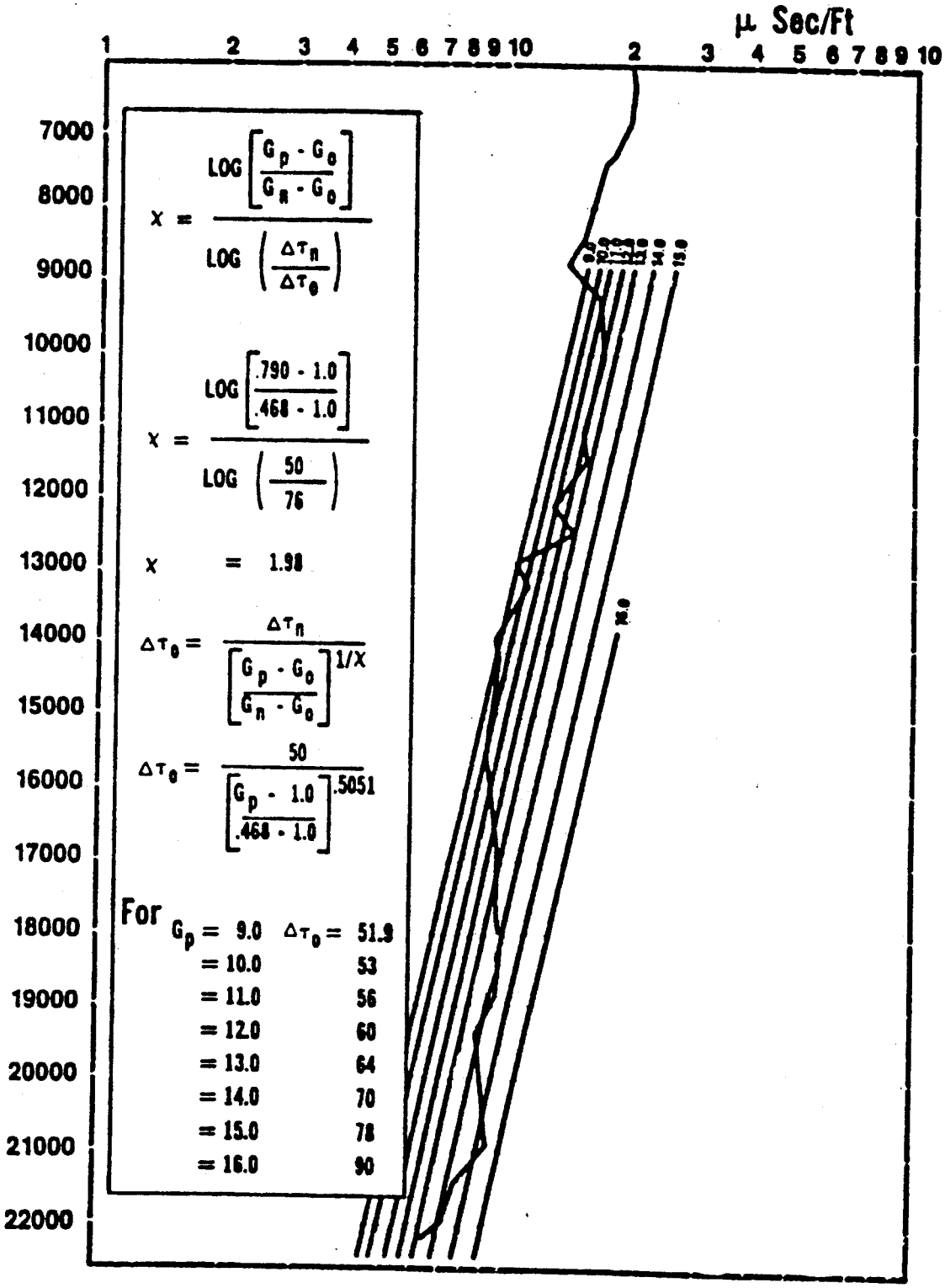
Figure 54:
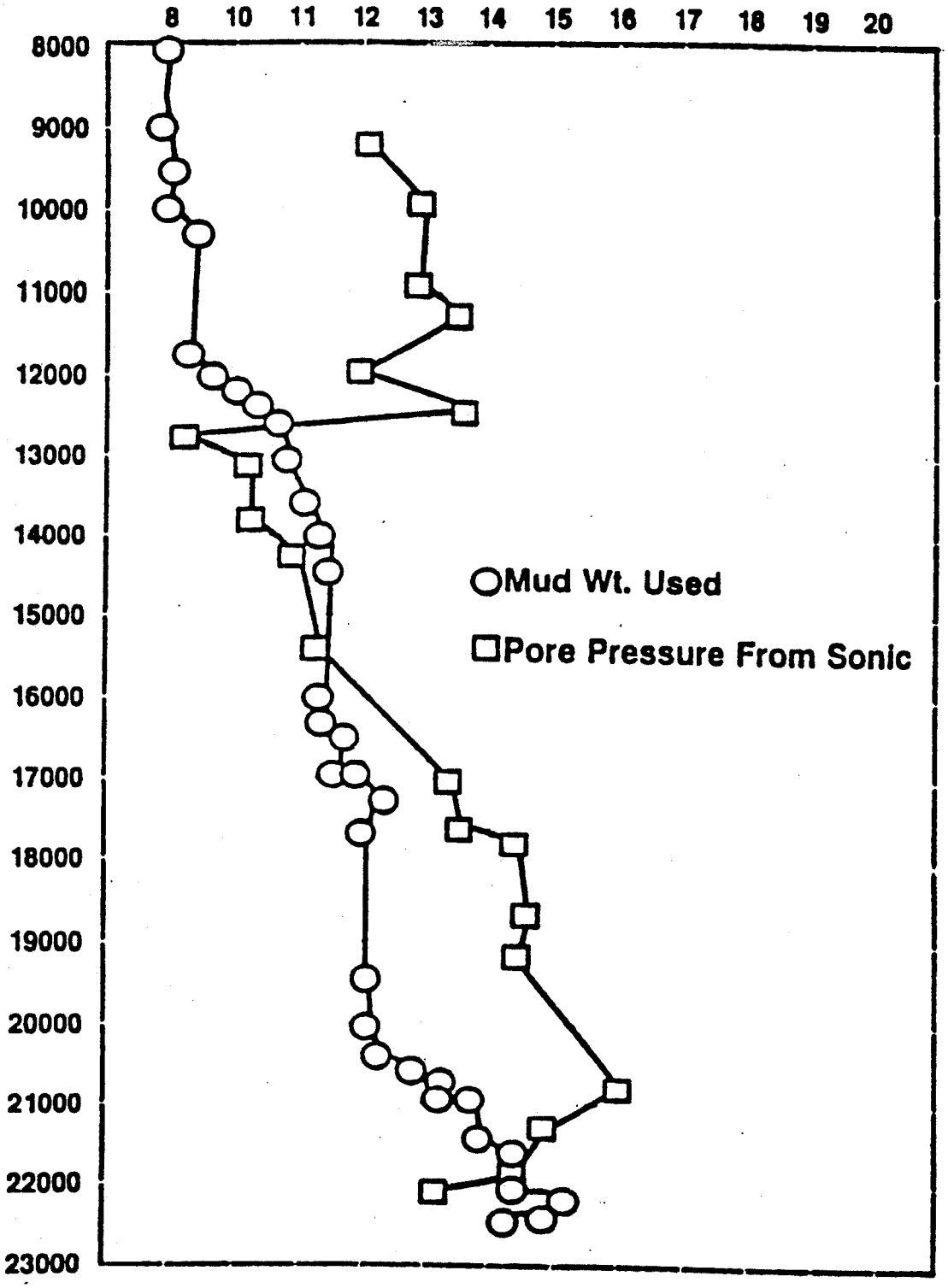
Figure 55:
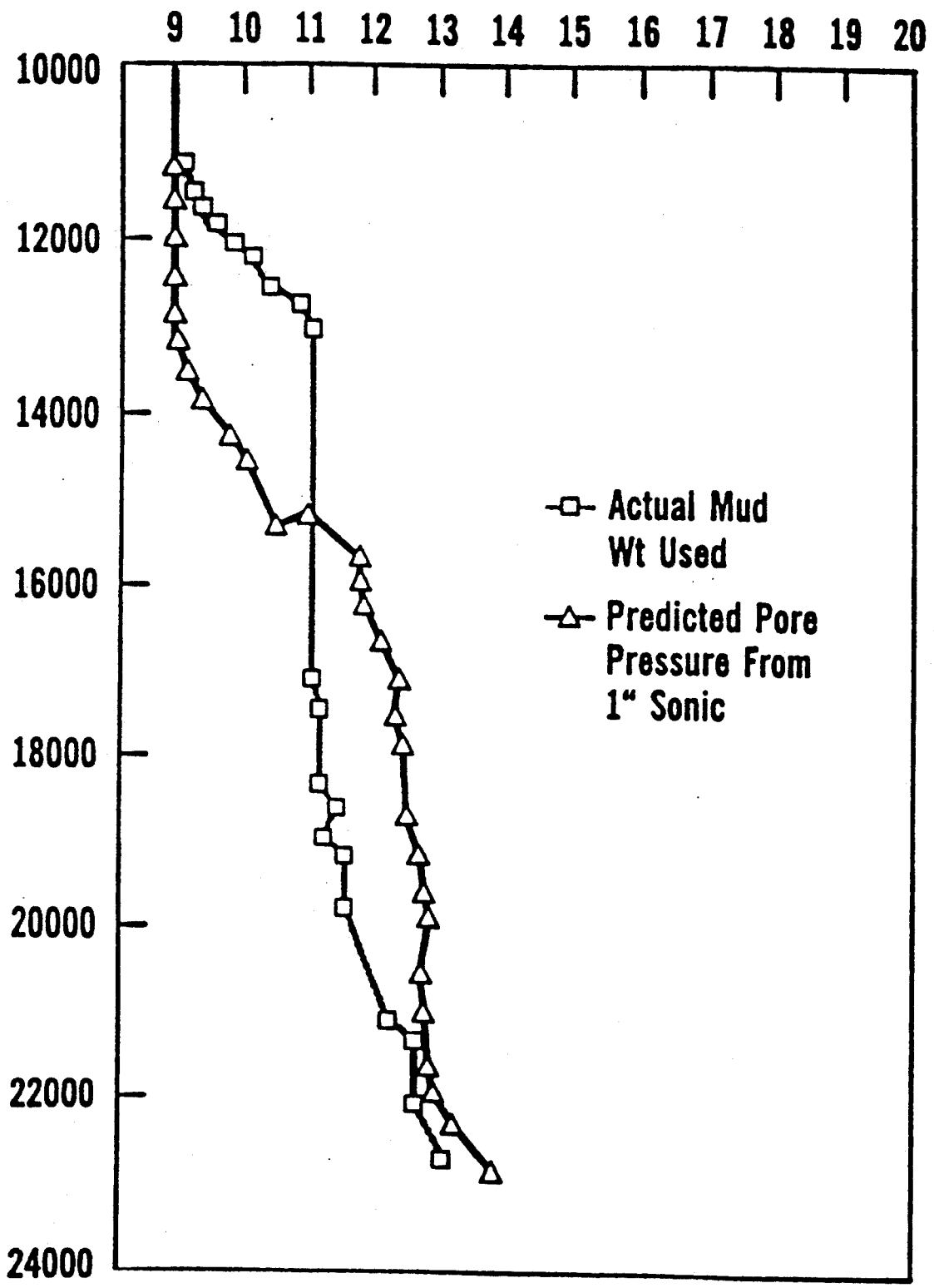
Figure 56:
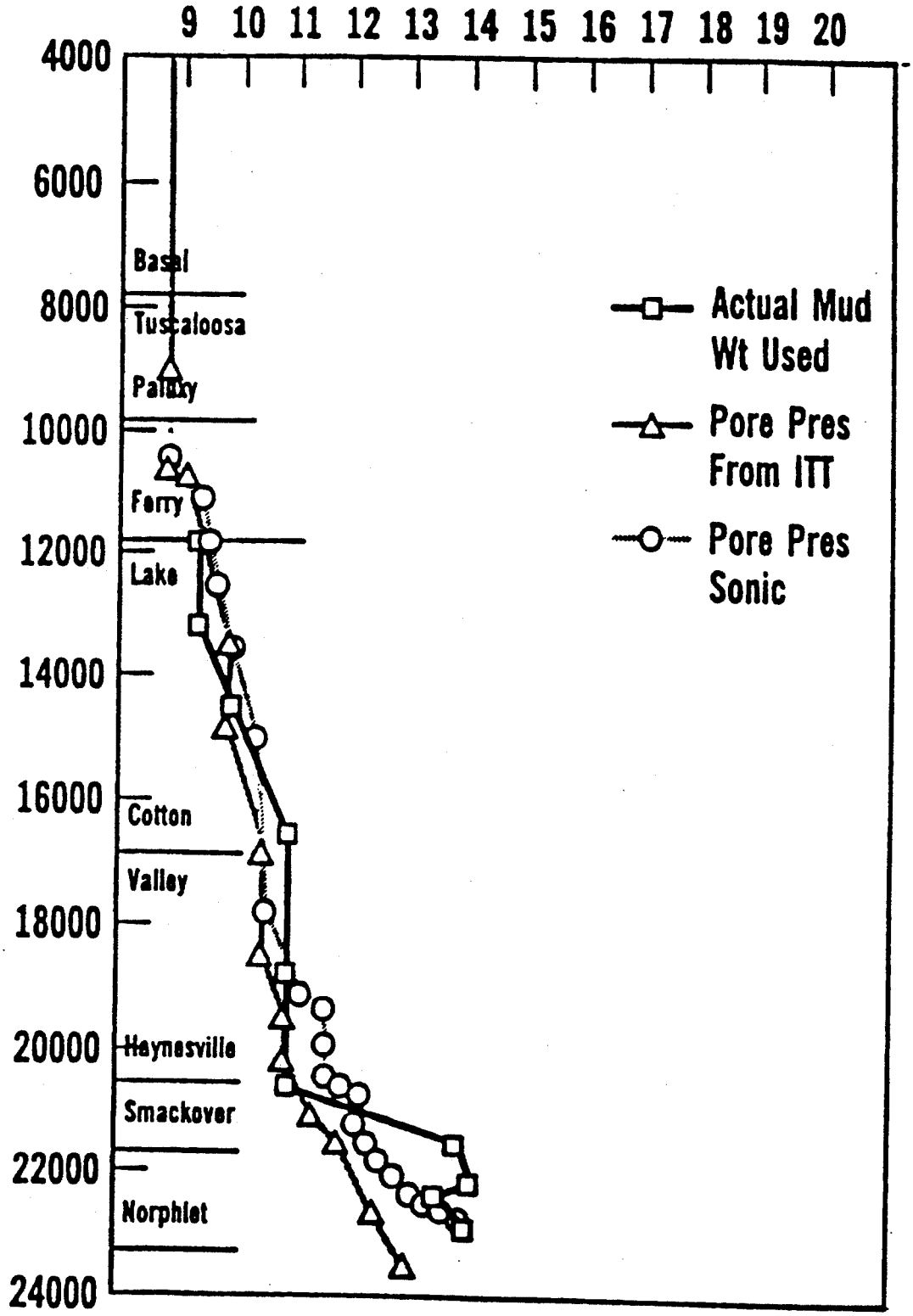
Figure 57:
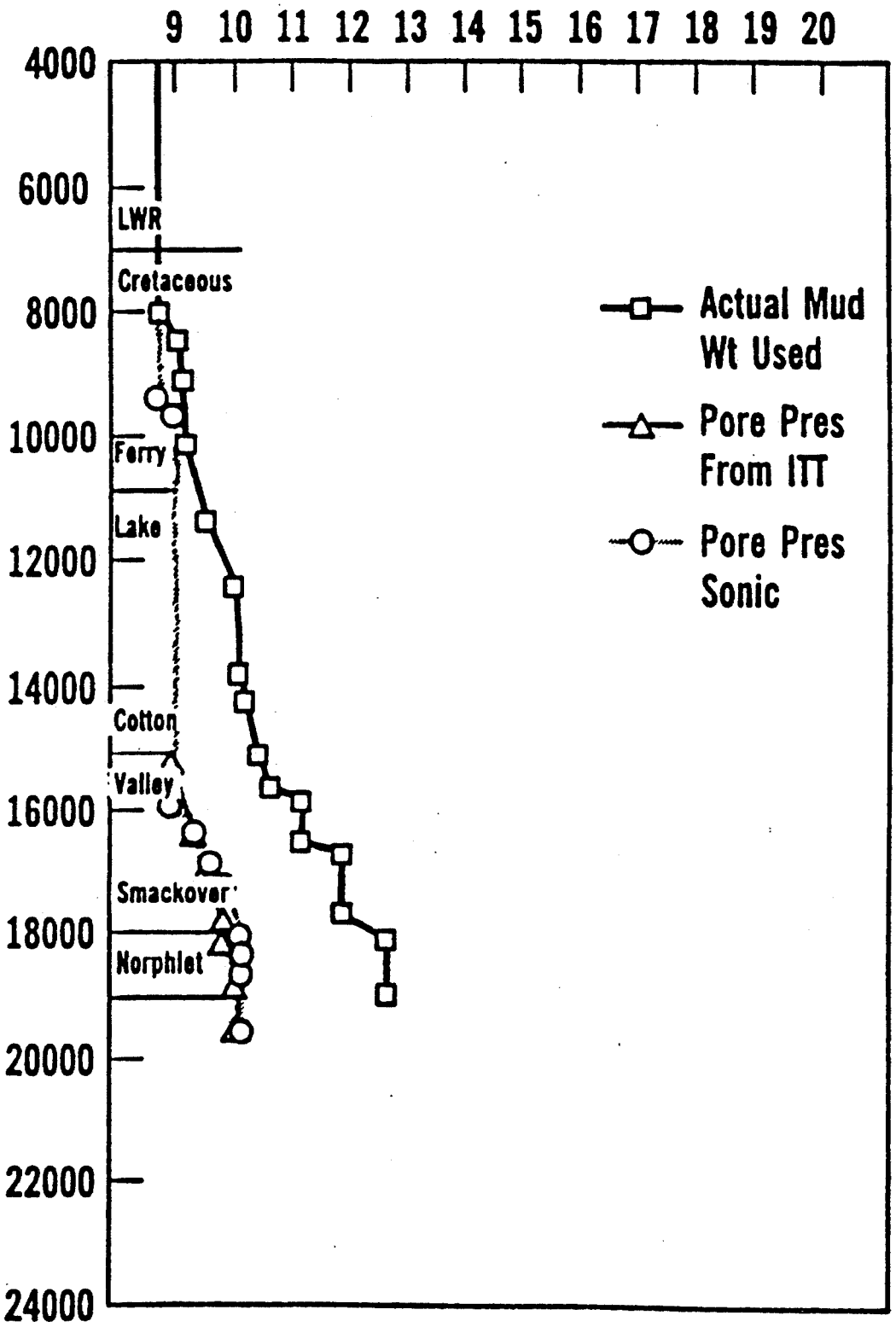
Figure 58:
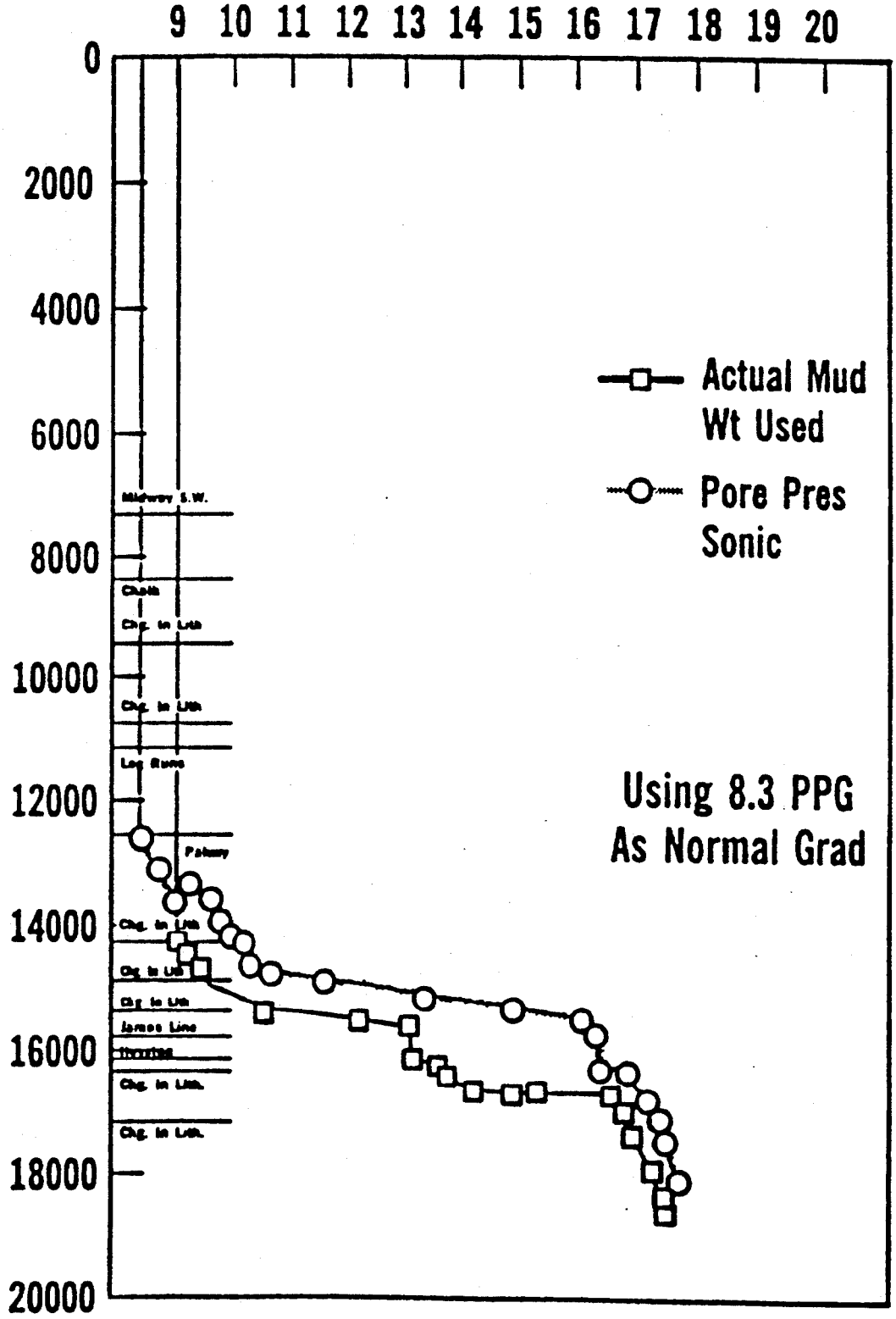
Figure 59:
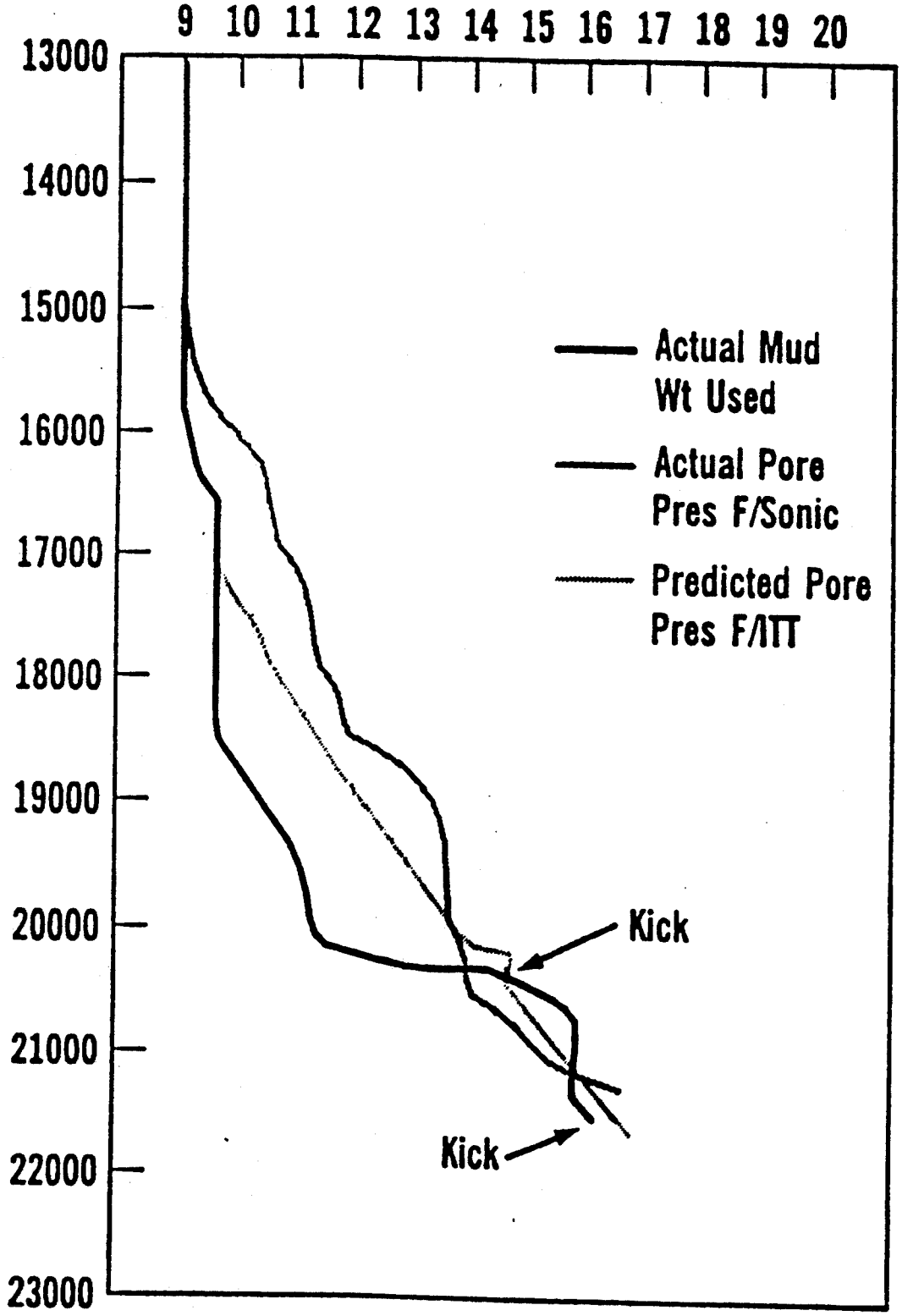
Figure 60:
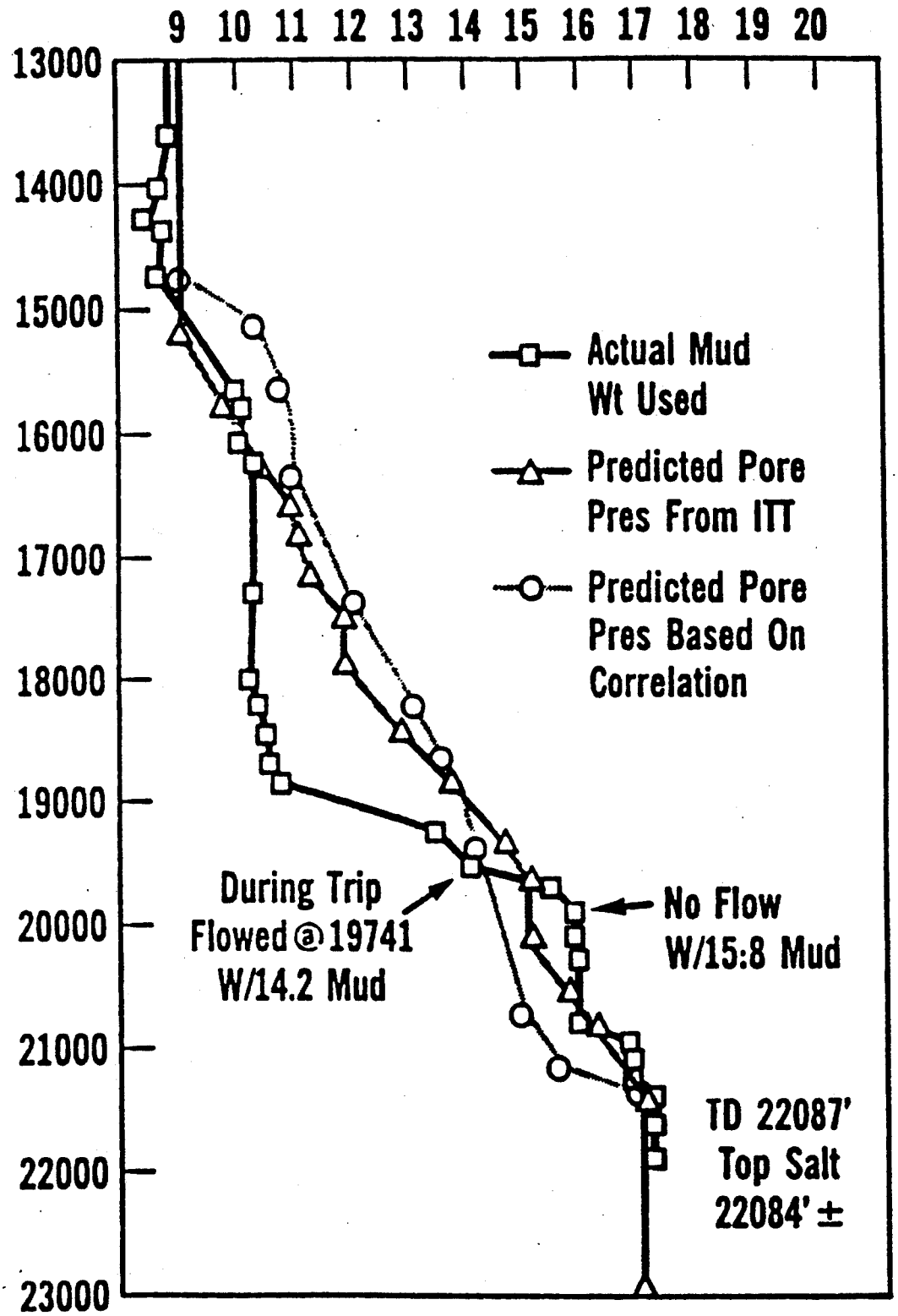

As seen in FIG. 52, a normal trend line is drawn through the normally pressured, normally compacted section of the hole from 5400 to 8700 feet.

In this well formation pore pressure at 21,000 feet was know to be 15.2 ppg equivalent mud weight. By integrating the bulk density log the overburden gradient was determined. The pore pressure exponent is then solved from these values to create an overlay for the area. This has been done in FIG. 53. Determination of pore pressure for all formations can now be read directly from this overlay. This has been done with results graphically displayed in FIG. 54. Note that in the intervals which appear to have been drilled with the mud weight under-balanced, difficulties with torque and drag were encountered. All the formations encountered lacked permeability, other than the formation at 21,000 feet which had low permeability. The pressure of this formation was approximately 15.2 ppg pore pressure so that formation fluid continued to flow at a rate of roughly ¾ a barrel per hour with a mud weight as high as 14.9 ppg in the hole. The bottom portion of the well experienced a pressure regression and mud weights could be reduced.

In the foregoing, it is important to recognize which side of the sonic log trend lines need be drawn. In many instances, it may be necessary to change from one side to the other upon crossing lithology tops. In FIG. 45 through 49, from close examination of the sonic response with respect to gamma ray intervals selected, it was necessary to switch from plotting trend lines on the right to the left side of the sonic log and vice versa.

EXAMPLES OF RESULTS

FIGS. 55 through 60 illustrate excellent results obtained in carbonate regions using this method.

From the foregoing it will be seen that the present method of determining pore pressures from sonic velocity trends is applicable over greatly varying geological provinces. It will be apparent a particular factor, among others, is the need to determine the location of lithological tops. These indicate the significant changes in sonic velocities in a seismic trace to permit identification of actual depths in a step-out well. Additionally, creation of area specific overlays of such lithology tops relative to normal compaction trends greatly simplifies and aids in determining pore pressures and with specific application to carbonate environments and correlating gamma ray logs to identify shale trends in such carbonates in particularly significant in such pore pressure predictions.

An appropriately programmed computer may be used to perform any number of the steps in the above-described method and exemplary description. Many statistical and graphical software programs are also available and may be adapted by those skilled in the art to perform the method of the present invention.

In summary, the present invention is directed to the use of seismic data recorded over a proposed well site to predict the depths at which over pressured (or under-pressured) formations will be encountered at depth. Such methods depended upon a detailed knowledge of two measurements of values that are seldom known. These are (1) the "normal" trend of hydrostatic or geostatic fluid pressures down through the same depth intervals and (2) the correlatable seismic "events" (distinguishable seismic reflections) represented as the changes in lithology at depth from the seismic amplitude-time trace.

The "depths" assigned to the composite seismic trace depend upon a detailed knowledge of the age of the strata traversed by the transmitted and received seismic waves. Alternatively, the "interval" velocities of each layer of rock, or strata, or seismic wave from the earth's surface to depth and reflected back to a group of detectors.

Although the "normal" trend of geopressures are determinable by a direct measurement of such pressures encountered by a well drilled in the general vicinity of the desired well, they are seldom measured in such a well above depths where abnormal pressures are expected or encountered. Accordingly, "normal" pressure at a desired depth in a given well (within less than 10 feet, and preferably even within one or two feet) is seldom available. In the absence of such detailed data, a general "trend" is merely estimated.

Accordingly, such estimates when used to indicate pore pressures at critical depth intervals in a drilling well are frequently not reliable. The present invention makes possible accurate prediction of such values from a seismic trace at a proposed drill site by correctly calibrating the normal geopressure trend of strata extending over critical depths of the proposed well so that pore pressures calculated from seismic ITT curves and well logs in a drilled well correspond to pore pressures measured in strata penetrated by a proposed well bore at the correct depth.

Various modifications and changes in the methods of the present invention will be apparent to those skilled in the art from the foregoing specification. All such modifications or changes coming within the spirit and scope of the following claims are intended to be included therein.

I claim:

1. A method of predicting pore pressure at a selected depth in a proposed well bore to be drilled from a given location in a geological basin comprising the steps of:

(a) in a well bore drilled in the vicinity of said given location, generating a suite of pore pressure values from measured parameters recorded in said well bore over a depth interval drilled through said selected depth, (b) generating a seismic interval transit time (ITT) curve from seismic traces generated and recorded over said depth interval by a multiplicity of sources and detectors having common reflection points proximate to said drilled well bore and through said selected depth, (c) selecting a normal ITT curve extending through said depth interval of said seismic ITT curve, (d) adjusting the slope and intersection of said normal ITT curve with said seismic ITT curve to minimize the differences between said suite of measured pore pressure values over said depth interval and a comparable suite of pore pressures calculated from values of said seismic ITT curve and said normal ITT curve extending over said depth interval to generate at least one modified normal ITT curve, (e) then generating another seismic ITT curve at said given location extending through said selected depth, and (f) calculating a similar suite of pore pressures over said selected depth from said other seismic ITT curve and said modified normal ITT curve to indicate pore pressures at said selected depth in said proposed well bore.

2. A method for determining pore pressures in a formation below a proposed drilling location prior to drilling a well bore at said location comprising the steps of:

(a) selecting an offset well bore at a location in the vicinity of said proposed drilling location;

(b) generating a seismic Interval Transmit Time (ITT) log derived from surface seismic data over common depth points adjacent said offset well bore location and over a depth interval including said formation;

(c) mutually calibrating a suite of calculated pore pressures determined by (1) said seismic interval transmit time (ITT) log and (2) a normal interval transit time log extending through said selected depth interval penetrated by said well bore with a suite of pore pressures measured in said offset well bore;

(d) said calibration reducing the differences between said calculated and said measured pore pressures to approach a minimum in a resulting calibrated normal ITT log (e) generating another seismic interval transit time log from common depth points at said proposed drilling location; and (f) generating a suite of pore pressures from said other seismic interval transit time log and said calibrated normal ITT log over a similar depth interval below said proposed drilling location whereby pore pressures of formations penetrated by a bore hole at said proposed location may be counterbalanced by drill fluid weight and casing sealed in said bore hole.

3. In a method of predicting pore pressure at a selected depth in a proposed well bore at a given location in a geological area and wherein another well has been drilled at an adjacent location and the pore pressures of strata drilled by said other well have been measured and a seismic interval transit time (ITT) curve has been generated from a group of seismic traces for common mid-points (CMP's) adjacent said other well, the improvement comprising generating a normal interval transmit time (ITT) curve for calculation of pore pressures over said selected depth in said proposed well bore from a similar seismic ITT curve recorded from seismic traces for common mid-points adjacent said proposed well, said normal ITT curve being derived by calibration of a suite of pore pressures calculated from said recorded seismic ITT curve generated adjacent said other well and an assumed normal interval transit time curve at said other well with a comparable suite of said pore pressures measured in said other well, and adjusting said assumed normal ITT curve in an amount and to an extent relative to said seismic ITT curve so that the sum of the differences in said measured and the calculated suites of pore pressures approach a minimum value over said selected depth, and then calculating another suite of pore pressures from said similar seismic ITT curve and the derived normal ITT curve.

4. A method in accordance with claim 3 wherein said normal and said seismic ITT curves are plotted and the spacing of said curves relative to each other is progressively changed and a separate suite of pore pressures is calculated for each such change and plotted against said measured suite of pore pressures in said other well bore.

5. A method of predicting pore pressure at a selected depth in a subterranean formation traversed by a well to be drilled from a proposed location comprising the steps of:

(a) generating a suite of pore pressures in said subterranean formation from well data measured in an offset location well traversing said formation in the vicinity of said well to be drilled;

(b) generating a seismic Interval Transit Time (ITT) curve from a suite of common mid-point traces recorded for a position extending downwardly through said formation adjacent said offset well location;

(c) generating a synthetic normal ITT curve to correlate said suite of pore pressures generated by said well data with a suite of pore pressures calculated from said seismic Interval Transit Time curve at said offset well location; said synthetic normal interval transit time curve substantially matching the suite of pore pressures calculated from said curves to said suite of measured pore pressures;

(d) generating another seismic ITT curve from a multiplicity of common mid-points of seismic surface data having a common mid-point extending downward from the proposed location of said well to be drilled through said formation; and (e) calculating a suite of pore pressures through said formation from the proposed location based on said other seismic ITT curve at the proposed location and said synthetic normal Interval Transit Time at the offset location.

6. A method for determining pore pressures in formations to be traversed by a proposed well bore at a location prior to drilling said well bore comprising the steps of:

(a) selecting a well bore drilled at an offset location in the vicinity of the proposed drilling location;

(b) plotting a seismic interval transit time (ITT) curve derived from surface seismic data for common depth points adjacent said offset location and over a depth interval including said formations to be traversed by said proposed well bore;

(c) calibrating a normal trend interval transit time curve and said seismic interval transit time curve in accordance with a suite of pore pressures recorded in said offset location well bore and a similar depth interval of said formations, said calibration including calculating a suite of pore pressures from said seismic interval transit time curve and an assumed normal trend interval transit time curve, each value of said suite of calculated pore pressures corresponding to a recorded value of said suite of measured pore pressures to generate substantially equal values over depths within said formations, as traversed by said offset well bore;

(d) generating a similar seismic ITT curve for said proposed drilling location; and (e) calculating a suite of pore pressures through corresponding portions of said formation at said proposed drilling location using the calibrated normal trend interval transit time curve from step (c) to predict the pore pressures at the correct depths in said formations at said proposed drilling location.

7. The method in accordance with claim 6 wherein said normal ITT curve is calibrated by sequentially calculating said suite of pore pressures by successively modifying at least portions of the slopes and inflection points of said normal trend curve relative to said seismic interval transit time curve to minimize the differences between said suite of calculated pore pressures and said suite of measured pore pressures.

8. The method in accordance with claim 6 wherein said normal trend interval transit time curve is calibrated by calculating a suite of normal transit time values from a suite of interval transmit times measured along the length of said well bore over a given interval of said formation to generate a well bore pore pressure gradient curve and an overburden pore pressure gradient curve and plotting successive adjustments of said normal trend interval transit time curve relative to said seismic interval transit time curve to determine the values of said suite of calculated pore pressures over a given depth interval from said seismic ITT curve corresponding to the suite of pore pressures measured in said offset well bore.

9. A method of determining pore pressure in a formation to be penetrated by a proposed well bore in a geological province where few well bores have been drilled comprising the steps of (a) recording in at least one well bore of said few drilled well bores (1) at least one pore pressure at a substantial depth below said formation to be penetrated by said proposed well bore, (2) at least one pore pressure at a depth substantially above said formation and (3) the Interval Transit Times (ITTs) at each of said depths, (b) then selecting an initial normal trend curve of ITTs versus depth for sedimentary formations in said geological province from the values recorded in step (a).

(c) recording over a selected depth interval of said one well intermediate the depths at which said pore pressures and said ITTs were recorded in step (a) (1) a suite of additional pore pressures and (2) a corresponding suite of interval transit times, (d) generating a seismic interval transit time ITT curve from a multiplicity of seismic traces having common mid-points at a location adjacent said one well bore and extending downwardly through said selected depth interval at a location adjacent said one well bore, (e) calibrating said initial normal trend curve selected in step (b) relative to said seismic ITT curve to generate a suite of calculated pore pressures over said selected depth interval generally corresponding in values over said depth interval to said suite of pore pressures recorded in said one well bore to identify correctly the depth interval along said seismic ITT curve of said suite of recorded pore pressures, (f) recording another seismic interval transit time (ITT) curve for a set of common mid-points in the vicinity of said proposed well bore to be drilled through similar formations in said geological province and (g) calibrating said other seismic ITT curve in accordance with the calibration of said normal trend curve generated in step (e) to calculate a similar suite of pore pressures over the corrected depth interval through said formations to be drilled by said proposed well bore to permit control of fluid pore pressures to be encountered during the drilling of said other well bore.

10. A method in accordance with claim 9 wherein calibration of said initial normal trend curve through said formation to be penetrated in said geological province in step (e) includes calculating the exponent for conversion of values measured by well logs in said one well bore, including interval transit time logs, into equivalent pore pressures for each measurement of a plurality of interval transit times at corresponding depths of said suite of pore pressures measured in said one well bore.

* * * * *